US011135849B2

(12) United States Patent
Matsuoka et al.

(10) Patent No.: US 11,135,849 B2
(45) Date of Patent: Oct. 5, 2021

(54) LIQUID EJECTING APPARATUS AND MAINTENANCE METHOD OF LIQUID EJECTING APPARATUS

(71) Applicant: SEIKO EPSON CORPORATION, Tokyo (JP)

(72) Inventors: Hiroki Matsuoka, Azumino (JP); Chikashi Nakamura, Azumino (JP); Shunsuke Kuramata, Shiojiri (JP); Shuhei Harada, Chino (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 10 days.

(21) Appl. No.: 16/505,380

(22) Filed: Jul. 8, 2019

(65) Prior Publication Data

US 2020/0009871 A1 Jan. 9, 2020

(30) Foreign Application Priority Data

Jul. 6, 2018 (JP) ..... JP2018-128843

(51) Int. Cl.
*B41J 2/165* (2006.01)

(52) U.S. Cl.
CPC ..... *B41J 2/16535* (2013.01)

(58) Field of Classification Search
CPC ..... B41J 2/16535; B41J 2/165525; B41J 2/16585; B41J 2002/16558; B41J 2002/1655
See application file for complete search history.

(56) References Cited

U.S. PATENT DOCUMENTS

| | | | |
|---|---|---|---|
| 2010/0245466 | A1 | 9/2010 | Inoue |
| 2012/0038707 | A1 | 2/2012 | Maida |
| 2017/0334209 | A1 | 11/2017 | Nakano |

FOREIGN PATENT DOCUMENTS

| | | |
|---|---|---|
| JP | 2004-338223 | 12/2004 |
| JP | 2005-021809 | 1/2005 |
| JP | 2005-224700 | 8/2005 |
| JP | 2007-007977 | 1/2007 |
| JP | 2007-275793 | 10/2007 |
| JP | 2010-234666 | 10/2010 |
| JP | 2010-280067 | 12/2010 |
| JP | 2012-040693 | 3/2012 |
| JP | 2013-159007 | 8/2013 |
| JP | 2013-159008 | 8/2013 |
| JP | 2017-159491 | 9/2017 |
| JP | 2017-205954 | 11/2017 |

*Primary Examiner* — Kristal Feggins
(74) *Attorney, Agent, or Firm* — Workman Nydegger

(57) ABSTRACT

A liquid ejecting apparatus includes a liquid ejector that ejects a liquid from a nozzle, a wiping mechanism that wipes a nozzle surface on which a plurality of nozzles is disposed with a wiping member, and a wiping-liquid supply mechanism that supplies a wiping liquid to the wiping member. The liquid ejecting apparatus is configured to perform wet-wiping of wiping the nozzle surface in a state where the wiping member has absorbed the wiping liquid and is configured to change a supply amount of the wiping liquid when the wiping member wipes the nozzle surface.

15 Claims, 33 Drawing Sheets

LIQUID EJECTING APPARATUS AND MAINTENANCE METHOD OF LIQUID EJECTING APPARATUS

The present application is based on, and claims priority from JP Application Serial Number 2018-128843, filed Jul. 6, 2018, the disclosure of which is hereby incorporated by reference herein in its entirety.

BACKGROUND

1. Technical Field

The present disclosure relates to a liquid ejecting apparatus, for example, an ink jet printer, and to a maintenance method of the liquid ejecting apparatus.

2. Related Art

JP-A-2007-275793 discloses a droplet discharge device that includes a wiping sheet for wiping a head configured to discharge a droplet and a washing-liquid spraying mechanism configured to spray a washing liquid onto the wiping sheet, as an example of the liquid ejecting apparatus.

In the droplet discharge device disclosed in JP-A-2007-275793, the washing liquid to be sprayed onto the wiping sheet may be insufficient. In such a case, it may not be possible to properly perform wiping.

SUMMARY

According to an aspect of the present disclosure, a liquid ejecting apparatus includes a liquid ejector that ejects a liquid from a nozzle, a wiping mechanism that wipes a nozzle surface on which a plurality of nozzles is disposed with a wiping member configured to absorb the liquid, a wiping-liquid supply mechanism that supplies a wiping liquid to the wiping member, and a relatively-moving mechanism that moves the liquid ejector and the wiping member relative to each other when the nozzle surface is wiped with the wiping member. The liquid ejecting apparatus is configured to perform wet-wiping of wiping the nozzle surface in a state where the wiping member has absorbed the wiping liquid and is configured to change a supply amount of the wiping liquid when the wiping member wipes the nozzle surface.

According to an aspect of the present disclosure, there is provided a maintenance method of a liquid ejecting apparatus including a liquid ejector that performs recording processing on a recording medium by ejecting a liquid from a nozzle, a wiping mechanism that wipes a nozzle surface on which a plurality of nozzles is disposed with a wiping member configured to absorb the liquid, a wiping-liquid supply mechanism that supplies a wiping liquid to the wiping member, and a relatively-moving mechanism that moves the liquid ejector and the wiping member relative to each other when the nozzle surface is wiped with the wiping member. The method includes performing wet-wiping of wiping the nozzle surface in a state where the wiping member has absorbed the wiping liquid, and changing a supply amount of the wiping liquid when the wet-wiping is performed, based on a status of the liquid ejecting apparatus.

DESCRIPTION OF EXEMPLARY EMBODIMENTS

Hereinafter, a liquid ejecting apparatus according to an embodiment will be described with reference to the drawings. As the liquid ejecting apparatus, for example, there is provided an ink jet printer that records an image of a character, a picture, or the like by ejecting an ink as an example of a liquid onto a recording medium such as paper.

First Embodiment

Figure 1:
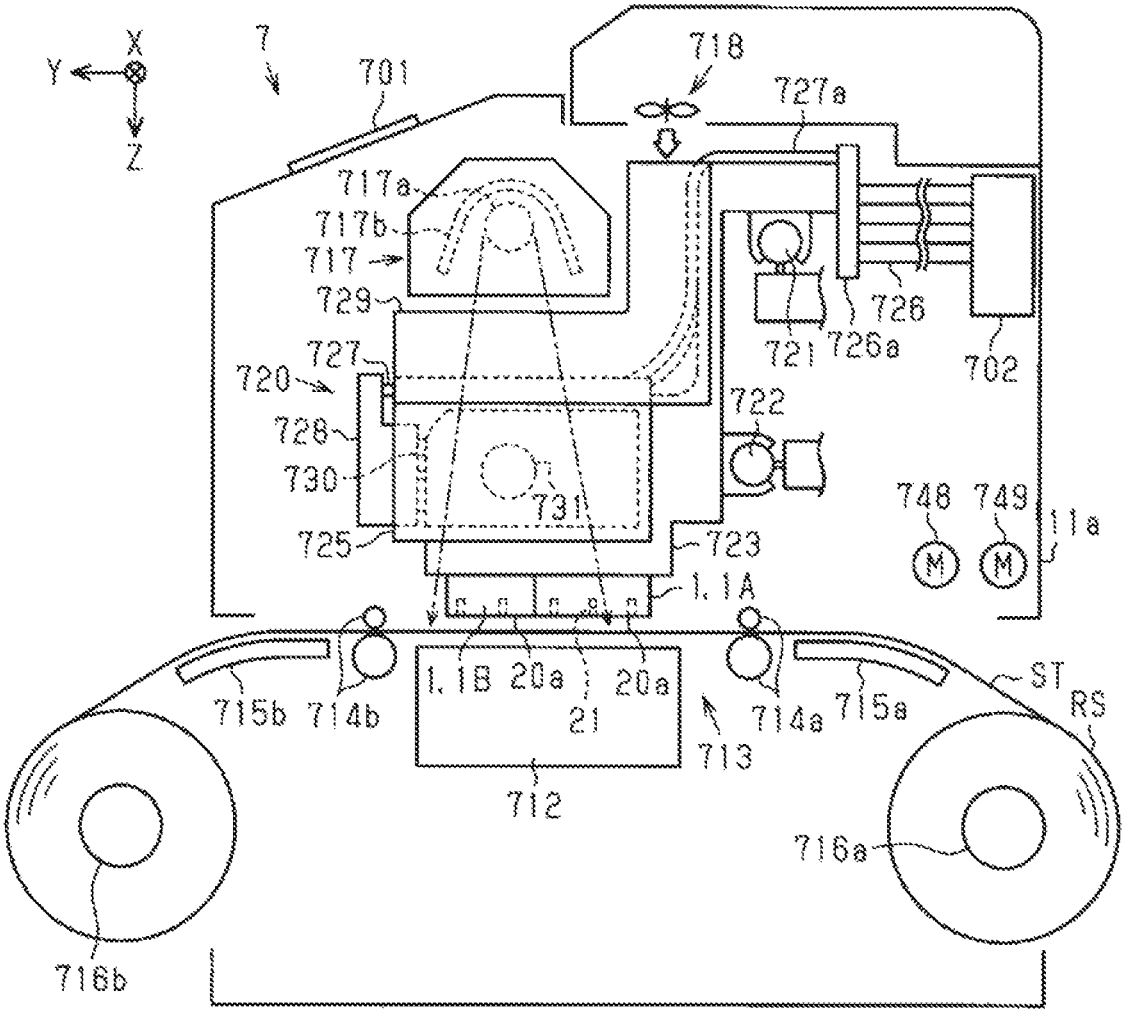
FIG. 1 is a schematic diagram illustrating a liquid ejecting apparatus according to a first embodiment.

As illustrated in FIG. 1, a liquid ejecting apparatus 7 includes a support stand 712 configured to support a recording medium ST, a transport portion 713 configured to transport the recording medium ST, and a recording portion 720 configured to record an image on the recording medium ST. The transport portion 713 transports the recording medium ST along the surface of the support stand 712 in a transport direction Y. The recording portion 720 records an image on a recording medium ST by ejecting a liquid onto the recording medium ST supported by the support stand 712. The liquid ejecting apparatus 7 further includes a heating portion 717 and a blower 718 for drying the liquid loaded on the recording medium ST.

The support stand 712, the transport portion 713, the heating portion 717, the blower 718, and the recording portion 720 are assembled in an apparatus body 11*a* constituted by a housing, a frame, and the like. The support stand 712 is configured to extend in a width direction of the recording medium ST in the apparatus body 11*a*.

The liquid ejecting apparatus 7 further includes an operation portion 701 for an operation. In the embodiment, the operation portion 701 is provided on the apparatus body 11*a*. The operation portion 701 is configured with a touch panel, for example. Therefore, the operation portion 701 is configured to be capable of operating the liquid ejecting apparatus 7 and displaying the status of the liquid ejecting apparatus 7.

The transport portion 713 includes a transport roller pair 714*a* and a transport roller pair 714*b*. The transport roller pair 714*a* is located on an upstream of the support stand 712 in the transport direction Y. The transport roller pair 714*b* is located on a downstream of the support stand 712 in the transport direction Y. The transport roller pair 714*a* and the transport roller pair 714*b* are driven by a transport motor 749. The transport portion 713 includes a guide plate 715*a* and a guide plate 715*b*. The guide plate 715*a* is located on an upstream of the transport roller pair 714*a* in the transport direction Y. The guide plate 715*b* is located on a downstream of the transport roller pair 714*b* in the transport direction Y. The guide plate 715*a* and the guide plate 715*b* guides transporting of the recording medium ST.

The transport roller pair 714*a* and the transport roller pair 714*b* rotate while sandwiching a recording medium ST, and thereby the transport portion 713 transports the recording medium ST along the surfaces of the guide plate 715*a*, the support stand 712, and the guide plate 715*b*. In the embodiment, the recording medium ST is continuously transported by being fed out from a roll sheet RS wound on a supply reel 716*a* in a roll shape. An image is recorded on the recording medium ST fed out from the roll sheet RS, with a liquid ejected by the recording portion 720. After the image has been recorded on the recording medium ST, the recording medium ST is wound by a winding reel 716*b* in a roll shape.

The recording portion 720 includes a carriage 723. The carriage 723 is supported by a guide shaft 721 and a guide shaft 722 extending in a scanning direction X which is a direction different from the transport direction Y of the recording medium ST. The carriage 723 is configured to move along the guide shaft 721 and the guide shaft 722 in the scanning direction X by power of the carriage motor 748. In the embodiment, the scanning direction X is identical to the width direction of the recording medium ST. The scanning direction X is different from both the transport direction Y and a gravity direction Z.

The recording portion 720 further includes a liquid ejector 1 that ejects a liquid from a nozzle 21. The liquid ejector 1 performs recording processing on a recording medium ST by ejecting the liquid from the nozzle 21. The liquid ejector 1 is provided in the carriage 723. In the embodiment, two liquid ejectors 1 are provided in the carriage 723. Therefore, in the embodiment, the two liquid ejectors 1 are referred to as a liquid ejector 1A and a liquid ejector 1B, respectively.

The liquid ejector 1 is attached to the lower end portion of the carriage 723 with a posture facing the support stand 712 at a predetermined distance in the gravity direction Z. In the embodiment, an ejection direction of the liquid ejected by the liquid ejector 1 is the gravity direction Z. The carriage motor 748 drives, and thereby the two liquid ejectors 1 reciprocate in the scanning direction X along with the carriage 723.

A liquid supply path 727 and a reservoir 730 are provided in the carriage 723. The liquid supply path 727 is used for supplying a liquid to the liquid ejector 1. The reservoir 730 temporarily stores the liquid which has been supplied through the liquid supply path 727. A flow path adaptor 728 coupled to the reservoir 730 is provided in the carriage 723. The reservoir 730 is held by a reservoir holder 725 attached to the carriage 723.

The reservoir 730 is attached on the upper side of the carriage 723. The upper side means an opposite side of the liquid ejector 1 with respect to the carriage 723 in the gravity direction Z. In the embodiment, in the liquid ejecting apparatus 7, the reservoir 730 is provided for each type of liquid. For example, four reservoirs 730 are provided, and the four reservoirs 730 store inks of cyan, magenta, yellow, and black, respectively. Therefore, in the embodiment, the liquid ejecting apparatus 7 can record an image in color or record an image in monochrome. The liquid stored by the reservoir 730 may contain an antiseptic.

The reservoir 730 may store a white ink. The white ink is used in base processing before recording processing is performed with a color ink, for example, when the recording medium ST is a transparent or translucent film or a dark medium. Any type of liquid stored by the reservoir 730 can be selected. For example, the reservoir 730 may be configured to store three types of inks of cyan, magenta, and yellow. The reservoir 730 may be configured to store at least one type of ink of inks of, for example, light cyan, light magenta, light yellow, orange, green, and gray, in addition to the three types of inks.

A differential pressure valve 731 is provided at a position on the liquid supply path 727. The differential pressure valve 731 opens if the liquid ejector 1 ejects the liquid, and thus pressure in the liquid ejector 1 reaches predetermined negative pressure with respect to the atmospheric pressure. If the differential pressure valve 731 opens, the liquid is supplied from the reservoir 730 to the liquid ejector 1. If the liquid is supplied to the liquid ejector 1, and thus the pressure in the liquid ejector 1 increases, the differential pressure valve 731 closes. The differential pressure valve 731 does not open even though the pressure in the liquid ejector 1 becomes higher. Therefore, the differential pressure valve 731 functions as a one-way valve that allows a supply of a liquid from an upstream being the reservoir 730 side to a downstream being the liquid ejector 1 side and suppresses a backflow of the liquid from the downstream to the upstream.

An upstream end of a supply tube 727*a* constituting a portion of a liquid supply path 727 is coupled to a downstream end of a liquid supply tube 726 through a coupling portion 726*a* attached to a portion of the carriage 723. A plurality of liquid supply tubes 726 may be provided and may be configured to be deformable. The liquid supply tube 726 deforms to follow movement of the carriage 723.

The upstream end of the liquid supply tube 726 is coupled to a liquid supply source 702. The liquid supply source 702 may be, for example, a tank that stores a liquid, or may be a cartridge which is detachable from the apparatus body 11*a*.

The downstream end of the supply tube 727*a* is coupled to the flow path adaptor 728 at a position on an upper side of the reservoir 730. Thus, a liquid is supplied from the liquid supply source 702 that stores the liquid, to the reservoir 730 through the liquid supply tube 726, the supply tube 727*a*, and the flow path adaptor 728.

The liquid ejector 1 includes a plurality of nozzles 21. The liquid ejector 1 has a nozzle surface 20*a* on which the plurality of nozzles 21 is disposed. The liquid ejector 1 ejects a liquid from the nozzle 21 onto a recording medium ST on the support stand 712 in the process of the carriage 723 moving in the scanning direction X.

The heating portion 717 heats the liquid adhering to the recording medium ST, so as to dry the recording medium ST. The heating portion 717 is located above the support stand 712 at a predetermined distance in the gravity direction Z in the liquid ejecting apparatus 7. The recording portion 720 reciprocates between the heating portion 717 and the support stand 712 in the scanning direction X.

The heating portion 717 includes a heating member 717*a* and a reflecting plate 717*b* extending in the scanning direction X. The heating member 717*a* is, for example, an infrared heater. The heating portion 717 heats the liquid adhering to the recording medium ST, by heat of infrared rays radiated into an area indicated by an arrow of a one-dot chain line in FIG. 1, for example, radiant heat.

The blower 718 blows the recording medium ST so as to dry the recording medium ST to which the liquid adheres. The blower 718 is located above the support stand 712 such that the recording portion 720 has a space for reciprocation with the support stand 712 in the liquid ejecting apparatus 7.

A heat insulation member 729 that blocks heat transferred from the heating portion 717 is provided at a position between the reservoir 730 and the heating portion 717. The heat insulation member 729 is formed of, for example, a metal material having high heat conductivity, such as stainless steel and aluminum. Preferably, the heat insulation member 729 covers at least an upper portion of the reservoir 730, which faces the heating portion 717.

Figure 2:
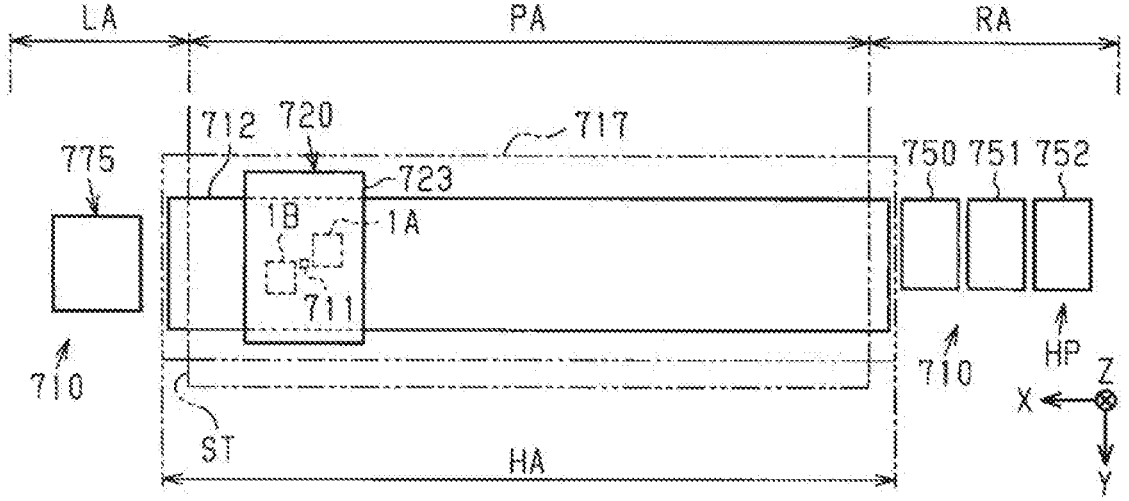
FIG. 2 is a plan view schematically illustrating an arrangement of constituent components of the liquid ejecting apparatus.

As illustrated in FIG. 2, the liquid ejector 1A and the liquid ejector 1B are located to be spaced from each other at a predetermined distance in the scanning direction X and to be shifted from each other at a predetermined distance in the transport direction Y, in the lower end portion of the carriage 723. In the lower end portion of the carriage 723, a temperature sensor 711 is provided at a position between the liquid ejector 1A and the liquid ejector 1B in the scanning direction X. The temperature sensor 711 detects the temperature around the liquid ejector 1.

A movement area in which the liquid ejector 1A and the liquid ejector 1B are movable in the scanning direction X includes a recording area PA, a non-recording area RA, and a non-recording area LA. The recording area PA is an area in which the liquid ejector 1A and the liquid ejector 1B eject liquids onto a recording medium ST in the process of recording processing on the recording medium ST. Therefore, the recording area PA is set to be an area enclosing a recording medium ST which has the maximum width and is transported on the support stand 712. When the recording portion 720 is capable of performing recording on a recording medium ST without a border, the recording area PA is an area which is a little wider than the range of the recording medium ST which has the maximum width and is transported, in the scanning direction X. A heating area HA to which the heating portion 717 applies heat corresponds to the recording area PA.

The non-recording area RA and the non-recording area LA are areas outside the recording area PA. The non-recording area RA and the non-recording area LA are areas in which the liquid ejector 1A and the liquid ejector 1B capable of moving in the scanning direction X do not face a recording medium ST.

The non-recording area RA and the non-recording area LA are located on both sides of the recording area PA in the scanning direction X. The non-recording area LA is located on the left side of the recording area PA in FIG. 2. A fluid ejecting device 775 is provided in the non-recording area LA. The non-recording area RA is located on the right side of the recording area PA in FIG. 2. A wiper unit 750, a flushing unit 751, and a cap unit 752 are provided in the non-recording area RA.

The fluid ejecting device 775, the wiper unit 750, the flushing unit 751, and the cap unit 752 constitute a maintenance device 710 configured to perform maintenance of the liquid ejector 1. A position at which the cap unit 752 is provided in the scanning direction X corresponds to a home position HP of the liquid ejector 1A and the liquid ejector 1B. The home position HP means a position, for example, at which the liquid ejector 1A and the liquid ejector 1B are on standby when the liquid ejecting apparatus 7 is in a standby state of not performing recording processing.

Regarding Configuration of Head Unit

Next, a configuration of the head unit 2 will be described.

The liquid ejector 1 includes a plurality of head units 2 provided for types of liquids, respectively. In the embodiment, the liquid ejector 1 is configured by arranging four head units 2 in the scanning direction X.

Figure 3:
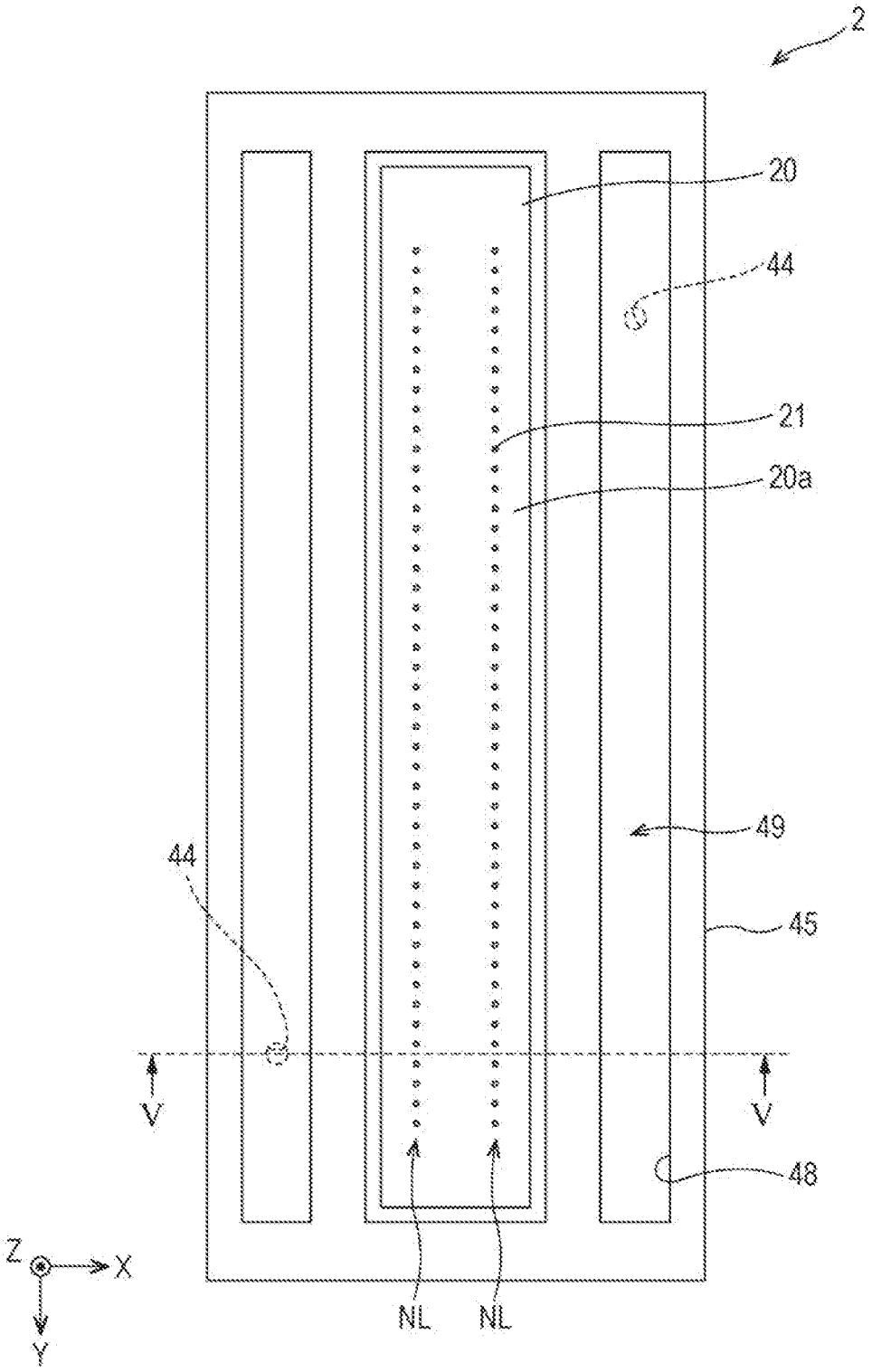
FIG. 3 is a bottom view illustrating a head unit.

As illustrated in FIG. 3, in one head unit 2, a nozzle row NL is formed by arranging multiple nozzles 21 for ejecting liquids at a predetermined nozzle pitch in one direction. In the embodiment, the nozzles 21 are arranged at a predetermined distance in the transport direction Y. The nozzle row NL is constituted by 180 nozzles 21, for example.

In the embodiment, two nozzle rows NL arranged in the scanning direction X are provided in one head unit 2. Therefore, the two nozzle rows NL are arranged at a predetermined distance in one liquid ejector 1 in the scanning direction X. Eight nozzle rows NL in total are formed in one liquid ejector 1. Two liquid ejectors 1 are located to be shifted from each other in the transport direction Y such that the nozzle pitch between the nozzles 21 at the end portions of one liquid ejector is equal to that in the other liquid ejector when the multiple nozzles 21 constituting the nozzle rows NL are projected in the scanning direction X.

Figure 4:
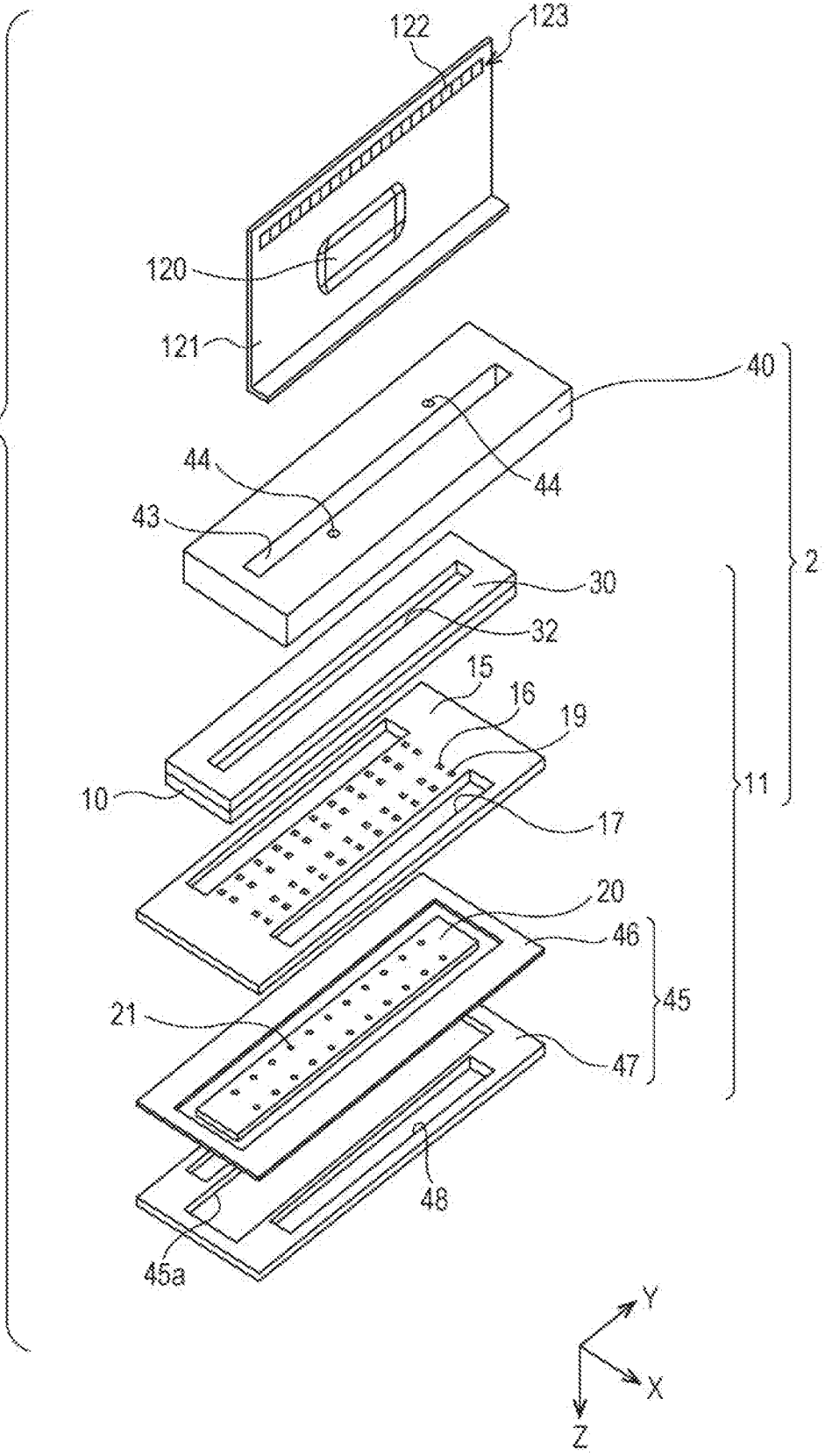
FIG. 4 is an exploded perspective view illustrating the head unit.

As illustrated in FIG. 4, the head unit 2 includes a head body 11 and a plurality of members such as a flow-path formation member 40 fixed to one surface side as an upper surface side of the head body 11. The head body 11 includes a flow-path forming substrate 10 and a communication plate 15 which is provided on one surface side as a lower surface side of the flow-path forming substrate 10. The head body 11 includes a nozzle plate 20 and a protective substrate 30. The nozzle plate 20 is provided on a lower surface side of the communication plate 15, which is opposite to the flow-path forming substrate 10. The protective substrate 30 is provided on an upper side of the flow-path forming substrate 10, which is opposite to the communication plate 15. The head body 11 includes a compliance substrate 45 provided on a surface side of the communication plate 15, on which the nozzle plate 20 is provided.

For example, stainless steel, metal such as nickel, a ceramic material represented by $ZrO_2$ or $Al_2O_3$, a glass ceramic material, an oxide such as MgO and $LaAlO_3$ can be used for the flow-path forming substrate 10. In the embodiment, the flow-path forming substrate 10 is formed with a silicon single crystal substrate.

Figure 5:
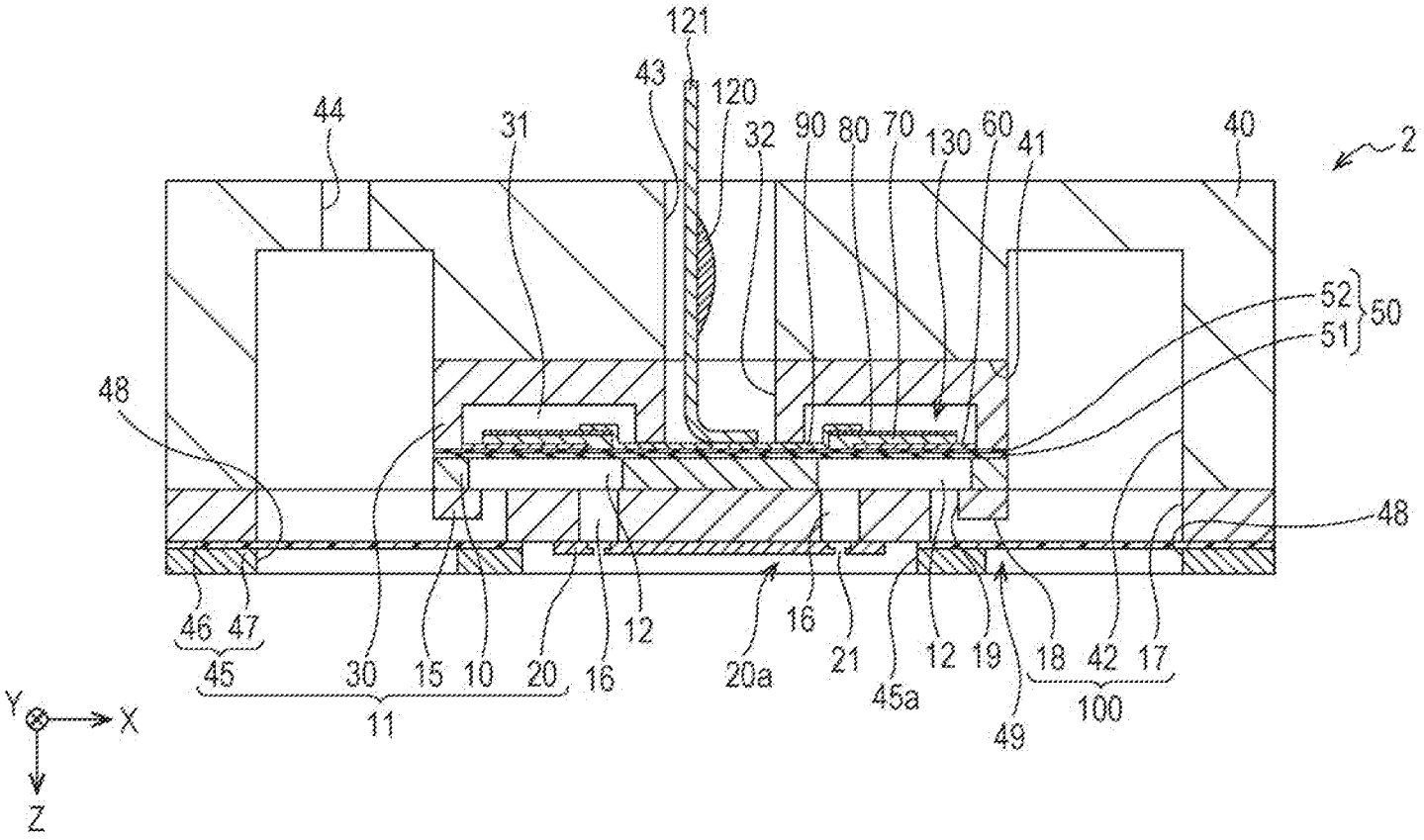
FIG. 5 is a sectional view taken along line V-V in FIG. 3.

As illustrated in FIG. 5, pressure generation chambers 12 partitioned by a plurality of partition walls are provided in the flow-path forming substrate 10 by performing anisotropic etching from one side. The pressure generation chambers 12 are arranged in a direction in which the plurality of nozzles 21 for ejecting liquids is arranged. A plurality of rows is provided in the flow-path forming substrate 10 so as to be arranged in the scanning direction X, each of the rows is obtained by arranging the pressure generation chambers 12 in the transport direction Y. In the embodiment, two rows in which the pressure generation chambers 12 are arranged in the transport direction Y are provided.

A supply path and the like may be provided on one end portion side of the pressure generation chamber 12 in the flow-path forming substrate 10 in the transport direction Y. The supply path has an opening area which is smaller than that of the pressure generation chamber 12 and applies flow-path resistance to a liquid flowing into the pressure generation chamber 12.

As illustrated in FIGS. 4 and 5, the communication plate 15 and the nozzle plate 20 are stacked on one surface side of the flow-path forming substrate 10 in the gravity direction Z. That is, the liquid ejector 1 includes the communication plate 15 provided on one surface of the flow-path forming substrate 10 and the nozzle plate 20 provided on the side of the communication plate 15, which is opposite to the flow-path forming substrate 10. The nozzles 21 are formed in the nozzle plate 20.

A nozzle communication path 16 communicating with the pressure generation chamber 12 and the nozzle 21 is provided in the communication plate 15. The communication plate 15 has an area which is larger than that of the flow-path forming substrate 10. The nozzle plate 20 has an area which is smaller than that of the flow-path forming substrate 10. Since the communication plate 15 is provided, a distance between the nozzle 21 in the nozzle plate 20 and the pressure generation chamber 12 becomes longer. Therefore, moisture of the liquid from the nozzle 21 is evaporated, and thereby it is possible to thicken the liquid in the pressure generation chamber 12. The nozzle plate 20 may just cover an opening of the nozzle communication path 16 communicating with the pressure generation chamber 12 and the nozzle 21. Thus, it is possible to relatively reduce the area of the nozzle plate 20 and to reduce cost.

As illustrated in FIG. 5, a first manifold portion 17 and a second manifold portion 18 constituting a portion of a common liquid room 100 as a manifold are provided in the communication plate 15. The first manifold portion 17 is provided by penetrating the communication plate 15 in a thickness direction. The thickness direction corresponds to the gravity direction Z which is set to be a stacking direction of the communication plate 15 and the flow-path forming substrate 10. The second manifold portion 18 may be a throttle flow path or an orifice flow path. The second manifold portion 18 is provided to open toward the nozzle plate 20 side of the communication plate 15 without penetrating the communication plate 15 in the thickness direction.

In the communication plate 15, a supply communication path 19 communicating with one end portion of the pressure generation chamber 12 in the transport direction Y is provided separately for each pressure generation chamber 12. The supply communication path 19 communicates with the second manifold portion 18 and the pressure generation chamber 12.

Stainless steel, metal such as nickel, ceramics such as zirconium, and the like can be used for forming the communication plate 15. The communication plate 15 may be formed with a material having a linear expansion coefficient which is equal to that of the flow-path forming substrate 10. When a material having a linear expansion coefficient which is largely different from that of the flow-path forming substrate 10 is used for the communication plate 15, the flow-path forming substrate 10 and the communication plate 15 may be warped by being heated and cooled. In the embodiment, it is possible to suppress an occurrence of warpage by heat, cracks by heat, peeling, and the like, by using the same material as the flow-path forming substrate 10, that is, using a silicon single crystal substrate for the communication plate 15.

Among both surfaces of the nozzle plate 20, a lower surface being a surface from which the liquid is ejected, that is, a surface on an opposite side of the pressure generation chamber 12 is referred to as a nozzle surface 20*a*. An opening of the nozzle 21, which opens to the nozzle surface 20*a* is referred to as a nozzle opening.

For example, metal such as stainless steel, an organic matter such as polyimide resin, a silicon single crystal substrate, or the like can be used for forming the nozzle plate 20. It is possible to set the linear expansion coefficient of the nozzle plate 20 to be equal to the linear expansion coefficient of the communication plate 15, by using a silicon single crystal substrate for the nozzle plate 20. Thus, it is possible to suppress an occurrence of warpage by being heated and cooled, cracks by heat, peeling, and the like in the nozzle plate 20.

A vibration plate 50 is provided on a surface side of the flow-path forming substrate 10, which is opposite to the communication plate 15. In the embodiment, an elastic film 51 and an insulating film 52 are provided as the vibration plate 50. The elastic film 51 is formed of silicon oxide and is provided on the flow-path forming substrate 10 side. The insulating film 52 is formed of zirconium oxide and is provided on the elastic film 51. A liquid flow path such as the pressure generation chamber 12 is formed in a manner that anisotropic etching is performed on the flow-path forming substrate 10 from one surface side, that is, from a surface side to which the nozzle plate 20 is bonded. The other surface of the liquid flow path such as the pressure generation chamber 12 is formed by the elastic film 51.

An actuator 130 as a pressure generation unit in the embodiment is provided on the vibration plate 50 on the flow-path forming substrate 10. The actuator 130 is a so-called piezoelectric actuator. The actuator 130 includes a first electrode 60, a piezoelectric layer 70, and a second electrode 80. In the embodiment, the actuator 130 refers to a part including the first electrode 60, the piezoelectric layer 70, and the second electrode 80.

Generally, any one electrode of the actuator 130 is configured as a common electrode, and the other electrode is configured to be patterned for each pressure generation chamber 12. In the embodiment, the first electrode 60 is set as the common electrode in a manner of being provided to continue over a plurality of actuators 130, the second electrode 80 is set as an individual electrode in a manner of being provided to be independent for each actuator 130. There is no problem even if the electrodes are configured to be reversed to each other by a drive circuit or wirings.

In the above-described example, a case where the vibration plate 50 is constituted by the elastic film 51 and the insulating film 52 is described. However, the disclosure is not limited thereto. For example, any one of the elastic film 51 and the insulating film 52 may be provided as the vibration plate 50. For example, only the first electrode 60 may function as the vibration plate without providing the elastic film 51 and the insulating film 52 as the vibration plate 50. For example, the actuator 130 may substantially function as the vibration plate.

The piezoelectric layer 70 is formed of a piezoelectric material, for example, an oxide having a polarized structure. The piezoelectric layer 70 can be formed of a perovskite oxide represented by a formula ABO3. A lead-based piezoelectric material which contains lead, a lead-free piezoelectric material which does not contain lead, or the like can be used.

One end portion of the lead electrode 90 is coupled to the second electrode 80 as the individual electrode of the actuator 130. The lead electrode 90 is formed of gold, for example. The lead electrode 90 is provided to be drawn out from the vicinity of the end portion thereof on an opposite side of the supply communication path 19 and to extend up onto the vibration plate 50.

A wiring substrate 121 is coupled to the other end portion of the lead electrode 90. The wiring substrate 121 is an example of a flexible wiring substrate in which a drive circuit 120 configured t drive the actuator 130 is provided. As the wiring substrate 121, a substrate which has flexibility and has a sheet shape, for example, a COF substrate can be used.

As illustrated in FIG. 4, a second terminal row 123 is formed on one surface of the wiring substrate 121. In the second terminal row 123, a plurality of second terminals 122 which are wiring terminals electrically coupled to first terminals 311 of a head substrate 300 described later is arranged. In the embodiment, the second terminal row 123 is formed by arranging the second terminals 122 in the transport direction Y. The drive circuit 120 may not be provided on the wiring substrate 121. That is, the wiring substrate 121 is not limited to a COF substrate and may be an FFC, an FPC, or the like.

As illustrated in FIGS. 4 and 5, the protective substrate 30 having substantially the same size as that of the flow-path forming substrate 10 is bonded to the surface of the flow-path forming substrate 10 on the actuator 130 side. The protective substrate 30 has a holding portion 31 which is a space for protecting the actuator 130.

The holding portion 31 has a recessed shape that opens to the flow-path forming substrate 10 side without penetrating the protective substrate 30 in the gravity direction Z as the thickness direction. The holding portion 31 is provided independently for each row constituted by the actuators 130 arranged in the transport direction Y. That is, the holding portion 31 is provided to accommodate the row in which the actuators 130 are arranged in the transport direction Y. The holding portion 31 is provided for each row of the actuator 130, that is, two holding portions are provided to be arranged in the scanning direction X. Such a holding portion 31 may have a space of an extent of not hindering the movement of the actuator 130. The space of the holding portion 31 may or may not be sealed.

The protective substrate 30 has a through-hole 32 which penetrates the protective substrate in the gravity direction Z as the thickness direction. The through-hole 32 is provided between two holding portions 31 arranged in the transport direction Y, along the transport direction Y which is an arrangement direction of a plurality of actuators 130. That is, the through-hole 32 is an opening having a long side in the arrangement direction of the plurality of actuators 130. The other end portion of the lead electrode 90 is located to expose in the through-hole 32. The lead electrode 90 and the wiring substrate 121 are electrically coupled in the through-hole 32.

A material having a thermal expansion coefficient which is substantially equal to that of the flow-path forming substrate 10, for example, glass or ceramic material may be used for forming the protective substrate 30. In the embodiment, the protective substrate 30 is formed with a silicon single crystal substrate of the same material as the flow-path forming substrate 10. A method of bonding the flow-path forming substrate 10 and the protective substrate 30 to each other is not particularly limited. For example, in the embodiment, the flow-path forming substrate 10 and the protective substrate 30 are bonded to each other with an adhesive.

The head unit 2 includes the flow-path formation member 40 for forming the common liquid room 100 communicating with the plurality of pressure generation chambers 12, along with the head body 11. The flow-path formation member 40 has a shape which is substantially the same as the above-described communication plate 15 in plan view. The flow-path formation member 40 is not only bonded to the protective substrate 30, but also to the above-described communication plate 15. Specifically, the flow-path formation member 40 includes a recess portion 41 on the protective substrate 30 side. The recess portion 41 has a depth which is as deep as the flow-path forming substrate 10 and the protective substrate 30 are accommodated.

The recess portion 41 has an opening area which is wider than that of the surface of the protective substrate 30, which is bonded to the flow-path forming substrate 10. An opening surface of the recess portion 41 on the nozzle plate 20 side is sealed by the communication plate 15, in a state where the flow-path forming substrate 10 and the like are accommodated in the recess portion 41. Thus, a third manifold portion 42 is formed on an outer circumference of the flow-path forming substrate 10 by the flow-path formation member 40 and the head body 11. In the embodiment, the common liquid room 100 is constituted by the first manifold portion 17 and the second manifold portion 18 (provided in the communication plate 15) and the third manifold portion 42 (formed by the flow-path formation member 40 and the head body 11).

The common liquid room 100 includes the first manifold portion 17, the second manifold portion 18, and the third manifold portion 42. In the embodiment, the common liquid room 100 is disposed on both outer sides of two rows of the pressure generation chamber 12 in the scanning direction X. Two common liquid rooms 100 provided on both the outer sides of the two rows of the pressure generation chamber 12 are independently provided so as not to be linked to each other in the head unit 2. That is, one common liquid room 100 is provided for each row of the pressure generation chamber 12 in the embodiment. In other words, the common liquid room 100 is provided for each nozzle row NL. The two common liquid rooms 100 may be linked to each other.

The flow-path formation member 40 is a member configured to form the common liquid room 100 as a flow path of the liquid supplied to the head body 11. The flow-path formation member 40 has an inlet 44 communicating with the common liquid room 100. That is, the inlet 44 is an opening portion as an entrance for causing the liquid supplied to the head body 11 to flow into the common liquid room 100. As the material of the flow-path formation member 40, for example, resin or metal may be used. It is possible to mass-produce the flow-path formation member 40 with low cost by forming the flow-path formation member 40 with resin.

A coupling port 43 communicating with the through-hole 32 of the protective substrate 30 is provided in the flow-path formation member 40. The wiring substrate 121 is inserted into the coupling port 43 and the through-hole 32. The wiring substrate 121 is provided such that the other end portion thereof extends toward an opposite side of a direction of penetrating the through-hole 32 and the coupling port 43, which is a direction, that is, the gravity direction Z and the ejection direction of the liquid.

The compliance substrate 45 is provided on the surface of the communication plate 15, to which the first manifold portion 17 and the second manifold portion 18 open. The compliance substrate 45 has a size which is substantially equal to that of the above-described communication plate 15 in plan view. A first exposure opening portion 45*a* configured to expose the nozzle plate 20 is provided in the compliance substrate 45. The openings of the first manifold portion 17 and the second manifold portion 18 on the nozzle surface 20*a* side are sealed in a state where the compliance substrate 45 exposes the nozzle plate 20 with the first exposure opening portion 45*a*. That is, the compliance substrate 45 forms a portion of the common liquid room 100.

In the embodiment, the compliance substrate 45 includes a sealing film 46 and a fixation substrate 47. The sealing film 46 is configured with a thin film having flexibility, for example, a thin film which is formed with polyphenylene sulfide or the like and has a thickness of 20 μm or smaller. The fixation substrate 47 is formed of a hard material such as metal, for example, stainless steel. An area of the fixation substrate 47, which faces the common liquid room 100 functions as an opening portion 48 obtained by completely removing the fixation substrate 47 in the thickness direction. Therefore, one surface of the common liquid room 100 functions as a compliance portion 49 which is a flexible portion sealed by only the sealing film 46 having flexibility. In the embodiment, one compliance portion 49 is provided to correspond to one common liquid room 100. That is, in the embodiment, since two common liquid rooms 100 are provided, two compliance portions 49 are provided on both sides of the head unit in the scanning direction X with interposing the nozzle plate 20 therebetween.

In the head unit 2, when a liquid is ejected, the liquid is taken in through the inlet 44, and the inside of a flow path from the common liquid room 100 to the nozzle 21 is filled with the liquid. Then, a voltage is applied to each actuator 130 corresponding to the pressure generation chamber 12, in accordance with a signal from the drive circuit 120, and thereby the vibration plate 50 is deflected along with the actuator 130. Thus, pressure in the pressure generation chamber 12 increases, and thus the liquid is ejected from a predetermined nozzle 21.

Regarding Configuration of Liquid Ejector

Next, the liquid ejector 1 including the head unit 2 will be described.

Figure 6:
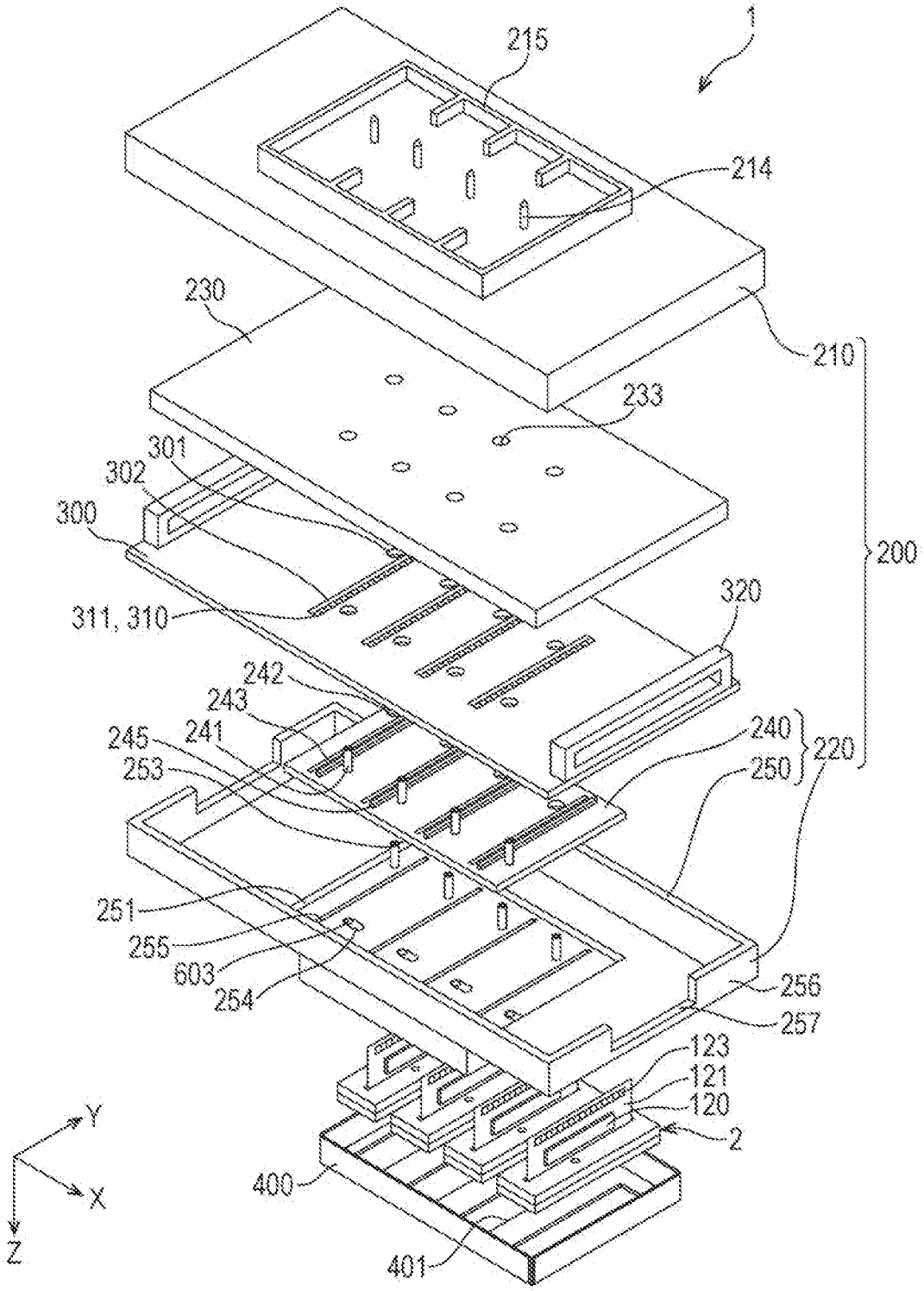
FIG. 6 is an exploded perspective view illustrating a liquid ejector.

As illustrated in FIG. 6, the liquid ejector 1 includes four head units 2 and a flow path member 200 including a holder member that holds the head units 2 and supplies a liquid to the head unit 2. The liquid ejector 1 includes the head substrate 300 held by the flow path member 200 and the wiring substrate 121 as an example of the flexible wiring substrate.

Figure 7:
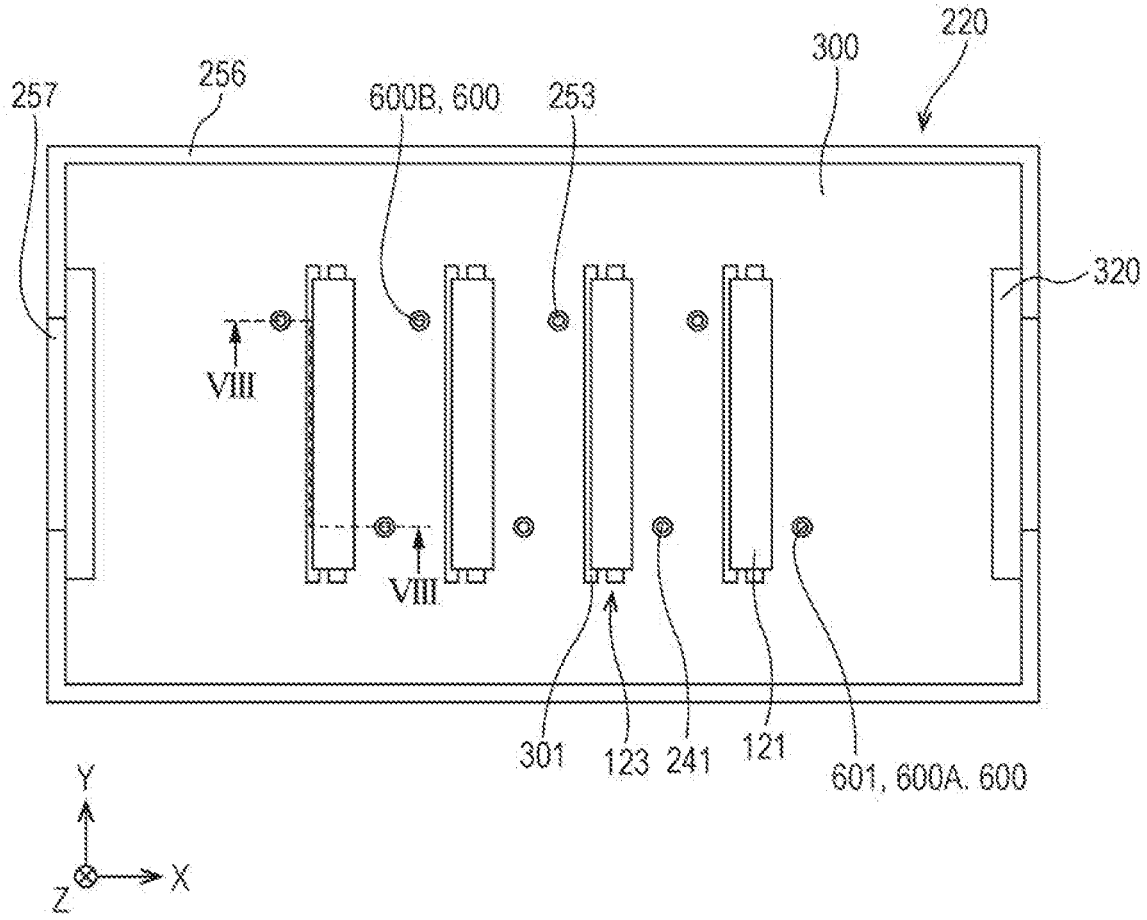
FIG. 7 is a plan view illustrating the liquid ejector.

FIG. 7 illustrates a plan view of the liquid ejector 1, in which illustrations of a sealing member 230 and an upstream flow path member 210 are omitted.

Figure 8:
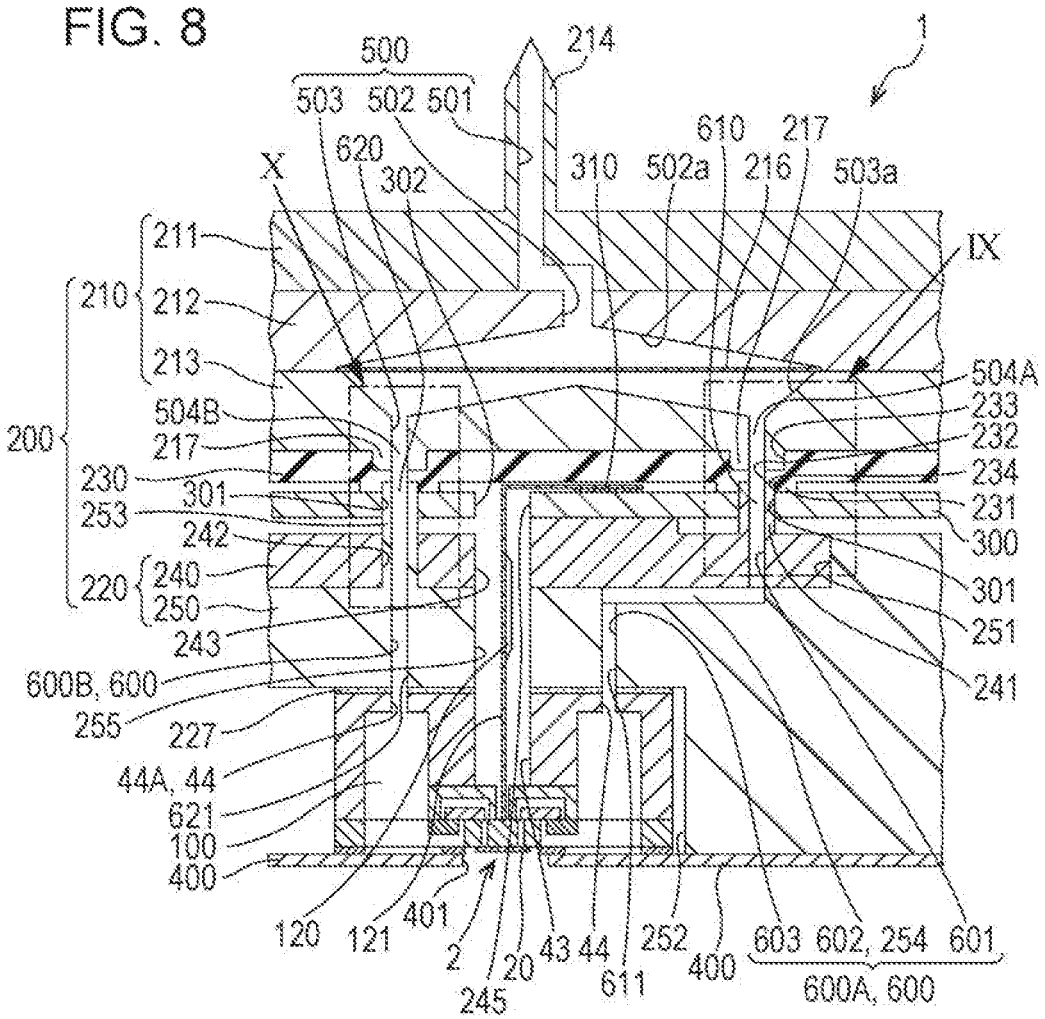
FIG. 8 is a sectional view taken along line VIII-VIII in FIG. 7.

As illustrated in FIG. 8, the flow path member 200 includes the upstream flow path member 210, a downstream flow path member 220 as an example of the holder member, and a sealing member 230 disposed between the upstream flow path member 210 and the downstream flow path member 220.

The upstream flow path member 210 has an upstream flow path 500 as a flow path of the liquid. In the embodiment, the upstream flow path member 210 is configured in a manner that a first upstream flow path member 211, a second upstream flow path member 212, and a third upstream flow path member 213 are stacked in the gravity direction Z. A first upstream flow path 501, a second upstream flow path 502, and a third upstream flow path 503 are provided in the first upstream flow path member 211, the second upstream flow path member 212, and the third upstream flow path member 213, respectively. The upstream flow path 500 is configured by joining the first upstream flow path 501, the second upstream flow path 502, and the third upstream flow path 503 to each other.

The upstream flow path member 210 is not limited to such a form and may be configured with a single member or with a plurality (two or more) of members. The stacking direction of the plurality of members constituting the upstream flow path member 210 is not particularly limited thereto. The stacking direction may be the scanning direction X or the transport direction Y.

The first upstream flow path member 211 includes a coupling portion 214 on an opposite surface side of the downstream flow path member 220. The coupling portion 214 is coupled to the reservoir 730 such as a tank or a cartridge, that stores the liquid. In the embodiment, the coupling portion 214 is set to protrude like a needle. The reservoir 730 such as the cartridge may be directly coupled to the coupling portion 214, or the reservoir 730 such as an ink tank may be coupled to the coupling portion 214 through a supply pipe such as a tube.

The first upstream flow path 501 is provided in the first upstream flow path member 211. The first upstream flow path 501 opens in the top of the coupling portion 214. The first upstream flow path 501 is constituted by a flow path extending in the gravity direction Z, a flow path extending in a plane including the scanning direction X and the transport direction Y, and the like, in accordance with the position of the second upstream flow path 502 described later. As illustrated in FIG. 6, a guide wall 215 for positioning the reservoir 730 is provided around the coupling portion 214 of the first upstream flow path member 211.

As illustrated in FIG. 8, the second upstream flow path member 212 is fixed to a surface side of the first upstream flow path member 211, which is opposite to the coupling portion 214. The second upstream flow path member 212 has the second upstream flow path 502 communicating with the first upstream flow path 501. A first liquid pool portion 502*a* is provided on a downstream of the second upstream flow path 502, which is the third upstream flow path member 213 side. The first liquid pool portion 502*a* has an inner diameter which increases from the second upstream flow path 502.

The third upstream flow path member 213 is provided on a side of the second upstream flow path member 212, which is opposite to the first upstream flow path member 211. The third upstream flow path 503 is provided in the third upstream flow path member 213. An opening portion of the third upstream flow path 503 on the second upstream flow path 502 side acts as a second liquid pool portion 503*a* having a width increasing to correspond to the first liquid pool portion 502*a*.

A filter 216 is provided at an opening portion of the second liquid pool portion 503*a*, that is, between the first liquid pool portion 502*a* and the second liquid pool portion 503*a*. The filter 216 is provided for removing bubbles, foreign matters, and the like included in the liquid. Thus, a liquid supplied from the second upstream flow path 502 is supplied to the third upstream flow path 503 through the filter 216.

For example, a mesh member such as a wire mesh or a resin mesh, a porous member, a metal plate in which fine through-holes are provided can be used for forming the filter 216. Specific examples of the mesh member include a metal mesh filter, metal fabric, and a felt-like member of, for example, a SUS fine wire. A sintered metal filter obtained by compression and sintering, an electroforming metal filter, an electron beam processed metal filter, a laser beam processed metal filter, and the like can be used as the filter 216.

Regarding the properties of the filter 216, it is preferable that the filter has bubble point pressure which does not vary. Therefore, a filter having a high definition hole diameter is suitable for the filter 216. The bubble point pressure means pressure at which the meniscus formed by filter openings is broken. The filtration particle size of the filter 216 is used for causing foreign matters in the liquid not to reach the nozzle opening. Thus, for example, when the nozzle opening is circular, the filtration particle size is preferably smaller than the diameter of the nozzle opening.

When a stainless steel mesh filter is employed as the filter 216, the filtration particle size may be set such that the foreign matters in the liquid do not reach the nozzle opening. Therefore, when the nozzle opening is circular, and the diameter thereof is 20 μm, a mesh filter which is like a tatami and has a filtration particle size of 10 μm may be employed. In this case, the bubble point pressure at a liquid having surface tension of 28 mN/m is 3 to 5 kPa. When a mesh filter which is like a tatami and has a filtration particle size of 5 μm is employed, the bubble point pressure at a liquid having surface tension of 28 mN/m is 0 to 15 kPa.

The third upstream flow path 503 is branched into two pieces on a downstream of the second liquid pool portion 503*a*, which is on an opposite side of the second upstream flow path 502. In the third upstream flow path 503, a first discharge port 504A and a second discharge port 504B open on the surface of the third upstream flow path member 213 on the downstream flow path member 220 side. When distinguishment between the first discharge port 504A and the second discharge port 504B is not required, the first discharge port 504A and the second discharge port 504B are referred to as a discharge port 504 below.

The upstream flow path 500 corresponding to one coupling portion 214 includes the first upstream flow path 501, the second upstream flow path 502, and the third upstream flow path 503. In the upstream flow path 500, two discharge ports 504 which are the first discharge port 504A and the second discharge port 504B open on the downstream flow path member 220 side. In other words, the two discharge ports 504 which are the first discharge port 504A and the second discharge port 504B are provided to communicate with a common flow path.

A third protrusion portion 217 which protrudes toward the downstream flow path member 220 side is provided on the downstream flow path member 220 side of the third upstream flow path member 213. The third protrusion portion 217 is provided for each third upstream flow path 503. The discharge port 504 is provided on the tip surface of the third protrusion portion 217, so as to open.

The first upstream flow path member 211, the second upstream flow path member 212, and the third upstream flow path member 213 in which the upstream flow path 500 is provided are integrally stacked by an adhesive, welding, for example. The first upstream flow path member 211, the second upstream flow path member 212, and the third upstream flow path member 213 can also be fixed by screws, clamps, or the like. Preferably, the first upstream flow path member 211, the second upstream flow path member 212, and the third upstream flow path member 213 are bonded to each other by an adhesive, welding, or the like, in order to suppress an occurrence of a situation in which the liquid is leaked from a coupling portion from the first upstream flow path 501 to the third upstream flow path 503.

In the embodiment, four coupling portions 214 are provided in one upstream flow path member 210. Therefore, four upstream flow paths 500 are independently provided in one upstream flow path member 210. Liquids are supplied to the upstream flow paths 500 so as to correspond to the four head units 2, respectively. One upstream flow path 500 is branched into two paths, and the paths are respectively coupled to two inlets 44 in the head unit 2, which communicate with a downstream flow path 600 described later.

In the embodiment, a configuration in which the upstream flow path 500 is divided into two pieces on a downstream of the filter 216, that is, on the downstream flow path member 220 side is described. However, it is not particularly limited thereto. The upstream flow path 500 may be branched on the downstream of the filter 216. The upstream flow path 500 may be branched into three or more pieces. One upstream flow path 500 may not be branched on a downstream of the filter 216.

The downstream flow path member 220 is bonded to the upstream flow path member 210. The downstream flow path member 220 is an example of a holder member which includes the downstream flow path 600 communicating with the upstream flow path 500. In the embodiment, the downstream flow path member 220 includes a first downstream flow path member 240 as an example of a first member and a second downstream flow path member 250 as an example of a second member.

The downstream flow path member 220 includes the downstream flow path 600 as a flow path of the liquid. In the embodiment, the downstream flow path 600 includes two types of downstream flow paths, that is, a downstream flow path 600A and a downstream flow path 600B having different shapes.

The first downstream flow path member 240 is a member formed to be substantially flat. The second downstream flow path member 250 is a member in which a first container 251 as a recess portion is provided on a surface on the upstream flow path member 210 side, and a second container 252 as a recess portion is provided on an opposite side of the upstream flow path member 210.

The first container 251 has a size of an extent of accommodating the first downstream flow path member 240. The second container 252 has a size of an extent of accommodating the four head units 2. In the embodiment, the second container 252 is capable of accommodating the four head units 2.

In the first downstream flow path member 240, a plurality of first protrusion portions 241 is formed on a surface on the upstream flow path member 210 side. The first protrusion portion 241 is provided to face a third protrusion portion 217 in which the first discharge port 504A is provided among third protrusion portions 217 provided in the upstream flow path member 210. In the embodiment, four first protrusion portions 241 are provided.

A first flow path 601 is provided in the first downstream flow path member 240. The first flow path 601 is penetrated in the gravity direction Z and opens a surface which is the top of the first protrusion portion 241 and faces the upstream flow path member 210. The third protrusion portion 217 and the first protrusion portion 241 are bonded to each other with the sealing member 230. The first discharge port 504A and the first flow path 601 communicate with each other.

In the first downstream flow path member 240, a plurality of second through-holes 242 penetrating in the gravity direction Z is formed. Each of the second through-holes 242 is formed at a position at which the second protrusion portion 253 formed in the second downstream flow path member 250 is inserted. In the embodiment, four second through-holes 242 are provided.

A plurality of first insertion holes 243 is formed in the first downstream flow path member 240. The wiring substrates 121 which are electrically coupled to the head units 2 are inserted into the first insertion holes 243. Specifically, each first insertion hole 243 is formed to penetrate in the gravity direction Z and to communicate with a second insertion hole 255 of the second downstream flow path member 250 and a third insertion hole 302 of the head substrate 300. In the embodiment, four first insertion holes 243 are provided to correspond to the wiring substrates 121 provided in the four head units 2, respectively. A support portion 245 which protrudes toward the head substrate 300 and has a receiving surface is provided in the first downstream flow path member 240.

A plurality of second protrusion portions 253 is formed on the bottom of the first container 251 in the second downstream flow path member 250. Each second protrusion portion 253 is provided to face a third protrusion portion 217 in which the second discharge port 504B is provided among third protrusion portions 217 provided in the upstream flow path member 210. In the embodiment, four second protrusion portions 253 are provided. A downstream flow path 600B is provided in the second downstream flow path member 250. The downstream flow path 600B penetrates in the gravity direction Z and opens to the top of the second protrusion portion 253 and a surface which is the bottom of the second container 252 and faces the head unit 2. The third protrusion portion 217 and the second protrusion portion 253 are bonded to each other with the sealing member 230. The second discharge port 504B and the downstream flow path 600B communicate with each other.

A plurality of third flow paths 603 penetrating in the gravity direction Z is formed in the second downstream flow path member 250. The third flow path 603 opens to the bottom of the first container 251 and the second container 252. In the embodiment, four third flow paths 603 are provided.

A plurality of groove portions 254 continuing to the third flow path 603 is formed on the bottom of the first container 251 in the second downstream flow path member 250. The groove portion 254 is sealed by the first downstream flow path member 240 accommodated in the first container 251, and thereby constitutes a second flow path 602. That is, the second flow path 602 is a flow path constituted by the groove portion 254 and the surface of the first downstream flow path member 240 on the second downstream flow path member 250 side. The second flow path 602 corresponds to a flow path provided between the first member and the second member.

A plurality of second insertion holes 255 are formed in the second downstream flow path member 250. The wiring substrates 121 which are electrically coupled to the head units 2 are inserted into the second insertion holes 255. Specifically, each second insertion hole 255 is formed to penetrate in the gravity direction Z and to communicate with the first insertion hole 243 of the first downstream flow path member 240 and the coupling port 43 of the head unit 2. In the embodiment, four second insertion holes 255 are provided to correspond to the wiring substrates 121 provided in the four head units 2, respectively.

The downstream flow path 600A is formed in a manner that the first flow path 601, the second flow path 602, and the third flow path 603 described above communicate with each other. The second flow path 602 is formed in a manner that a groove formed in one surface of the first downstream flow path member 240 is sealed by the second downstream flow path member 250. The first downstream flow path member 240 and the second downstream flow path member 250 are bonded to each other in this manner, and thereby it is possible to easily form the second flow path 602 in the downstream flow path member 220.

The second flow path 602 is an example of a flow path extending in a horizontal direction. The phrase of the second flow path 602 extending in the horizontal direction means that the direction in which the second flow path 602 extends includes a component of the scanning direction X or the transport direction Y, that is, a vector of the scanning direction X or the transport direction Y. Since the second flow path 602 extends in the horizontal direction, it is possible to reduce the height of the liquid ejector 1 in the gravity direction Z. If the second flow path 602 is inclined from the horizontal direction, the dimension of the height of the liquid ejector 1 increases.

The direction in which the second flow path 602 extends means a direction in which a liquid in the second flow path 602 flows. Thus, the second flow path 602 includes a path provided in the horizontal direction and a path provided to intersect a horizontal plane extending in the horizontal direction. In the embodiment, the first flow path 601 and the third flow path 603 are provided to extend in the gravity direction Z, and the second flow path 602 is provided to extend in the horizontal direction. The first flow path 601 and the third flow path 603 may be provided to extend in the horizontal direction.

The downstream flow path 600A is not limited thereto. A path other than the first flow path 601, the second flow path 602, and the third flow path 603 may be provided for the downstream flow path 600A. The downstream flow path 600A may not be constituted by the first flow path 601, the second flow path 602, and the third flow path 603, and but be constituted by one flow path.

As described above, the downstream flow path 600B is formed as a through-hole which penetrates the second downstream flow path member 250 in the gravity direction Z. The downstream flow path 600B is not limited to such a form. For example, the downstream flow path 600B may be formed to extend in the horizontal direction or may be constituted by a plurality of flow paths, like the downstream flow path 600A.

The downstream flow path 600A and the downstream flow path 600B are formed for each head unit 2. That is, four sets of downstream flow paths 600A and downstream flow paths 600B are provided in the downstream flow path member 220.

Among openings on both ends of the downstream flow path 600A, an opening of the first flow path 601, which communicates with the first discharge port 504A is set as a first inflow port 610, and an opening of the third flow path 603, which opens to the second container 252 is set as a first outflow port 611.

Among openings on both ends of the downstream flow path 600B, an opening of the downstream flow path 600B, which communicates with the second discharge port 504B is set as a second inflow port 620, and an opening of the downstream flow path 600B, which opens to the second container 252 is set as a second outflow port 621. When distinguishment between the downstream flow path 600A and the downstream flow path 600B is not required, the downstream flow path 600A and the downstream flow path 600B are referred to as the downstream flow path 600 below.

As illustrated in FIG. 6, the downstream flow path member 220 as the holder member holds the head unit 2 on the lower side. Specifically, a plurality of head units 2 is accommodated in the second container 252 in the downstream flow path member 220. In the embodiment, four head units 2 are accommodated in the second container 252 in the downstream flow path member 220.

As illustrated in FIG. 8, two inlets 44 are provided in each head unit 2. The first outflow port 611 and the second outflow port 621 of the downstream flow path 600A and the downstream flow path 600B are provided in the downstream flow path member 220 so as to match with opening positions of the inlets 44.

The inlets 44 of the head unit 2 are aligned to communicate with the first outflow port 611 and the second outflow port 621 of the downstream flow path 600, which open to the bottom portion of the second container 252. The head unit 2 is fixed to the second container 252 with an adhesive 227 provided around the inlets 44. As described above, the head unit 2 is fixed to the second container 252, and thus, the first outflow port 611 and the second outflow port 621 of the downstream flow path 600 communicate with the inlets 44, and the liquid is supplied to the head unit 2.

The head substrate 300 is mounted above the downstream flow path member 220. Specifically, the head substrate 300 is mounted on the surface of the downstream flow path member 220 on the upstream flow path member 210 side. The head substrate 300 is a member which is coupled to the wiring substrate 121 and on which electronic components such as circuits (that control an ejection operation of the liquid ejector 1 via the wiring substrate 121) and resistors are mounted.

As illustrated in FIG. 6, a first terminal row 310 is formed on the surface of the head substrate 300 on the upstream flow path member 210 side. In the first terminal row 310, a plurality of first terminals 311 being electrode terminals which are electrically coupled to the second terminal row 123 of the wiring substrate 121 is arranged. In the embodiment, the first terminal row 310 is formed by arranging the plurality of first terminals 311 in the transport direction Y. In the embodiment, the first terminal row 310 corresponds to an example of a mounting area which is electrically coupled to the wiring substrate 121.

A plurality of third insertion holes 302 into which the wiring substrates 121 electrically coupled to the head units 2 are inserted is formed in the head substrate 300. Specifically, the third insertion hole 302 is formed to penetrate in the gravity direction Z and to communicate with the first insertion hole 243 of the first downstream flow path member 240. In the embodiment, four third insertion holes 302 are provided to correspond to the wiring substrates 121 provided in the four head units 2, respectively.

A third through-hole 301 penetrating in the gravity direction Z is provided in the head substrate 300. The third through-hole 301 is a hole into which the first protrusion portion 241 of the first downstream flow path member 240 and the second protrusion portion 253 of the second downstream flow path member 250 are inserted. In the embodiment, eight third through-holes 301 in total are provided to face the first protrusion portion 241 and the second protrusion portion 253.

The shape of the third through-hole 301 formed in the head substrate 300 is not limited to the above-described form. For example, a common through-hole into which the first protrusion portion 241 and the second protrusion portion 253 may be used as an insertion hole. That is, an insertion hole, a notch, or the like may be formed in the head substrate 300 such that the first protrusion portion 241 and the second protrusion portion 253 do not hinder coupling when the downstream flow path 600 of the downstream flow path member 220 is coupled to the upstream flow path 500 of the upstream flow path member 210.

Figure 9:
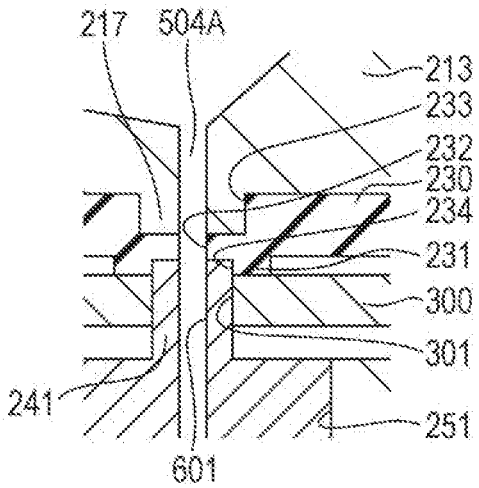
FIG. 9 is an enlarged view illustrating a portion indicated by a frame of a one-dot chain line on a right side in FIG. 8.
Figure 10:
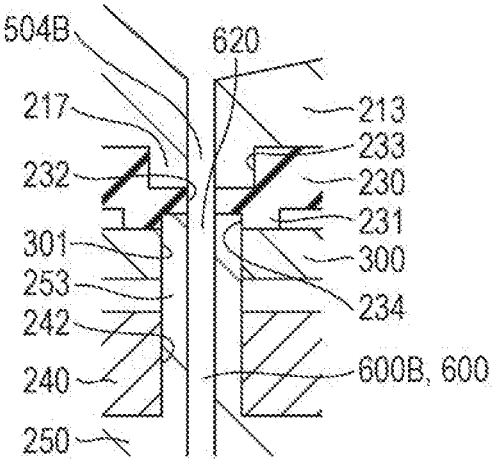
FIG. 10 is an enlarged view illustrating a portion indicated by a frame of a one-dot chain line on a left side in FIG. 8.

As illustrated in FIGS. 8 to 10, the sealing member 230 is provided between the head substrate 300 and the upstream flow path member 210. As the material of the sealing member 230, a material which has liquid resistance against a liquid such as an ink, which is used in the liquid ejector 1 and is elastically deformable, for example, rubber and elastomer can be used.

The sealing member 230 is a plate member in which a communication path 232 penetrating in the gravity direction Z and a fourth protrusion portion 231 protruding toward the downstream flow path member 220 side are formed. In the embodiment, eight communication paths 232 and eight fourth protrusion portions 231 are formed to correspond to the upstream flow paths 500 and the downstream flow paths 600.

A ring-like first recess portion 233 into which the third protrusion portion 217 is inserted is provided on the upstream flow path member 210 side of the sealing member 230. The first recess portion 233 is provided at a position facing the fourth protrusion portion 231.

The fourth protrusion portion 231 is provided to protrude toward the downstream flow path member 220 and is provided at a position facing the first protrusion portion 241 and the second protrusion portion 253 of the downstream flow path member 220. A second recess portion 234 into which the first protrusion portion 241 and the second protrusion portion 253 are inserted is provided on a surface which is the top of the fourth protrusion portion 231 and faces the downstream flow path member 220.

The communication path 232 is configured to penetrate the sealing member 230 in the gravity direction Z and to have one end which opens to the first recess portion 233 and the other end which opens to the second recess portion 234. The fourth protrusion portion 231 is held between the tip surface of the third protrusion portion 217 inserted into the first recess portion 233 and the tip surface of the first protrusion portion 241 and the second protrusion portion 253 inserted into the second recess portion 234. The fourth protrusion portion 231 is held in a state where predetermined pressure is applied in the gravity direction Z. Thus, the upstream flow path 500 and the downstream flow path 600 communicate with each other in a state of being airtightly sealed with the communication path 232.

A cover head 400 is attached to a lower side of the downstream flow path member 220, which is the second container 252 side. The cover head 400 is a member to which the head unit 2 is fixed and which is fixed to the downstream flow path member 220. A second exposure opening portion 401 for exposing the nozzle 21 is provided in the cover head 400. In the embodiment, the second exposure opening portion 401 has an opening which has a size as large as exposing the nozzle plate 20, that is, a size which is substantially equal to that of the first exposure opening portion 45*a* in the compliance substrate 45.

The cover head 400 is bonded to a surface of the compliance substrate 45, which is opposite to the communication plate 15. The cover head 400 seals a space on an opposite side of the common liquid room 100 which is the flow path of the compliance portion 49. As described above, since the compliance portion 49 is covered by the cover head 400, it is possible to reduce a concern that the compliance portion 49 is damaged by coming into contact with a recording medium ST. The cover head 400 suppresses an occurrence of a situation in which a liquid adheres to the compliance portion 49. The liquid adhering to the surface of the cover head 400 can be swept with a wiper blade, for example. Thus, it is possible to suppress contamination of the recording medium ST with the liquid adhering to the cover head 400. Although not particularly illustrated, a space between the cover head 400 and the compliance portion 49 is open to the atmosphere. The cover head 400 may be independently provided for each head unit 2.

Regarding Configuration of Maintenance Device

Next, a configuration of the maintenance device 710 will be described.

Figure 11:
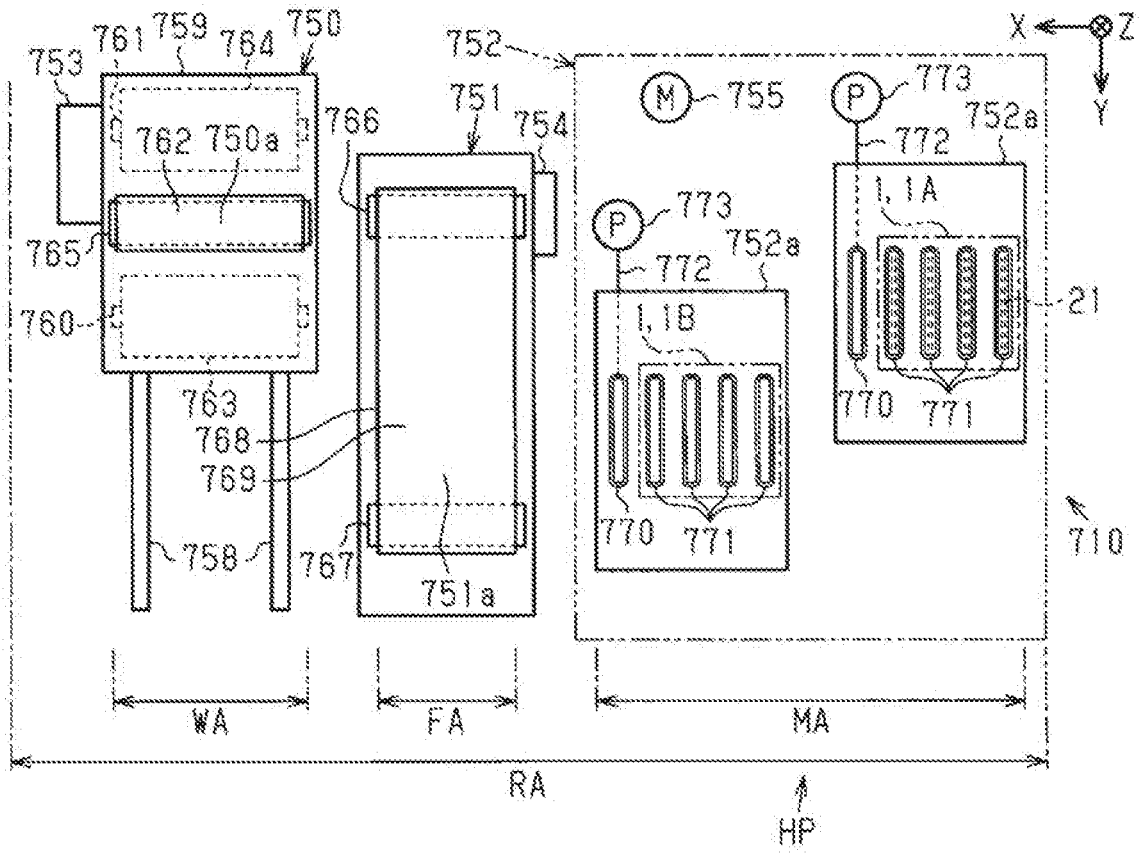
FIG. 11 is a plan view illustrating a configuration of a maintenance device.

As illustrated in FIG. 11, the non-recording area RA includes a wiping area WA, a receiving area FA, and a maintenance area MA. The wiper unit 750 is provided in the wiping area WA. The flushing unit 751 is provided in the receiving area FA. The cap unit 752 is provided in the maintenance area MA. The wiping area WA, the receiving area FA, and the maintenance area MA are located in the non-recording area RA in order from the recording area PA side in the scanning direction X.

The wiper unit 750 includes a wiping member 750*a* configured to absorb a liquid. The wiper unit 750 wipes the nozzle surface 20*a* with the wiping member 750*a*. In the embodiment, the wiping member 750*a* is a movable type. The wiper unit 750 performs wiping with power of a wiping motor 753. The wiping is an operation of sweeping the nozzle surface 20*a* in order to remove dirt such as a liquid and dust, which adheres to the nozzle surface 20*a* of the liquid ejector 1.

The wiper unit 750 includes a pair of rails 758 extending in the transport direction Y and a movable casing 759 supported by the pair of rails 758. The casing 759 is configured to reciprocate on the rails 758 by transmitting power of the wiping motor 753 via a power transmission mechanism such as a rack-and-pinion mechanism. Each of a feeding shaft 760 and a winding shaft 761 is supported in the casing 759, so as to be rotatable. The feeding shaft 760 and a winding shaft 761 are located to be spaced from each other at a predetermined distance in the transport direction Y. The feeding shaft 760 supports a feeding roll 763 on which a not-used cloth sheet 762 is formed. The winding shaft 761 supports a winding roll 764 on which the used cloth sheet 762 is formed.

The cloth sheet 762 located between the feeding roll 763 and the winding roll 764 is wrapped around the upper surface of the pressing roller 765 in a state where a portion of the pressing roller protrudes from an opening located at the center on the upper surface of the casing 759. The cloth sheet 762 forms a semi-cylindrical wiping member 750*a* which is convex upward at a portion at which the cloth sheet 762 is wrapped around the pressing roller 765. The wiping member 750*a* is in a state of being pressed upward.

The wiping motor 753 drives forward, and thereby the casing 759 moves forward from a withdrawal position illustrated in FIG. 11 in the transport direction Y and reaches a wiping position. The wiping motor 753 drives reversely, and thereby the casing 759 moves backward from the wiping position in a direction reverse to the transport direction Y and reaches the withdrawal position. In the embodiment, when the casing 759 moves forward, the wiping member 750*a* wipes the nozzle surface 20*a* of the liquid ejector 1.

If the forward movement of the casing 759 ends, the state of the power transmission mechanism is switched to a state where the wiping motor 753 and the winding shaft 761 are coupled to allow transmission of power. A backward movement of the casing 759 and a winding operation of the cloth sheet 762 around the winding roll 764 by a predetermined amount are performed by power when the wiping motor 753 drives reversely. The liquid ejector 1A and the liquid ejector 1B are sequentially moved to the wiping area WA. Therefore, the wiping member 750*a* wipes one liquid ejector 1 when the casing 759 reciprocates once and wipes two liquid ejectors 1 when the casing 759 reciprocates twice.

The flushing unit 751 includes a liquid receiving portion 751*a* that receives a liquid ejected by the liquid ejector 1. In the embodiment, the liquid receiving portion 751*a* is configured by a belt, for example. The flushing unit 751 moves the belt by power of a flushing motor 754 at predetermined time when the contamination amount of the belt by flushing is greater than a defined amount. The flushing is an operation of ejecting a liquid from the nozzle 21 regardless of the recording processing, in order to prevent and remove clogging of the nozzle 21.

The flushing unit 751 includes a drive roller 766, a driven roller 767, and an endless belt 768. The drive roller 766 and the driven roller 767 oppose each other in the transport direction Y and are parallel to each other. The belt 768 is wrapped around the drive roller 766 and the driven roller 767. In the embodiment, the belt 768 has a width which is equal to or wider than a width of eight nozzle rows NL in the scanning direction X. The belt 768 constitutes the liquid receiving portion 751*a* that receives liquids ejected from the nozzles 21 of the liquid ejector 1A and the liquid ejector 1B. In this case, the outer circumferential surface of the belt 768 acts as a liquid receiving surface 769 for receiving a liquid.

The flushing unit 751 includes a moisturizing-liquid supply portion and a liquid scraping portion (not illustrated) below the belt 768. The moisturizing-liquid supply portion is capable of supplying a moisturizing liquid onto the liquid receiving surface 769. The liquid scraping portion scraps a waste liquid and the like adhering to the liquid receiving surface 769 in a moisturized state. The waste liquid received on the liquid receiving surface 769 is removed from the belt 768 by the liquid scraping portion. Thus, the liquid receiving surface 769 which is to receive a liquid next is updated to a portion to which the waste liquid does not adhere.

The cap unit 752 includes two cap portions 752*a*. The two cap portions 752*a* are configured to be in contact with each of the liquid ejector 1A and the liquid ejector 1B located at the home position HP indicated by a two-dot chain line in FIG. 11. The cap portion 752*a* moves between a contact position at which the cap portion comes into contact with the liquid ejector 1 being at the home position HP and the withdrawal position separated from the liquid ejector 1, by power of a capping motor 755. The cap portion 752*a* located at the contact position comes into contact with the liquid ejector 1 so as to surround the nozzle 21.

In the embodiment, the cap portion 752*a* includes one suction cap 770 and four moisturizing caps 771. The moisturizing cap 771 caps each of two nozzle rows NL so as to suppress dry of the nozzles 21. Capping means that the cap portion 752*a* is brought into contact with the liquid ejector 1, and thereby a closed space is formed to surround the nozzle 21.

The suction cap 770 is coupled to a suction pump 773 via a tube 772. If the suction pump 773 is driven in a state where the suction cap 770 caps the liquid ejector 1, negative pressure is generated in the suction cap 770. The thickened liquid, bubbles, and the like are discharged from the nozzle 21 by an action of the negative pressure generated in the suction cap 770. As described above, an operation of forcibly ejecting a liquid from the nozzle 21 by suction is referred to as a suction cleaning.

The suction cleaning is performed for each of two nozzle rows NL in the liquid ejector 1A and the liquid ejector 1B. If suction cleaning is performed, the liquid discharged from the nozzle 21 may adhere to the nozzle surface 20*a* of the liquid ejector 1. Therefore, after the suction cleaning is performed, wiping may be performed. If the suction cleaning is performed, and then wiping is performed, the liquid adhering to the nozzle surface 20*a* by suction cleaning can be removed by wiping.

If wiping is performed with the wiping member 750*a*, foreign matters adhering to the liquid ejector 1, bubbles, and the like may be put into the nozzle 21. In this case, the meniscus in the nozzle 21 may be broken, or poor ejection may occur in the nozzle 21. Therefore, after wiping is performed, flushing may be performed. If wiping is performed, and then flushing is performed, it is possible to discharge foreign matter in the nozzle 21 or to adjust the meniscus in the nozzle 21.

Regarding Configuration of Fluid Ejecting Device

Next, a configuration of the fluid ejecting device 775 will be described.

Figure 12:
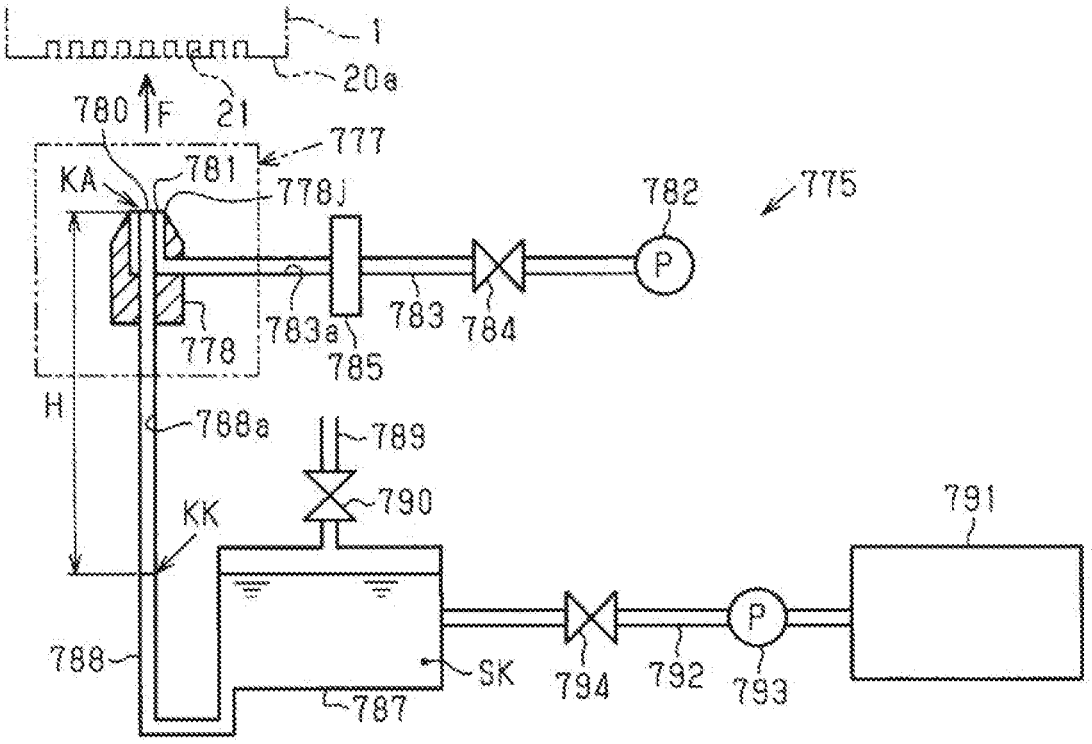
FIG. 12 is a schematic diagram illustrating a configuration of a fluid ejecting device.

As illustrated in FIG. 12, the fluid ejecting device 775 is configured to be capable of ejecting at least one of a gas and a second liquid to the liquid ejector 1. As the gas ejected by the fluid ejecting device 775, for example, an air is provided. As the second liquid ejected by the fluid ejecting device 775, a washing liquid is provided. The fluid ejecting device 775 can eject the gas and the washing liquid together so as to eject a fluid mixture in which the air and the washing liquid are mixed.

The washing liquid may be set to be the same as the main solvent of the liquid used by the liquid ejector 1. In the embodiment, an aqueous resin ink containing water as a solvent is employed as the liquid used by the liquid ejector 1. Thus, pure water is used as the washing liquid. For example, when a solvent of the liquid used by the liquid ejector 1 is an organic solvent, the same organic solvent of the liquid used by the liquid ejector 1 may be used as the washing liquid. As the washing liquid, a liquid obtained by containing an antiseptic in pure water may be used.

The antiseptic contained in the washing liquid may be the same as an antiseptic contained in the liquid used by the liquid ejector 1. Examples of the antiseptic contained in the washing liquid include aromatic halogen compounds, methylene dithiocyanate, halogen-containing nitrogen sulfur compounds, and 1,2-benzisothiazolin-3-one. For example, PreventolCMK is provided as the aromatic halogen compound. For example, PROXELGXL is provided as 1,2-benzisothiazolin-3-one. When PROXEL is employed as the antiseptic from a viewpoint of foam difficulty, it is preferable that the content of the antiseptic with respect to the washing liquid is set to be equal to or smaller than 0.05 mass %.

The fluid ejecting device 775 includes an ejection unit 777. The ejection unit 777 includes a fluid ejection nozzle 778 including an ejection port 778*j* allowing a fluid mixture to be ejected. The fluid ejection nozzle 778 is disposed to eject the fluid mixture in an ejection direction F. The ejection direction F is, for example, an upward direction which is perpendicular to the nozzle surface 20*a*.

The fluid ejection nozzle 778 includes a liquid ejecting nozzle 780 and a gas ejecting nozzle 781. The washing liquid is ejected from the liquid ejecting nozzle 780 in the ejection direction F. The gas is ejected from the gas ejecting nozzle 781 in the ejection direction F. The gas ejecting nozzle 781 is provided in an annular shape, so as to surround the liquid ejecting nozzle 780.

All the liquid ejecting nozzle 780 and the gas ejecting nozzle 781 open in the ejection direction F. If it is considered that the liquid used by the liquid ejector 1 adheres to the liquid ejecting nozzle and is solidified, the opening diameter of the liquid ejecting nozzle 780 is preferably sufficiently larger than the opening diameter of the nozzle 21 in the liquid ejector 1. For example, the opening diameter of the liquid ejecting nozzle is preferably equal to or greater than 0.4 mm. In the embodiment, the opening diameter of the liquid ejecting nozzle 780 is set to 1.1 mm.

In the embodiment, a so-called external mixing type in which a mixing portion KA in which the washing liquid and the gas are mixed is located outside of the fluid ejection nozzle 778 is employed in the fluid ejection nozzle 778. Thus, the mixing portion KA is configured by a predetermined space which is adjacent to the opening of the liquid ejecting nozzle 780 and the opening of the gas ejecting nozzle 781. A gas supply tube 783 for forming a gas flow path 783*a* used for supplying an air from an air pump 782 is joined to the fluid ejection nozzle 778. The gas flow path 783*a* communicates with the gas ejecting nozzle 781.

A pressure adjustment valve 784 for adjusting pressure of the air supplied from the air pump 782 is provided at a position in the middle of the gas supply tube 783. In the embodiment, in the fluid ejecting device 775, the pressure of the air supplied from the air pump 782 to the fluid ejection nozzle 778 is set to be equal to or higher than 200 kPa. An air filter 785 that removes dirt and the like in the air supplied to the fluid ejection nozzle 778 is provided between the pressure adjustment valve 784 in the gas supply tube 783 and the fluid ejection nozzle 778.

A liquid supply tube 788 for forming a liquid flow path 788*a* used for supplying the washing liquid stored in a storage tank 787 is joined to the fluid ejection nozzle 778. The liquid flow path 788*a* communicates with the liquid ejecting nozzle 780. An air release tube 789 for opening a liquid accommodation space SK in the storage tank 787 to the atmosphere is provided at an upper end portion of the storage tank 787. A first solenoid valve 790 as an example of an opening and closing valve is provided in the air release tube 789.

If the first solenoid valve 790 opens, the liquid accommodation space SK turns into a communication state of communicating with the atmosphere via the air release tube 789. If the first solenoid valve 790 closes, the liquid accommodation space SK turns into a not-communication state of not communicating with the atmosphere. That is, the first solenoid valve 790 is configured to be capable of switching the liquid accommodation space SK between the communication state and the not-communication state, by opening and closing the first solenoid valve.

The storage tank 787 is coupled to a washing liquid cartridge 791 via a supply tube 792. The washing liquid cartridge 791 accommodates the washing liquid and is mounted in the apparatus body 11*a* so as to be detachable. A liquid supply pump 793 for supplying the washing liquid in the washing liquid cartridge 791 to the storage tank 787 is provided at a position in the middle of the supply tube 792. A second solenoid valve 794 for opening and closing the supply tube 792 is provided at a position between the liquid supply pump 793 in the supply tube 792 and the storage tank 787.

Figure 13:
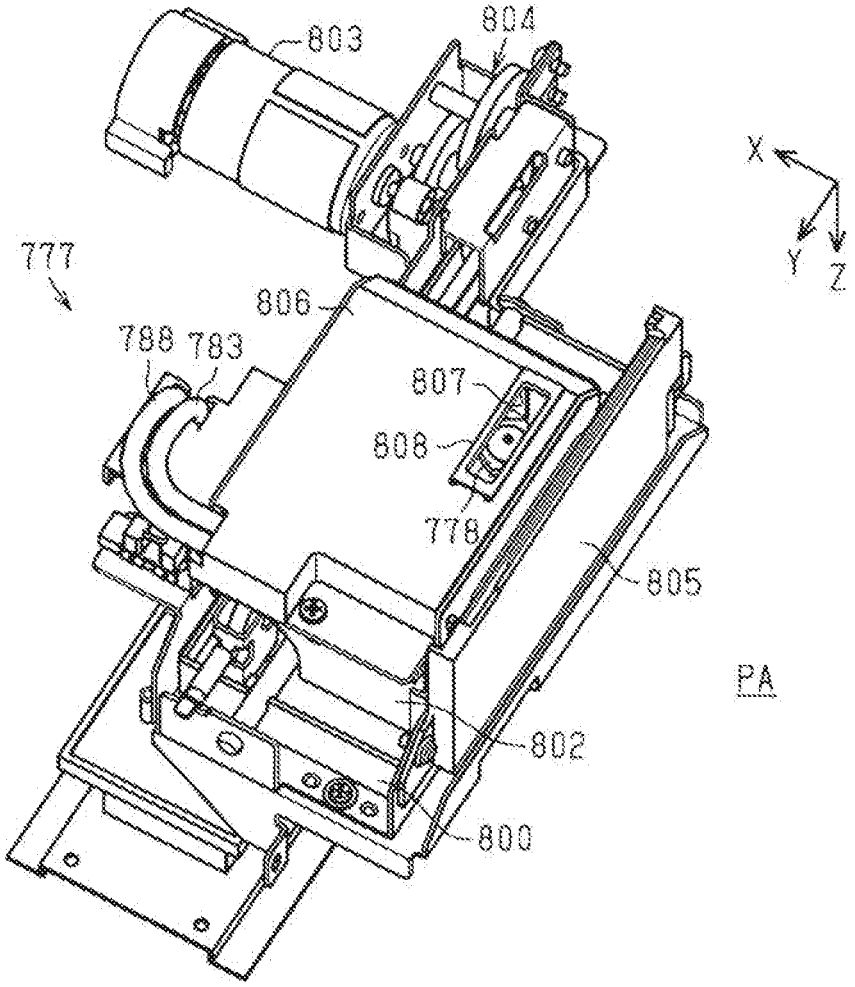
FIG. 13 is a perspective view illustrating an ejection unit.
Figure 14:
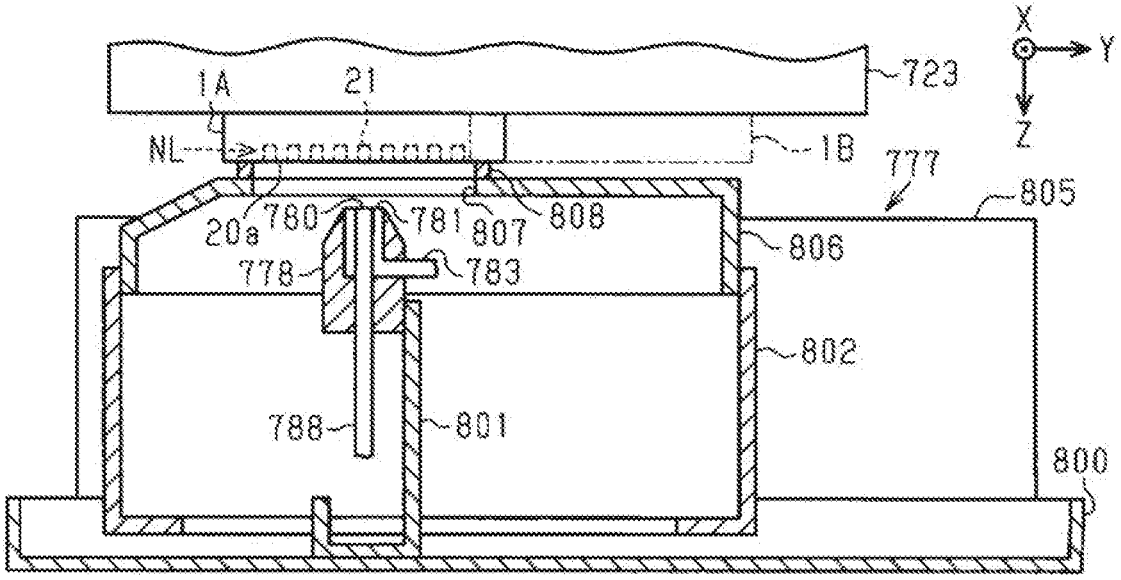
FIG. 14 is a side sectional view schematically illustrating a use state of the ejection unit.

As illustrated in FIGS. 13 and 14, the ejection unit 777 includes a base member 800 and a support member 801 disposed in the base member 800. The base member 800 has a shape which has the bottom and is a substantially rectangular box shape. The support member 801 supports the fluid ejection nozzle 778. The fluid ejection nozzle 778 is fixed to the support member 801. The ejection unit 777 further includes a case 802 disposed in the base member 800. The case 802 has a shape which is a rectangular cylindrical shape and accommodates the fluid ejection nozzle 778 and the support member 801. The support member 801 and the case 802 are configured to be capable of individually moving forward in the base member 800 in the transport direction Y.

As illustrated in FIG. 13, the ejection unit 777 includes a washing motor 803, a transmission mechanism 804, and a side plate 805. The transmission mechanism 804 transmits a driving force of the washing motor 803 to the support member 801. The side plate 805 is provided at an end portion on the side of the recording area PA. If the driving force of the washing motor 803 is transmitted via the transmission mechanism 804, the support member 801 reciprocates along with the fluid ejection nozzle 778 in the transport direction Y. In this case, when the case 802 is pressed from an inner side by the support member 801, the case 802 reciprocates along with the support member 801 in the transport direction Y.

A cover member 806 as an example of a counterpart member configured to close the upper end opening of the case 802 is attached to the case 802. A rectangular through-hole 807 extending in the transport direction Y is formed at a position overlapping a portion of the movement area of the fluid ejection nozzle 778 in the gravity direction Z, on an upper surface of the cover member 806. A lip portion 808 which has a rectangular frame shape and surrounds the through-hole 807 is provided on an upper surface of the cover member 806. A guide portion (not illustrated) configured to guide the case 802 when the case 802 reciprocates in the transport direction Y is provided on a surface of the side plate 805 on the case 802 side.

As illustrated in FIG. 14, the guide portion (not illustrated) guides the case 802 such that the case 802 rises at a position corresponding to each of the liquid ejector 1A and the liquid ejector 1B and is brought into contact with the liquid ejector 1 in a state where the lip portion 808 surrounds two nozzle rows NL which are adjacent to each other.

In the embodiment, a distance between the fluid ejection nozzle 778 and the liquid ejector 1 in the gravity direction Z is set to about 5 mm. A distance between the recording medium ST supported by the support stand 712 illustrated in FIG. 1 and the nozzle surface 20*a* is about 1 mm. Therefore, the distance between the fluid ejection nozzle 778 and the liquid ejector 1 in the gravity direction Z is longer than the distance between the recording medium ST supported by the support stand 712 illustrated in FIG. 1 and the nozzle surface 20*a*.

Regarding Electrical Configuration of Liquid Ejecting Apparatus

Next, an electrical configuration of the liquid ejecting apparatus 7 will be described.

Figure 15:
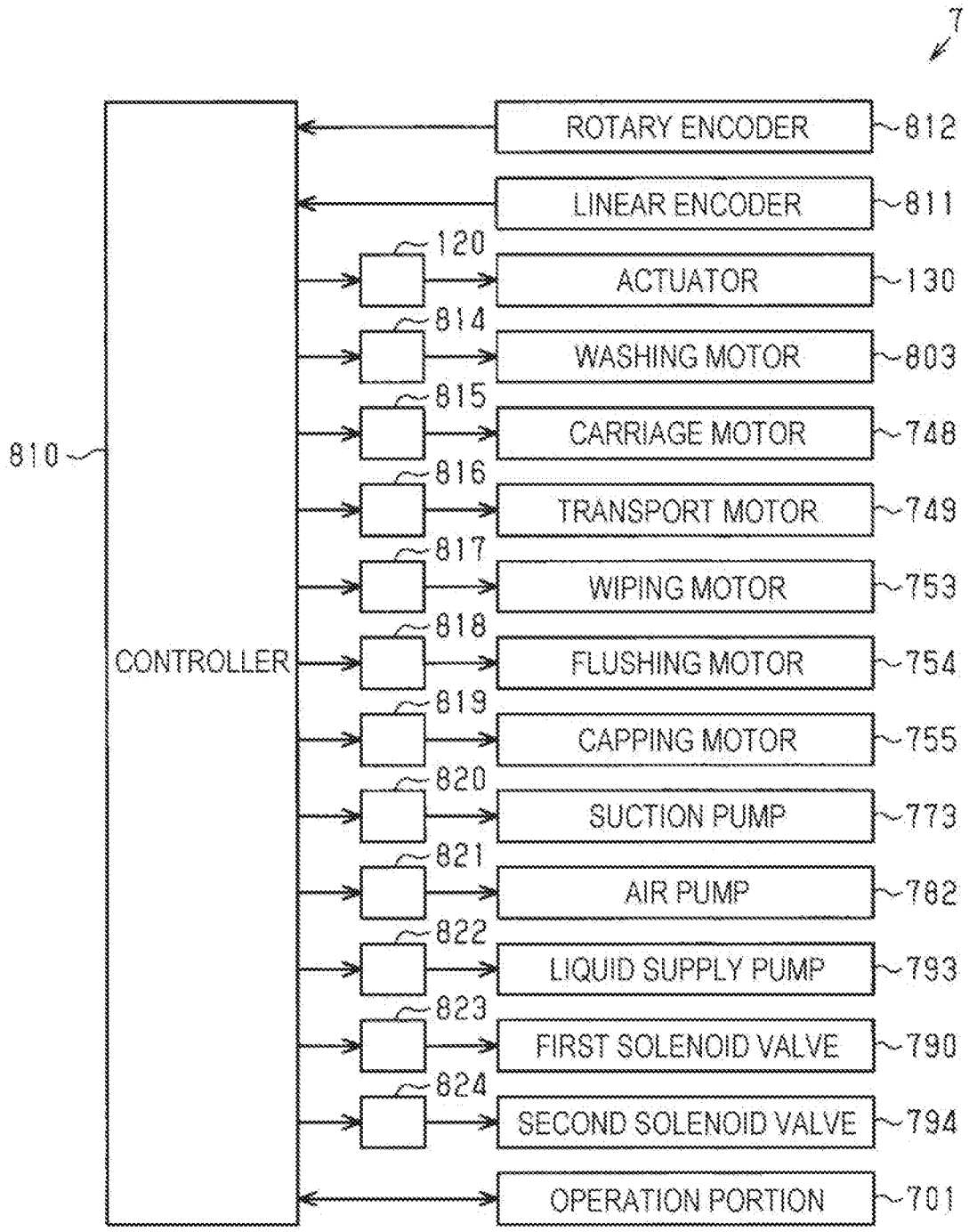
FIG. 15 is a block diagram illustrating an electrical configuration of the liquid ejecting apparatus.

As illustrated in FIG. 15, the liquid ejecting apparatus 7 includes a controller 810 that totally controls the liquid ejecting apparatus 7. The controller 810 is electrically coupled to a linear encoder 811. The linear encoder 811 includes a tape-like code plate and a sensor. The code plate is provided on the back surface side of the carriage 723 so as to extend along the guide shaft 722. The sensor detects light transmitted through slits which have a predetermined pitch and are perforated in the code plate. The sensor is fixed to the carriage 723.

The controller 810 receives an input of pulses of which the number is proportional to the amount of the recording portion 720 moving, from the linear encoder 811. The controller 810 adds the number of input pulses when the recording portion 720 is separated from the home position HP and subtracts when the recording portion 720 is close to the home position HP. In this manner, the controller 810 recognizes the position of the recording portion 720 in the scanning direction X.

A rotary encoder 812 is electrically coupled to the controller 810. The rotary encoder 812 includes a disc-like code plate and a sensor. The code plate is attached to an output shaft of the washing motor 803. The sensor detects light transmitted through slits which have a predetermined pitch and are perforated in the code plate.

The controller 810 receives an input of pulses of which the number is proportional to the amount of the support member 801 moving, from the rotary encoder 812. The controller 810 adds the number of input pulses when the support member 801 is separated from a standby position illustrated in FIG. 20 and subtracts when the support member 801 is close to the standby position. In this manner, the controller 810 recognizes the position of the support member 801 in the transport direction Y, that is, the position of the fluid ejection nozzle 778 in the transport direction Y.

As illustrated in FIG. 15, the controller 810 is electrically coupled to the actuator 130 via the drive circuit 120 and controls driving of the actuator 130. The controller 810 recognizes clogging of the nozzle 21 based on a period of residual vibration of the vibration plate 50 by driving the actuator 130.

The controller 810 is electrically coupled to the washing motor 803 via a motor drive circuit 814. The controller 810 is electrically coupled to the carriage motor 748 via a motor drive circuit 815. The controller 810 is electrically coupled to the transport motor 749 via a motor drive circuit 816. The controller 810 is electrically coupled to the wiping motor 753 via a motor drive circuit 817. The controller 810 is electrically coupled to the flushing motor 754 via a motor drive circuit 818. The controller 810 is electrically coupled to the capping motor 755 via a motor drive circuit 819. The controller 810 controls driving of each of the washing motor 803, the carriage motor 748, the transport motor 749, the wiping motor 753, the flushing motor 754, and the capping motor 755.

The controller 810 is electrically coupled to the suction pump 773 via a pump drive circuit 820. The controller 810 is electrically coupled to the air pump 782 via a pump drive circuit 821. The controller 810 is electrically coupled to the liquid supply pump 793 via a pump drive circuit 822. The controller 810 controls driving of each of the suction pump 773, the air pump 782, and the liquid supply pump 793.

The controller 810 is electrically coupled to the first solenoid valve 790 via a valve drive circuit 823. The controller 810 is electrically coupled to the second solenoid valve 794 via a valve drive circuit 824. The controller 810 controls driving of each of the first solenoid valve 790 and the second solenoid valve 794.

The controller 810 is electrically coupled to the operation portion 701. A user inputs an instruction to the controller 810 with the operation portion 701. In the embodiment, the operation portion 701 transmits information to the controller 810 or receives information from the controller 810.

Figure 16:
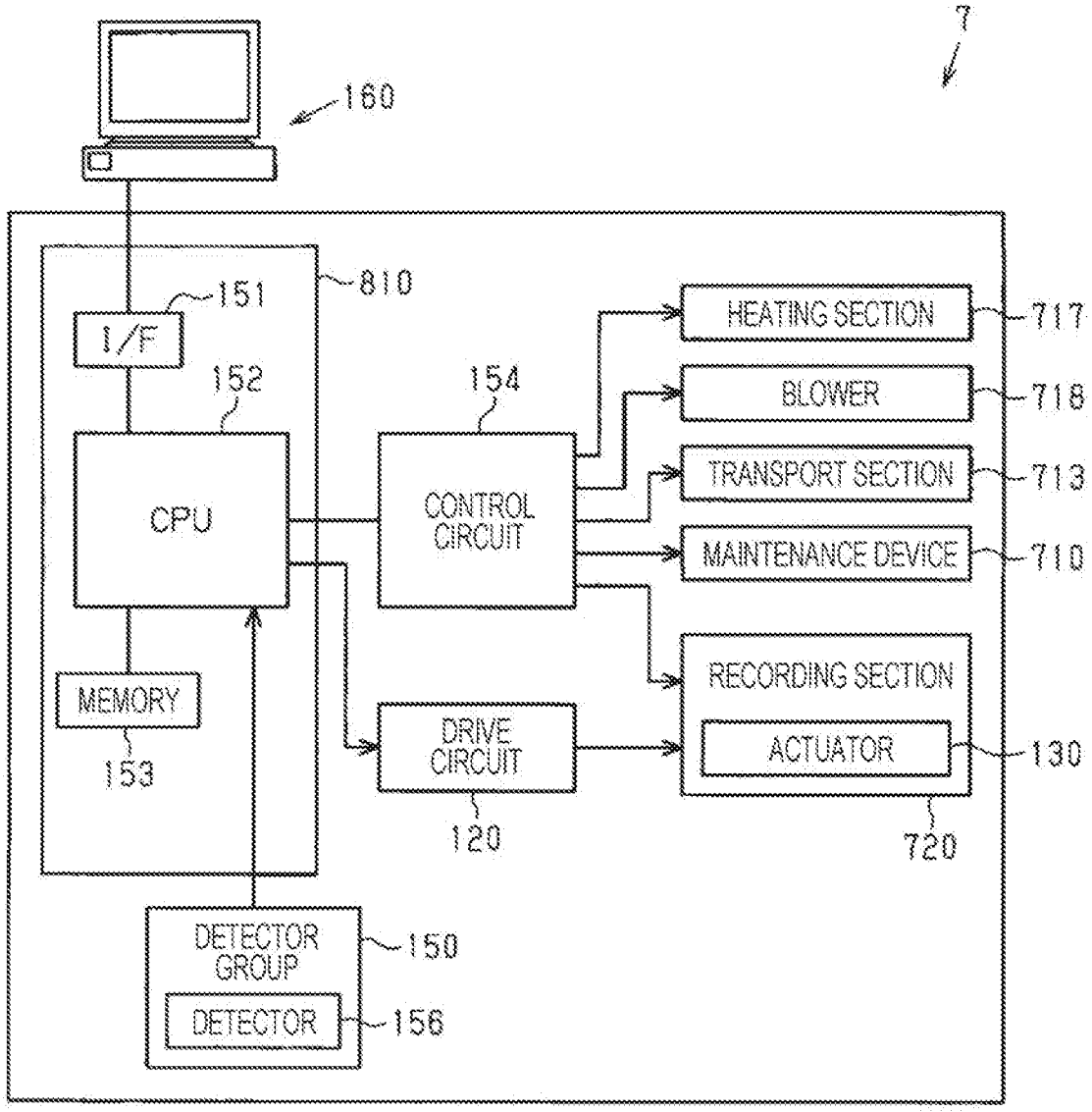
FIG. 16 is a block diagram illustrating the electrical configuration of the liquid ejecting apparatus.

As illustrated in FIG. 16, the liquid ejecting apparatus 7 includes a detector group 150 which monitors the status of the liquid ejecting apparatus 7. The detector group 150 outputs a detection result to the controller 810.

The controller 810 includes an interface unit 151, a CPU 152, and a memory 153. The interface unit 151 causes a computer 160 as an external device and the liquid ejecting apparatus 7 to transmit and receive data to and from each other. The drive circuit 120 generates a drive signal for driving the actuator 130.

The CPU 152 is an execution processing unit. The memory 153 is a storage device that secures an area for storing a program of the CPU 152, a work area, and the like. The memory 153 includes a storage element such as a RAM and an EEPROM. The CPU 152 controls the recording portion 720, the transport portion 713, the heating portion 717, the blower 718, and the maintenance device 710 via a control circuit 154, in accordance with the program stored in the memory 153. The control circuit 154 includes, for example, the motor drive circuit 815, the motor drive circuit 816, the motor drive circuit 817, the motor drive circuit 818, and the motor drive circuit 819.

The detector group 150 includes, for example, the linear encoder 811 that detects a status of the carriage 723 moving, a medium detection sensor that detects the recording medium ST, and a detector 156 configured to detect the ejection state of a liquid from the nozzle 21. The detector 156 is, for example, a circuit for detecting the residual vibration of the pressure generation chamber 12. The controller 810 performs nozzle examination described later, based on a detection result of the detector 156. The detector 156 may include a piezoelectric element constituting the actuator 130.

Regarding Nozzle Examination

Next, nozzle examination performed by the detector 156 detecting the ejection state of the liquid ejector 1 will be described.

If a signal is received from the drive circuit 120, and a voltage is applied to the actuator 130, the vibration plate 50 deflects. Thus, pressure fluctuates in the pressure generation chamber 12, and the vibration plate 50 vibrates for a while by the fluctuation. Such vibration is referred to as residual vibration. An operation of detecting a state of the pressure generation chamber 12 and a state of the nozzle 21 communicating with the pressure generation chamber 12 from the state of residual vibration is referred to as nozzle examination.

Figure 17:
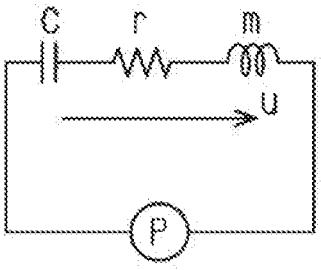
FIG. 17 is a diagram illustrating a calculation model of a single vibration assumed to be a residual vibration of a vibration plate.

FIG. 17 is a diagram illustrating a calculation model of single vibration assumed as residual vibration of the vibration plate 50.

If the drive circuit 120 applies a drive signal to the actuator 130, the actuator 130 expands and contracts in accordance with the voltage of the drive signal. The vibration plate 50 bends in accordance with the expansion and contraction of the actuator 130. Thus, the volume of the pressure generation chamber 12 increases, and then is reduced. At this time, a portion of the liquid of which the pressure generation chamber 12 is full is ejected from the nozzle 21 in a form of a droplet, by pressure generated in the pressure generation chamber 12.

When a series of operations of the vibration plate 50 are performed, the vibration plate 50 freely vibrates at a natural vibration frequency. The natural vibration frequency is determined by flow-path resistance r, inertance m, and compliance C of the vibration plate 50. The flow-path resistance r is determined by the shape of a flow path in which the liquid flows, viscosity of the liquid, and the like. The inertance m is determined by the weight of the liquid in the flow path. The free vibration of the vibration plate 50 is residual vibration.

The calculation model of the residual vibration of the vibration plate 50 is represented by pressure P, the inertance m, the compliance C, and the flow-path resistance r described above. If a step response when pressure P is applied to the circuit in FIG. 17 is calculated for a volume velocity u, the following expression is obtained.

$$u = \frac{P}{\omega \cdot m} e^{-\omega t} \cdot \sin\omega t \tag{1}$$

$$\omega = \sqrt{\frac{1}{m \cdot C} - \alpha^2} \tag{2}$$

$$\alpha = \frac{r}{2m} \tag{3}$$

Figure 18:
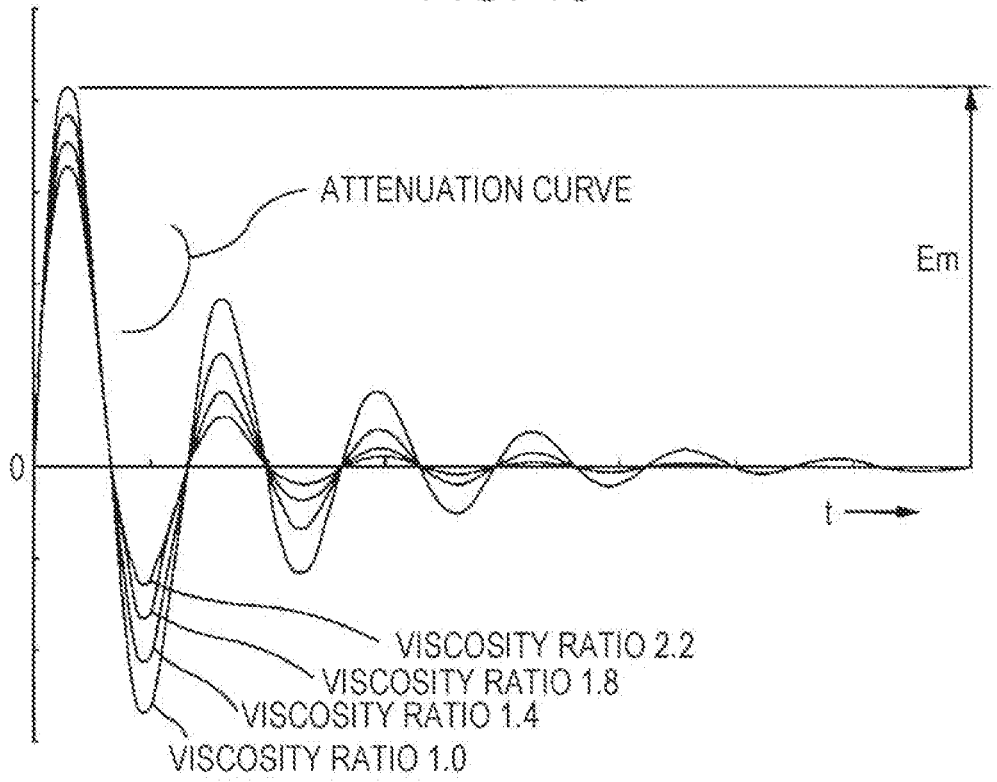
FIG. 18 is a diagram illustrating a relation between thickening of an ink and a waveform of the residual vibration.

FIG. 18 is a diagram illustrating a relation between thickening of the liquid and a waveform of residual vibration. In FIG. 18, a horizontal axis indicates time, and a vertical axis indicates the size of residual vibration. For example, when a liquid in the vicinity of the nozzle 21 is dried, viscosity of the liquid increases, that is, is thickened. If the liquid is thickened, the flow-path resistance r increases. Thus, a vibration period increases, or residual vibration attenuates largely.

Figure 19:
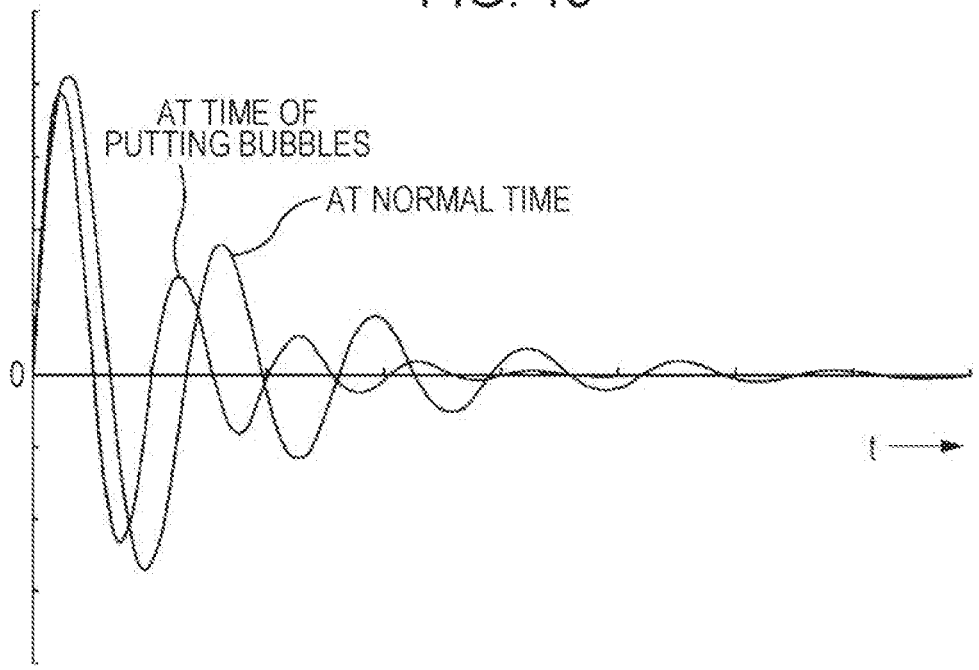
FIG. 19 is a diagram illustrating a relation between mixture of bubbles and the waveform of the residual vibration.

FIG. 19 is a diagram illustrating a relation between mixture of bubbles and the waveform of the residual vibration. In FIG. 19, a horizontal axis indicates time, and a vertical axis indicates the size of residual vibration. For example, when bubbles are put into the flow path of the liquid or the tip of the nozzle 21, the weight of the liquid, that is, the inertance m is reduced by the amount of the put bubbles in comparison to that when the state of the nozzle 21 is normal. With Expression (2), if the inertance m is reduced, an angular velocity ω increases. Thus, the vibration period becomes shorter. That is, the vibration frequency increases.

If foreign matters such as paper powder stick to the vicinity of the opening of the nozzle 21, it is considered that the inertance m increases by increasing the liquid in the pressure generation chamber 12 and the oozing liquid in comparison to that in a normal time when viewed from the vibration plate 50. It is considered that the flow-path resistance r increases by fiber of paper powder adhering to the vicinity of an exit of the nozzle 21. Thus, when the paper powder adheres to the vicinity of the opening of the nozzle 21, the frequency is lower than that when ejection is normally performed, and the frequency of the residual vibration increases in comparison to that when the liquid is thickened.

If the liquid is thickened, bubbles are put in, or foreign matters stick, the state of the nozzle 21 or the state in the pressure generation chamber 12 is not normal. Thus, typically, the liquid is not ejected from the nozzle 21. Therefore, dot missing occurs in an image recorded on a recording medium ST. Even though droplets are ejected from the nozzle 21, the amount of droplets may be small, or a direction of the droplets flying may be shifted so as not to be loaded on a desired position. The nozzle 21 in which such an ejection problem occurs is referred to as an abnormal nozzle.

As described above, the residual vibration of the pressure generation chamber 12 communicating with the abnormal nozzle is different from the residual vibration of the pressure generation chamber 12 communicating with a normal nozzle 21. The detector 156 detects a vibration waveform of the pressure generation chamber 12 so as to detect a state in the pressure generation chamber 12. The controller 810 examines the nozzle 21 based on the detection result of the detector 156. The maintenance device 710 may perform maintenance for removing an ejection problem, based on a result of nozzle examination.

Regarding Maintenance Operation by Maintenance Device

Next, a maintenance operation performed on the liquid ejector 1 by the maintenance device 710 will be described.

If recording data is input to the controller 810 through the computer 160 as the external device and the like, the controller 810 drives the carriage motor 748 based on the recording data. The controller 810 causes the liquid from nozzles 21 of the liquid ejector 1A and the liquid ejector 1B to be ejected onto the surface of a recording medium ST in the process of the recording portion 720 moving in the scanning direction X. If the liquid is ejected, an image is recorded on the surface of the recording medium ST in a manner that the ejected liquid is loaded on the surface of the recording medium ST.

In recording processing of the recording medium ST, in order to suppress thickening of the liquid in the nozzle 21 which does not eject the liquid among all nozzles 21, the recording portion 720 moves into the receiving area FA and performs flushing of ejecting a liquid from the nozzle 21 in a predetermined period. At this time, the recording portion 720 ejects liquids from all the nozzles 21. The predetermined period means, for example, every time at which predetermined time in a range of 10 to 30 seconds elapses.

If a predetermined suction cleaning condition is satisfied, the controller 810 controls the carriage motor 748 to move the recording portion 720 to the home position HP and performs suction cleaning. When the controller 810 performs suction cleaning, the controller 810 brings the suction cap 770 into contact with the liquid ejector 1 so as to surround the nozzle row NL. The controller 810 drives the suction pump 773 in a state where a closed space is formed by the suction cap 770 in contact with the liquid ejector 1. In this manner, negative pressure acts in the suction cap 770, and thereby a liquid of a predetermined amount is sucked from the nozzle 21. Thus, the thickened liquid, bubbles, and the like are removed from the nozzle 21.

After the controller 810 ends suction cleaning, the controller 810 moves the recording portion 720 into the wiping area WA. The controller 810 controls the wiping member 750*a* to wipe the nozzle surface 20*a*, so as to remove liquids and the like adhering to the nozzle surface 20*a*. After wiping is performed, the controller 810 moves the recording portion 720 into the receiving area FA. The controller 810 performs flushing on the liquid receiving portion 751*a* so as to adjust the meniscus in the nozzle 21.

After flushing, the controller 810 detects clogging of the nozzle 21 based on the period of residual vibration of the vibration plate 50 by driving the actuator 130. The reason that clogging of the nozzle 21 is detected after suction cleaning ends is as follows. That is, particularly, when a resin ink containing synthetic resin cured by heating or an UV ink cured by UV irradiation is used as the liquid ejected by the liquid ejector 1, the nozzle 21 in which clogging is not removed even though suction cleaning is performed may be provided.

The clogging here includes a state where it is not possible to normally eject the liquid from the nozzle 21 because the liquid hardens such that a film is stretched on the meniscus of the nozzle 21 or the liquid in the nozzle 21, the pressure generation chamber 12, and the nozzle communication path 16 is thickened, in addition to a state where the liquid in the nozzle 21 is solidified and clogged.

When an occurrence of clogging in all the nozzles 21 is not detected, if the controller 810 receives recording data, the controller 810 moves the recording portion 720 into the recording area PA and performs recording processing on the recording medium ST. If a clogged nozzle 21 is detected among all the nozzles 21, the controller 810 moves the recording portion 720 into the non-recording area LA on an opposite side of the home position HP in the scanning direction X and controls the fluid ejecting device 775 to wash the clogged inside of the nozzle 21. That is, when clogging occurs in the nozzle 21, the controller 810 washes a nozzle for removing clogging of the nozzle 21.

When the fluid ejecting device 775 washes the nozzle, the position of the nozzle 21 matches with the position of the fluid ejection nozzle 778 such that the clogged nozzle 21 and the fluid ejection nozzle 778 face each other in the gravity direction Z. In this case, aligning between the clogged nozzle 21 and the fluid ejection nozzle 778 in the scanning direction X is performed by moving the recording portion 720. Aligning between the clogged nozzle 21 and the fluid ejection nozzle 778 in the transport direction Y is performed by moving the fluid ejection nozzle 778.

In detail, when the clogged nozzle 21 is in the liquid ejector 1A, as illustrated in FIG. 14, the recording portion 720 is aligned in the scanning direction X, and then the case 802 is moved via the support member 801 so that the lip portion 808 is brought into contact with the nozzle surface 20*a* in a state of surrounding a nozzle row NL including the clogged nozzle 21. Then, the fluid ejection nozzle 778 is moved via the support member 801 such that the liquid ejecting nozzle 780 of the fluid ejection nozzle 778 faces the clogged nozzle 21. In this manner, the fluid ejection nozzle 778 is aligned in the transport direction Y.

In a normal state before a fluid mixture is ejected from the fluid ejection nozzle 778, the first solenoid valve 790 opens, and thus the liquid accommodation space SK turns into the communication state of communicating with the atmosphere, and the second solenoid valve 794 turns into a closed state. In this state, as illustrated in FIG. 12, the height H of an air-liquid interface KK of the washing liquid in the liquid flow path 788*a* is preferably set to be −100 to −1000 mm when the height of the tip of the fluid ejection nozzle 778 is set to 0. In the embodiment, when the tip of the fluid ejection nozzle 778 is set to 0, the height H is set to −150 mm.

In the state illustrated in FIGS. 12 to 14, if the air pump 782 drives to supply the atmosphere to the fluid ejection nozzle 778, an air is ejected from the gas ejecting nozzle 781. The washing liquid in the liquid flow path 788*a* is sucked up by negative pressure generated by the ejection of the air. Thus, the washing liquid is ejected from the liquid ejecting nozzle 780. At this time, a fluid mixture is obtained by mixing the air and the washing liquid in the mixing portion KA. As a result, the fluid mixture is ejected onto a partial area of the nozzle surface 20*a*, which includes the clogged nozzle 21.

Multiple washing liquids which have a droplet shape and a diameter smaller than the opening of the nozzle 21 are included in the fluid mixture. An ejection rate of the fluid mixture from the fluid ejection nozzle 778 at this time is set to be equal to or greater than 40 m of each second. For example, when the opening of the nozzle 21 is circular, and the shape of the droplet is spherical, a droplet of the washing liquid, having a diameter which is equal to or smaller than 20 μm and is smaller than the opening diameter of the nozzle 21 is included in the fluid mixture. The droplet of the washing liquid, which has a small diameter is referred to as a small droplet.

Preferably, the kinetic energy of a small droplet has an extent that breaking is not possible at energy transmitted to the air-liquid interface in the nozzle 21 by an ejection operation of the liquid in recording processing and a flushing operation, and is equal to or higher than kinetic energy allowing the liquid film solidified at the air-liquid interface to be broken.

A product of the mass of the small droplet of the washing liquid ejected from the ejection port 778*j* to the nozzle 21 by the fluid ejecting device 775 and the square of a flying velocity of the small droplet at an opening position of the nozzle 21 is set to be greater than a product of the mass of the liquid ejected from the opening of the nozzle 21 and the square of the flying velocity of the liquid.

Preferably, the fluid mixture including a small droplet is ejected onto an opening area in which the clogged nozzle 21 opens, by the fluid ejecting device 775 in a state where the liquid in the pressure generation chamber 12 communicating with the clogged nozzle 21 is pressurized by vibration of the vibration plate 50, which occurs by driving the actuator 130 corresponding to the pressure generation chamber 12. If the fluid mixture is ejected from the fluid ejection nozzle 778 to the clogged nozzle 21, the washing liquid having a shape of a droplet which is smaller than the opening of the nozzle 21 in the fluid mixture enters into the nozzle 21 through the opening of the nozzle 21. At this time, the small droplet of the washing liquid collides with a clogged portion in the nozzle 21.

If the fluid mixture is ejected from the fluid ejection nozzle 778, the washing liquid having a shape of a droplet which is smaller than the opening of the nozzle 21 collides with the hardened liquid in the nozzle 21. The hardened liquid is broken by an impact of the washing liquid on the hardened liquid. Thus, the clogging of the nozzle 21 is removed. At this time, since the liquid in the pressure generation chamber 12 communicating with the nozzle 21 in which clogging has been removed is pressurized, an occurrence of a situation in which the fluid mixture entering into the nozzle 21 enters into the back of the liquid ejector 1A through the pressure generation chamber 12 is suppressed.

When ejection of the fluid mixture from the fluid ejection nozzle 778 is stopped, firstly, the first solenoid valve 790 is closed in a state where the fluid mixture is ejected from the fluid ejection nozzle 778. Thus, the state of the liquid accommodation space SK is switched from the communication state of communicating with the atmosphere to the not-communication state of not communicating with the atmosphere. If the state of the liquid accommodation space SK is switched, the liquid accommodation space SK has negative pressure. Thus, the washing liquid ejected from the liquid ejecting nozzle 780 is drawn to the liquid flow path 788*a* by an action of the negative pressure.

Since the liquid accommodation space SK has negative pressure, the air-liquid interface KK of the washing liquid in the liquid flow path 788*a*, that is, the water level of the storage tank 787 is located downward the mixing portion KA, that is, located on the storage tank 787 side. If the air pump 782 stops, an air is not ejected from the gas ejecting nozzle 781. In this case, the air pump 782 is stopped in a state where the air-liquid interface KK of the washing liquid in the liquid flow path 788*a* is located downward the mixing portion KA. Therefore, an occurrence of a situation in which the washing liquid in the liquid flow path 788*a* enters into the gas ejecting nozzle 781 over the mixing portion KA is suppressed.

After a supply of the air from the air pump 782 to the gas ejecting nozzle 781 through the liquid flow path 788*a* stops, the closed state of the first solenoid valve 790 is maintained. Therefore, the not-communication state of the liquid accommodation space SK is maintained. An unnecessary washing liquid after the nozzle 21 has been washed, an unnecessary ink washed away from the nozzle 21, and the like flow from the inside of the case 802 down into the base member 800. The ink and the washing liquid flowing down into the base member 800 is collected from a waste liquid port provided in the base member 800 into a waste liquid tank.

Figure 20:
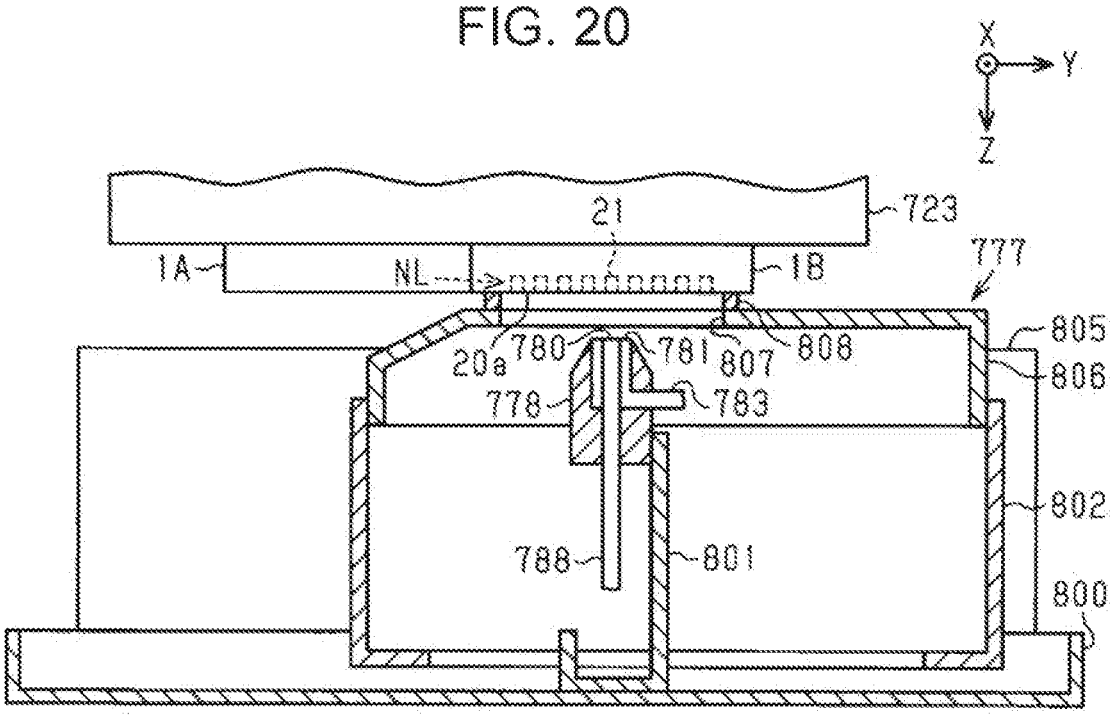
FIG. 20 is a side sectional view schematically illustrating the use state of the ejection unit.

As illustrated in FIG. 20, when the clogged nozzle 21 is in the liquid ejector 1B, similar to a case of the liquid ejector 1A, the case 802 is moved via the support member 801 so that the lip portion 808 is brought into contact with the nozzle surface 20*a* in a state of surrounding the nozzle row NL including the clogged nozzle 21 in the liquid ejector 1B. Similar to the case of the liquid ejector 1A, the clogging of the nozzle 21 is removed by ejecting the fluid mixture to the clogged nozzle 21 of the liquid ejector 1B in a state where the first solenoid valve 790 is closed.

The fluid mixture may be ejected from the fluid ejection nozzle 778 to the liquid ejector 1A or the liquid ejector 1B including the clogged nozzle 21 plural times at a time interval. In this case, the time interval may be constant or may not be constant. If the time interval is provided, the bubble-like fluid mixture which closes the opening of the nozzle 21 when ejection of the fluid mixture stops turns back to a droplet shape even though the fluid mixture ejected to the liquid ejector 1A and the liquid ejector 1B becomes a bubble shape, and thus closes the opening of the nozzle 21. Therefore, it is possible to suppress an occurrence of a situation in which entering of droplets in the fluid mixture ejected to the liquid ejector 1A and the liquid ejector 1B into the nozzle 21 is hindered by the fluid mixture which has been previously ejected to the liquid ejector 1A and the liquid ejector 1B, becomes a bubble shape, and thus closes the opening of the nozzle 21. When pure water which does not contain an antiseptic is used as the washing liquid, such bubbling is suppressed.

Figure 21:
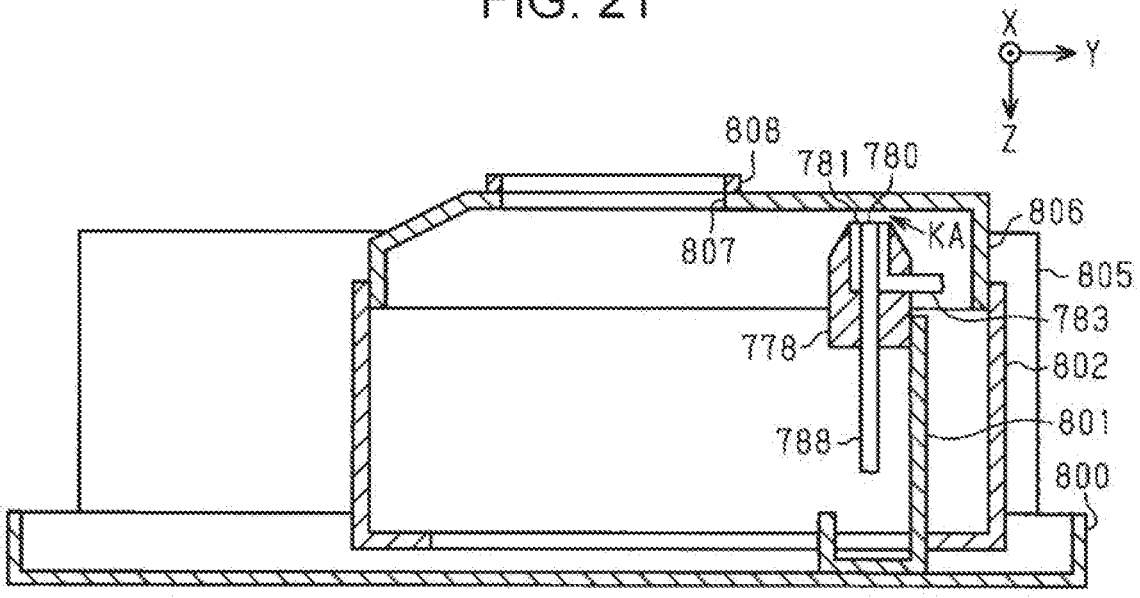
FIG. 21 is a side sectional view schematically illustrating a standby state of the ejection unit.

As illustrated in FIG. 21, after washing of the clogged nozzle 21 in the liquid ejector 1A and the liquid ejector 1B by the fluid ejecting device 775 ends, the support member 801 is moved to the standby position in a state where the fluid mixture is ejected from the fluid ejection nozzle 778, and the fluid ejection nozzle 778 is caused to face a position which does not correspond to the through-hole 807 on an upper wall of the cover member 806. At this time, a small gap is formed between the fluid ejection nozzle 778 and the upper wall of the cover member 806.

The air ejected from the annular gas ejecting nozzle 781 that surrounds the liquid ejecting nozzle 780 collides with the upper wall of the cover member 806, and then flows along the upper wall. Thus, pressure of the air ejected from the annular gas ejecting nozzle 781 on an inside, that is, on an upper side of the liquid ejecting nozzle 780 increases. The washing liquid in the liquid flow path 788*a* is pushed downward, that is, toward the storage tank 787 by the increasing pressure on the upper side of the liquid ejecting nozzle 780. As a result, the air-liquid interface KK of the washing liquid in the liquid flow path 788*a* is in a state of being pushed much downward the mixing portion KA.

If the air pump 782 stops in a state where the air-liquid interface KK of the washing liquid is pushed downward the mixing portion KA, the air is not ejected from the gas ejecting nozzle 781. In this case, the air pump 782 is stopped in a state where the air-liquid interface KK of the washing liquid in the liquid flow path 788*a* is located downward the mixing portion KA. Thus, the occurrence of a situation in which the washing liquid in the liquid flow path 788*a* enters into the gas ejecting nozzle 781 over the mixing portion KA is suppressed.

After the air pump 782 is stopped, suction cleaning or flushing of discharging the liquids from the openings of the nozzles 21 in the liquid ejector 1A and the liquid ejector 1B is performed, and thereby the washing liquid, bubbles, and the like remaining in the liquid ejector 1A and the liquid ejector 1B are removed. At this time, suction cleaning or flushing is completed with a small amount of discharged liquid. The reason is as follows. That is, since the fluid mixture is ejected to the clogged nozzle 21 in a state where the ink in the pressure generation chamber 12 communicating with the clogged nozzle 21 is pressurized as described above, the occurrence of a situation in which the fluid mixture enters into the back of the liquid ejector 1A and the liquid ejector 1B through the pressure generation chamber 12 is suppressed.

Second Embodiment

Next, a liquid ejecting apparatus 7 according to a second embodiment will be described with reference to the drawings.

Figure 22:
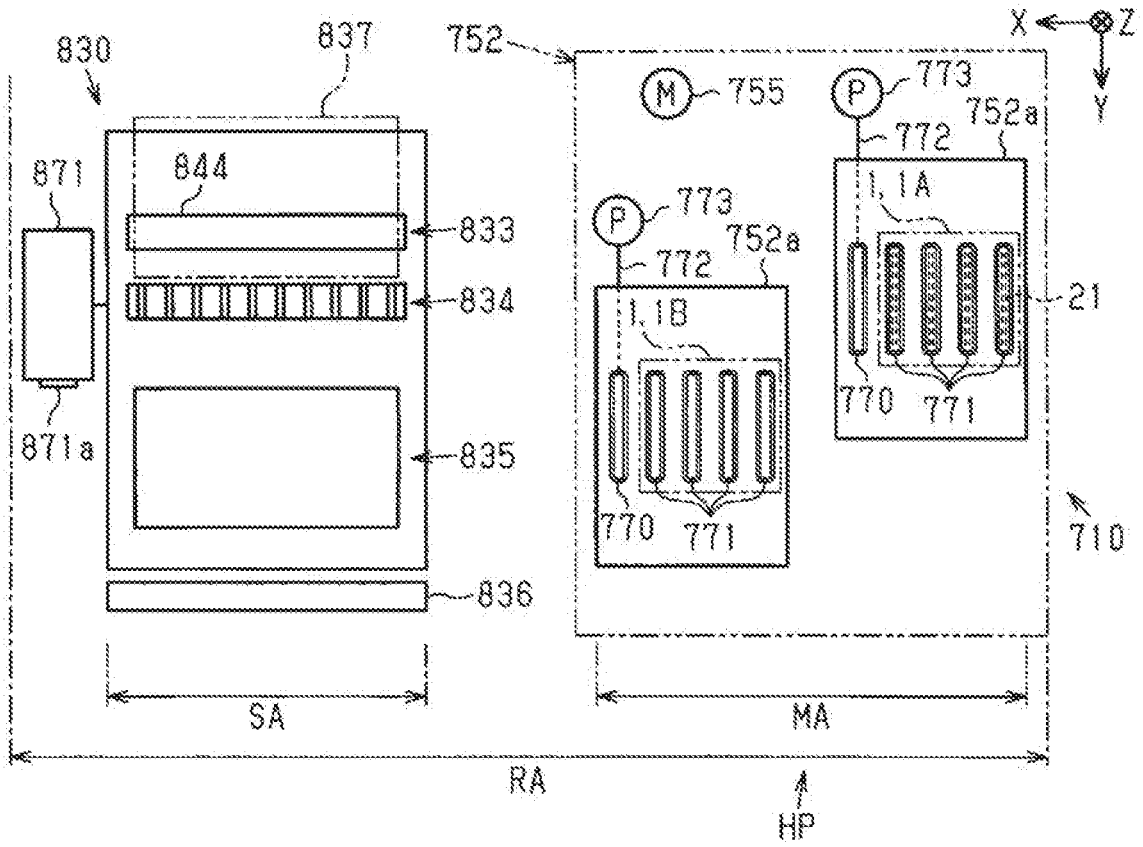
FIG. 22 is a plan view schematically illustrating a configuration of a maintenance device according to a second embodiment.

As illustrated in FIG. 22, in the second embodiment, the liquid ejecting apparatus 7 is obtained by changing the wiper unit 750 and the flushing unit 751 in the maintenance device 710 in the first embodiment to a maintenance unit 830, in comparison to the liquid ejecting apparatus 7 in the first embodiment. In the second embodiment, in the liquid ejecting apparatus 7, components other than the maintenance unit 830 are substantially common with the components of the liquid ejecting apparatus 7 in the first embodiment. Therefore, in the second embodiment, descriptions will be made focusing on differences from the first embodiment.

Figure 23:
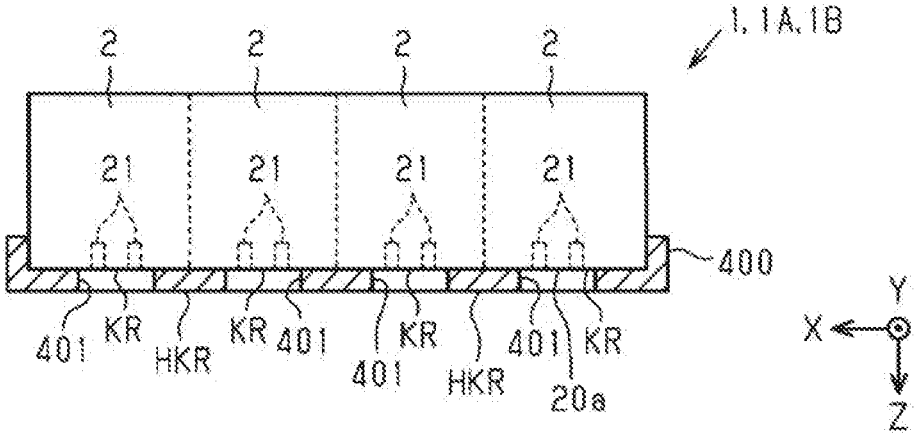
FIG. 23 is a sectional view schematically illustrating the liquid ejector.

As illustrated in FIG. 23, a liquid ejector 1 includes four head units 2 having nozzle surfaces 20*a* on which nozzles 21 open and a cover head 400 that covers all the nozzle surfaces 20*a* which is lower surfaces of the four head units 2. Four second exposure opening portions 401 for exposing the nozzles 21 of the four head units 2 are provided in the cover head 400 to penetrate the cover head 400.

An area on an inside of the second exposure opening portion 401 on the lower surface of the head unit 2 serves as an opening area KR in which the nozzles 21 open. An area which does not include the opening area KR in the liquid ejector 1 serves as a non-opening area HKR. That is, in the embodiment, an area which is not covered by the cover head 400 on the lower surface of the liquid ejector 1 serves as the opening area KR, and the lower surface of the cover head 400 serves as the non-opening area HKR. Liquid repellency of the opening area KR is set to be higher than liquid repellency of the non-opening area HKR.

A liquid repellent film is formed on the nozzle surface 20*a* for a liquid repelling treatment. The components and configuration of the liquid repellent film may be changed in accordance with a liquid ejected by the liquid ejector 1. For example, in order to repel an aqueous ink, a liquid repellent film including a thin-film underlayer and a liquid repellent film layer is suitable. The underlayer contains polyorganosiloxane including an alkyl group, as the main material. The liquid repellent film layer is formed from metal alkoxide having a long chain polymer group containing fluorine.

As illustrated in FIG. 22, the maintenance unit 830 is disposed in a service area SA in a non-recording area RA. The maintenance unit 830 includes a wiping mechanism 833, a wiping-liquid supply mechanism 834, a waste-liquid receiving portion 835, and a collection portion 836. The maintenance unit 830 may further include a wiping liquid container 871 that accommodates a wiping liquid. The wiping liquid container 871 is coupled to the wiping-liquid supply mechanism 834 and is configured to supply the accommodated wiping liquid to the wiping-liquid supply mechanism 834.

The wiping liquid container 871 is constituted by a replaceable cartridge, for example. The wiping liquid container 871 includes a storage medium 871*a* for storing information regarding the accommodated wiping liquid. The storage medium 871*a* stores information of the type and the remaining amount of the accommodated wiping liquid, for example. The storage medium 871*a* is electrically coupled to a controller 810 in a state where the wiping liquid container 871 is mounted in the liquid ejecting apparatus 7. In this state, the controller 810 can read information stored in the storage medium 871*a* or write information in the storage medium 871*a*. For example, when a wiping liquid is supplied from the wiping liquid container 871 to the wiping-liquid supply mechanism 834, the controller 810 updates information regarding the remaining amount of the wiping liquid accommodated in the wiping liquid container 871.

Figure 24:
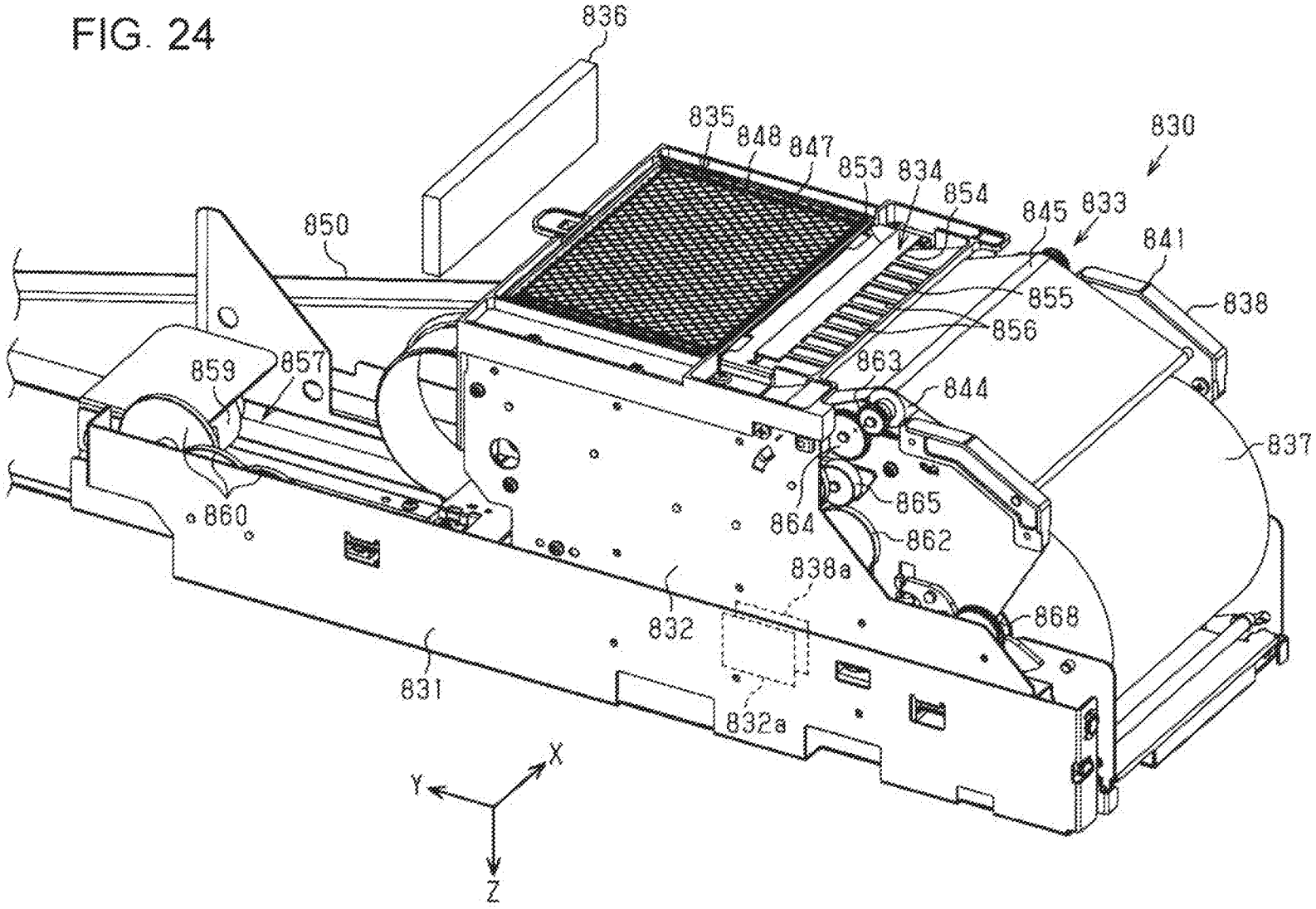
FIG. 24 is a perspective view illustrating a maintenance unit.

As illustrated in FIG. 24, the maintenance unit 830 includes a sill portion 831 extending in the transport direction Y and a base portion 832 supported by the sill portion 831. The base portion 832 is configured to reciprocate with respect to the sill portion 831 in the transport direction Y. The wiping mechanism 833, the wiping-liquid supply mechanism 834, and the waste-liquid receiving portion 835 are provided in the base portion 832. The collection portion 836 is disposed above the base portion 832.

Figure 25:
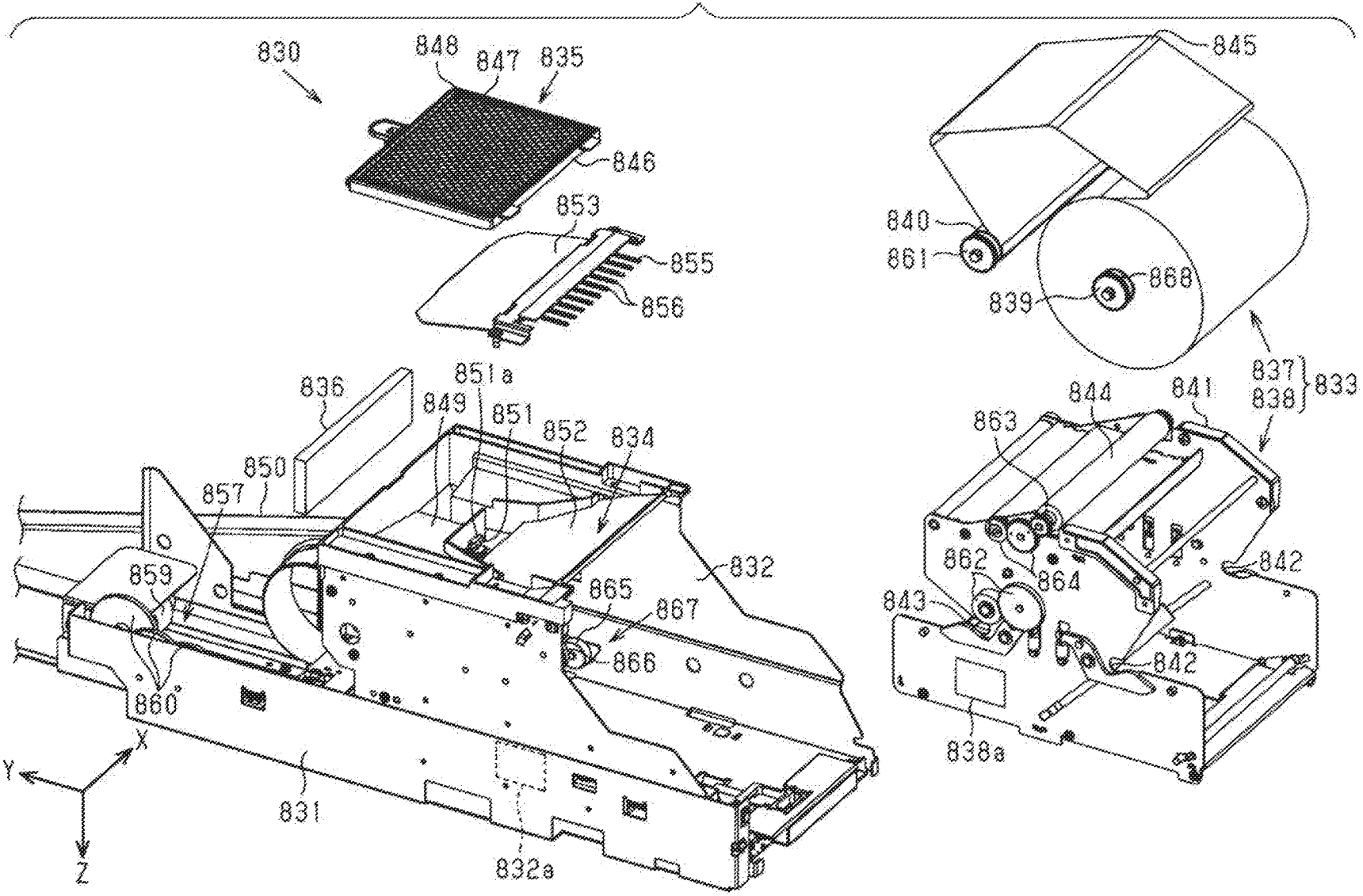
FIG. 25 is an exploded perspective view illustrating the maintenance unit.

As illustrated in FIGS. 24 and 25, the wiping mechanism 833 includes a wiping member 845 configured to absorb a liquid. The wiping mechanism 833 wipes the nozzle surface 20*a* of the liquid ejector 1 with the wiping member 845. If wiping is performed, a liquid, dirt, and the like adhering to the nozzle surface 20*a* of the liquid ejector 1 are wiped off by the wiping member 845. Thus, it is possible to remove contaminations on the nozzle surface 20*a*.

The wiping mechanism 833 wipes the nozzle surface 20*a* with the wiping member 845 by moving relative to the liquid ejector 1. That is, the wiping member 845 wipes the nozzle surface 20*a* by sliding on the nozzle surface 20*a*. When the wiping member 845 wipes the nozzle surface 20*a*, the wiping member 845 may move with respect to the liquid ejector 1, or the liquid ejector 1 may move with respect to the wiping member 845. Both the wiping member 845 and the liquid ejector 1 may move. In the embodiment, wiping is performed by moving the wiping member 845 with respect to the liquid ejector 1. In the embodiment, when the nozzle surface 20*a* is wiped, a direction in which the wiping member 845 moves relative to the liquid ejector 1 is referred to as a wiping direction.

In the embodiment, when the nozzle surface 20*a* is wiped with the wiping member 845, the wiping mechanism 833 also wipes the cover head 400. That is, the wiping mechanism 833 wipes both the opening area KR and the non-opening area HKR in the liquid ejector 1 with the wiping member 845.

The wiping mechanism 833 is configured to attached to the base portion 832 so as to be detachable from an upstream of the transport direction Y. The base portion 832 moves in the transport direction Y, and thereby the wiping mechanism 833 wipes the liquid ejector 1 located in the service area SA with the wiping member 845. That is, in the embodiment, the wiping direction is identical to the transport direction Y. When the base portion 832 moves in the transport direction Y, the nozzle surface 20*a* is wiped. After wiping of the nozzle surface 20*a* ends, the base portion 832 comes back to the original position by moving in a direction reverse to the transport direction Y. The wiping mechanism 833 may be configured to perform wiping when the base portion 832 moves in the direction reverse to the transport direction Y. In this case, the wiping direction is a reverse direction of the transport direction Y.

The liquid ejector 1A and the liquid ejector 1B are sequentially moved into the service area SA. The wiping mechanism 833 wipes one liquid ejector 1 when the base portion 832 reciprocates once and wipes two liquid ejectors 1 when the base portion 832 reciprocates twice.

The wiping mechanism 833 includes a cloth sheet 837 and a cloth holder 838. The cloth sheet 837 is wound in a roll shape and has a long band shape. The cloth sheet 837 is mounted in the cloth holder 838 so as to be detachable from the cloth holder 838. The cloth sheet 837 has absorptivity for absorbing a liquid and the like. Therefore, the cloth sheet 837 is configured to be capable of absorbing a liquid used by the liquid ejector 1 and the wiping liquid supplied by the wiping-liquid supply mechanism 834. The cloth sheet 837 is provided to be coupled to a feeding shaft 839 having a base end extending in the scanning direction X and to be coupled to a winding shaft 840 having a tip extending in the scanning direction X. Most of the cloth sheet 837 is wound around the feeding shaft 839 in a new state. That is, the feeding shaft 839 supports the roll-like cloth sheet 837 which is not used. The winding shaft 840 supports the roll-like cloth sheet 837 which has been used.

The cloth holder 838 includes a wrapping portion 841 obtained by wrapping the cloth sheet 837, at the center in the transport direction Y. The wrapping portion 841 has a substantially fan shape when viewed in the scanning direction X. Feeding bearing portions 842 are provided on an upstream in the transport direction Y in the wrapping portion 841 so as to form a pair in the scanning direction X. The feeding bearing portions 842 support both end portions of the feeding shaft 839 so as to be rotatable. Winding shaft bearing portions 843 are provided on a downstream in the transport direction Y in the wrapping portion 841 so as to form a pair in the scanning direction X. The winding shaft bearing portions 843 support both end portions of the winding shaft 840 so as to be rotatable.

For example, a rubber pressing roller 844 is provided at the center of the wrapping portion 841 in the transport direction Y so as to extend in the scanning direction X. The pressing roller 844 is disposed at the top position of the wrapping portion 841. The cloth sheet 837 located between the feeding shaft 839 and the winding shaft 840 is wrapped around an upper surface of the pressing roller 844. Thus, a semi-cylindrical wiping member 845 which has a convex shape by a portion (obtained by wrapping the cloth sheet 837 around the pressing roller 844) is formed. The wiping member 845 is in a state of being pushed upward via the pressing roller 844 by a pushing member (not illustrated).

The wiping mechanism 833 includes a storage medium 838*a* for storing information regarding the cloth sheet 837. The storage medium 838*a* stores information of a material and the remaining amount of the cloth sheet 837, for example. The storage medium 838*a* is attached to the cloth holder 838. A coupling terminal 832*a* is provided in the base portion 832 so as to come into contact with the storage medium 838*a* in a state where the cloth holder 838 is attached to the base portion 832. If the coupling terminal 832*a* comes into contact with the storage medium 838*a*, the controller 810 and the storage medium 838*a* are electrically coupled to each other. In this state, the controller 810 can read information stored in the storage medium 838*a* or write information in the storage medium 838*a*. For example, when the winding shaft 840 rotates to wind the used cloth sheet 837, the controller 810 updates information regarding the remaining amount of the cloth sheet 837 which has been wound around the feeding shaft 839 and has not been used yet.

The waste-liquid receiving portion 835 is attached to the base portion 832 so as to be detachable. The waste-liquid receiving portion 835 includes a rectangular frame member 846, a rectangular liquid absorbing material 847 accommodated in the frame member 846, and a rectangular net member 848 disposed on the liquid absorbing material 847.

The frame member 846 is formed of synthetic resin, for example. The liquid absorbing material 847 is formed of nonwoven fabric, for example. The net member 848 is a member for pushing the liquid absorbing material 847 and is formed of stainless steel, for example.

The waste-liquid receiving portion 835 is disposed on a downstream of the wiping mechanism 833 in the wiping direction when the wiping mechanism 833 wipes the liquid ejector 1. The waste-liquid receiving portion 835 receives a waste liquid ejected from the nozzle 21 by a flushing operation of performing flushing of the liquid ejector 1, at a position facing the liquid ejector 1.

A receiving recess portion 849 is formed on a downstream of the waste-liquid receiving portion 835 in the base portion 832. The receiving recess portion 849 receives the waste liquid flowing down from the waste-liquid receiving portion 835. A waste liquid tube 850 is coupled to the bottom of the receiving recess portion 849. The waste liquid flowing down to the receiving recess portion 849 is collected by a waste-liquid collection container (not illustrated) through the waste liquid tube 850.

The wiping-liquid supply mechanism 834 is configured to supply the wiping liquid to the wiping member 845. The wiping-liquid supply mechanism 834 supplies the wiping liquid accommodated in the wiping liquid container 871 to the wiping member 845. Since the wiping-liquid supply mechanism 834 supplies the wiping member 845 to the wiping liquid, the wiping mechanism 833 can wipe the nozzle surface 20*a* with the wiping member 845 which has absorbed the wiping liquid.

When wiping is performed with the wiping member 845 which has absorbed the wiping liquid, it is possible to suppress damages of the nozzle surface 20*a* by wiping, in comparison to a case where wiping is performed with the wiping member 845 which does not absorb the wiping liquid. When wiping is performed with the wiping member 845 which has absorbed the wiping liquid, it is easy to remove contamination on the nozzle surface 20*a*, in comparison to a case where wiping is performed with the wiping member 845 which does not absorb the wiping liquid. When the wiping member 845 absorbs the wiping liquid, the wiping member 845 is in a state of being wet by the wiping liquid. When not absorbing the wiping liquid, the wiping member 845 is in a state of being not wet.

An operation of wiping the nozzle surface 20*a* in a state where the wiping member 845 has absorbed the wiping liquid is referred to as wet-wiping. An operation of wiping the nozzle surface 20*a* in a state where the wiping member 845 does not absorb the wiping liquid is referred to as non-wet wiping. In the second embodiment, the liquid ejecting apparatus 7 is configured to perform wet-wiping when the nozzle surface 20*a* is wiped with the wiping member 845. The liquid ejecting apparatus 7 may be configured to select wet-wiping or non-wet wiping. When wet-wiping is performed, the wiping-liquid supply mechanism 834 supplies the wiping liquid to the wiping member 845 before the wiping member 845 wipes the nozzle surface 20*a*.

The wiping-liquid supply mechanism 834 is disposed between the wiping mechanism 833 and the receiving recess portion 849 in the base portion 832. The wiping-liquid supply mechanism 834 includes an ejection port 851 allowing the wiping liquid to be ejected to the liquid ejector 1 or the wiping member 845. The wiping-liquid supply mechanism 834 further includes a path formation plate 853 which is made of, for example, stainless steel. The path formation plate 853 covers the ejection port 851 from the top and forms a path 852 of the wiping liquid ejected from the ejection port 851 to the liquid ejector 1.

In the embodiment, the ejection port 851 is constituted by a supply nozzle 851*a* for ejecting the wiping liquid so as to be spread in a fan shape. The supply nozzle 851*a* is configured to be pivotable. Since the supply nozzle 851*a* pivots, an ejection destination of the wiping liquid ejected from the ejection port 851 is changed to the liquid ejector 1 or the wiping member 845.

A supply tube (not illustrated) for supplying the wiping liquid is coupled to the supply nozzle 851*a*. The supply nozzle 851*a* is coupled to the wiping liquid container 871 through the supply tube (not illustrated). An ejection pump (not illustrated) that ejects a fluid from the supply nozzle 851*a* is provided in the supply tube. Driving of the ejection pump is controlled by the controller 810.

The wiping-liquid supply mechanism 834 may be configured to eject a fluid including the wiping liquid. For example, the wiping-liquid supply mechanism 834 may include a nozzle for ejecting an air as a gas, similar to the fluid ejecting device 775, in addition to the supply nozzle 851*a* for ejecting the wiping liquid. In this case, the wiping-liquid supply mechanism 834 is capable of ejecting the wiping liquid and an air to the liquid ejector 1 or the wiping member 845. The wiping-liquid supply mechanism 834 may be configured to be capable of performing both ejection of the wiping liquid and ejection of a fluid including the wiping liquid.

The path 852 extends obliquely upward toward the wiping mechanism 833. The tip of the path 852 serves as a spout opening portion 854 for spouting a fluid from the inside of the path 852 to the outside of the path 852. The spout opening portion 854 is located between the wiping mechanism 833 and the waste-liquid receiving portion 835 in the base portion 832. A portion of the spout opening portion 854 is shielded by a comb-like blocking mechanism 855 formed in the path formation plate 853.

The blocking mechanism 855 includes a plurality of thin blocking plates 856 which is arranged over the entirety of the spout opening portion 854 at an equal distance in the scanning direction X and extends in the transport direction Y. The plurality of blocking plates 856 are disposed to block a fluid directed toward the opening area KR when the liquid ejector 1 moving into the service area SA ejects the fluid from the ejection port 851 through the path 852 and the spout opening portion 854.

As the wiping liquid, a liquid which is the same as the washing liquid used by the fluid ejecting device 775 in the liquid ejecting apparatus 7 in the first embodiment may be used. That is, pure water may be employed as the wiping liquid, or a liquid obtained by containing an antiseptic in pure water may be employed as the wiping liquid. As the wiping liquid, a liquid having surface tension which is higher than surface tension of the liquid used by the liquid ejector 1 may be employed. For example, a liquid having surface tension of 40 mN/m to 80 mN/m may be employed as the wiping liquid. In this case, a liquid having surface tension of 60 mN/m to 80 mN/m may be employed as the wiping liquid.

The collection portion 836 is configured with, for example, a rubber blade having a rectangular plate shape and is fixed to the apparatus body 11*a*. The collection portion 836 is brought into contact with the waste-liquid receiving portion 835, and thus the waste liquid received by the waste-liquid receiving portion 835 and deposits thereof are scraped and collected. That is, if the waste-liquid receiving portion 835 moves with moving the base portion 832 in the transport direction Y, the collection portion 836 relatively moves on the net member 848 so as to scrap the waste liquid and deposits thereof adhering onto the net member 848 of the waste-liquid receiving portion 835.

Figure 26:
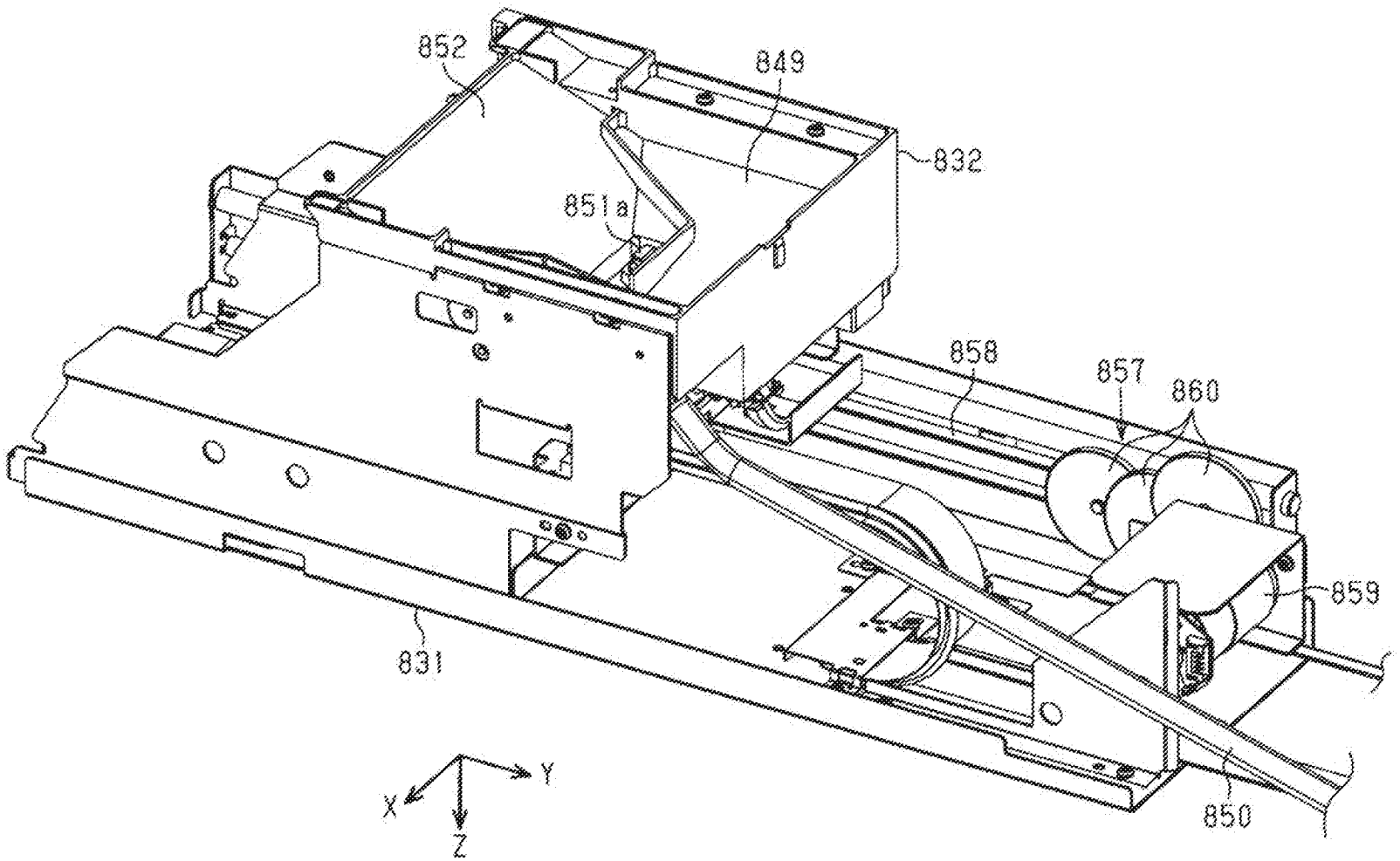
FIG. 26 is a perspective view illustrating a sill portion and a base portion.

As illustrated in FIG. 26, the maintenance unit 830 includes a relatively-moving mechanism 857 that moves the liquid ejector 1 and the wiping member 845 relative to each other when the wiping member 845 wipes the nozzle surface 20*a*. In the embodiment, the relatively-moving mechanism 857 moves the wiping member 845 with respect to the liquid ejector 1.

In the embodiment, the relatively-moving mechanism 857 is provided in the sill portion 831 and is configured to cause the base portion 832 to reciprocate in the transport direction Y. The relatively-moving mechanism 857 includes a pair of pulleys provided to be rotatable, on an inner surface of the sill portion 831. The pair of pulleys are located at both end portions of the inner surface of the sill portion 831 in the transport direction Y, respectively.

The relatively-moving mechanism 857 includes an endless timing belt 858, a moving motor 859, and a reduction gear group 860. The timing belt 858 is wrapped by the pair of pulleys. The reduction gear group 860 transmits a rotational driving force of the moving motor 859 to the pair of pulleys. The controller 810 controls driving of the moving motor 859.

A portion of the timing belt 858 is joined to the base portion 832. If the timing belt 858 moves by driving the moving motor 859, the base portion 832 reciprocates in the transport direction Y. The base portion 832 holds the wiping mechanism 833 and the waste-liquid receiving portion 835. Therefore, if the base portion 832 is moved with respect to the liquid ejector 1 and the collection portion 836 by the relatively-moving mechanism 857 in a state where the liquid ejector 1 is moved into the service area SA, the wiping mechanism 833 and the waste-liquid receiving portion 835 can be moved with respect to the liquid ejector 1 and the collection portion 836.

The relatively-moving mechanism 857 moves the base portion 832 in the transport direction Y, and thereby moves a pair of the wiping mechanism 833 and the waste-liquid receiving portion 835 and a pair of the liquid ejector 1 and the collection portion 836 relative to each other in the wiping direction in which the wiping mechanism 833 wipes the liquid ejector 1.

Figure 32:
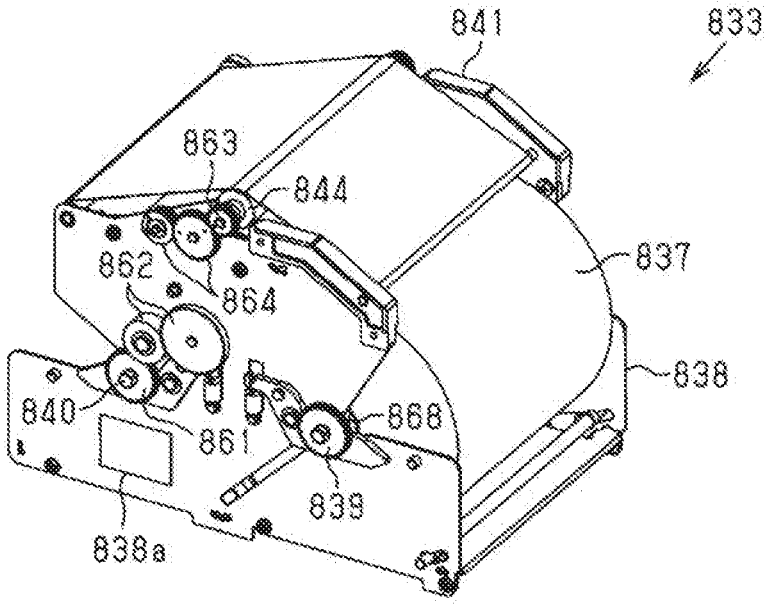
FIG. 32 is a perspective view illustrating the wiping mechanism after the cloth sheet has been mounted in the cloth holder.

As illustrated in FIGS. 25 and 32, two first transmission gears 862 and two second transmission gears 864 are provided on one side surface of the cloth holder 838 in the wiping mechanism 833 in the scanning direction X. The first transmission gear 862 engages with a winding gear 861 provided at one end portion of the winding shaft 840 of the cloth sheet 837 mounted in the cloth holder 838. The second transmission gear 864 engages with a pressing gear 863 provided at one end portion of the pressing roller 844.

A winding driving mechanism 867 is provided in the base portion 832. The winding driving mechanism 867 includes a transmission gear group 865 and a winding motor 866. The transmission gear group 865 engages with the first transmission gear 862 and the second transmission gear 864 when the wiping mechanism 833 is mounted in the base portion 832. The winding motor 866 drives the transmission gear group 865 to rotate. The controller 810 controls driving of the winding motor 866.

If the winding motor 866 of the winding driving mechanism 867 drives, the rotational driving force thereof is transmitted to the first transmission gear 862 and the second transmission gear 864 through the transmission gear group 865. If the force is transmitted, the first transmission gear 862 and the second transmission gear 864 rotate, and thus the winding gear 861 and the pressing gear 863 are rotated. Thus, the winding shaft 840 and the pressing roller 844 are rotated with synchronization with a direction in which the cloth sheet 837 is wound. As a result, the cloth sheet 837 is wound by the winding shaft 840. At this time, since the winding shaft 840 and the pressing roller 844 rotate in synchronization with each other, rubbing between the pressing roller 844 and the cloth sheet 837 is suppressed. Therefore, wear of the pressing roller 844 is suppressed.

The liquid ejecting apparatus 7 is configured to be capable of changing the supply amount of the wiping liquid when the nozzle surface 20*a* is wiped with the wiping member 845. That is, the wiping-liquid supply mechanism 834 is configured to be capable of changing the supply amount of the wiping liquid ejected to the wiping member 845. If the supply amount of the wiping liquid supplied to the wiping member 845 is small when wet-wiping is performed, the nozzle surface 20*a* is easily damaged by wiping. In particular, when the liquid used by the liquid ejector 1 is an inorganic pigment ink, for example, an inorganic pigment such as carbon rubs against the nozzle surface 20*a*, and thereby the nozzle surface 20*a* is easily damaged. If the liquid repellent film formed on the nozzle surface 20*a* is damaged, the liquid repellency of the nozzle surface 20*a* is deteriorated. As a result, ejection accuracy of the nozzle 21 for ejecting the liquid is affected.

If the supply amount of the wiping liquid supplied to the wiping member 845 is large when wet-wiping is performed, the wiping liquid easily remains on the nozzle surface 20*a* after the nozzle surface 20*a* is wiped with the wiping member 845. If the wiping liquid remains on the nozzle surface 20*a*, the ejection accuracy of the nozzle 21 for ejecting the liquid is affected.

If the supply amount of the wiping liquid supplied to the wiping member 845 is large when wet-wiping is performed, when the wiping member 845 wipes the nozzle surface 20*a*, the liquid adhering to the nozzle surface 20*a* may not be absorbed, and but the liquid adhering to the nozzle surface 20*a* may be pushed into the nozzle 21, or bubbles may be pushed into the nozzle 21. In this case, an abnormal nozzle may occur. Therefore, if the supply amount of the wiping liquid supplied to the wiping member 845 is changed to an appropriate amount when wet-wiping is performed, it is possible to appropriately perform wiping.

The controller 810 may control the wiping-liquid supply mechanism 834 to change the supply amount of the wiping liquid when the wiping member 845 wipes the nozzle surface 20*a*, based on the status of the liquid ejecting apparatus 7. That is, the supply amount of the wiping liquid when the wiping member 845 wipes the nozzle surface 20*a* may be changed based on the status of the liquid ejecting apparatus 7, as a maintenance method of the liquid ejecting apparatus 7.

The status of the liquid ejecting apparatus 7 includes, for example, an operation status of the liquid ejector 1 and an operation status of the wiping mechanism 833. The controller 810 may change the supply amount of the wiping liquid based on the status of the liquid ejecting apparatus 7: for example, an installation environment of the liquid ejecting apparatus 7; the remaining amount of the wiping liquid; the contamination state of the nozzle surface 20*a*; time elapsed from the previous wiping; a result of the previous wiping; the number of nozzles 21 in which clogging occurs; the type of liquid ejected by the liquid ejector 1; and the material of the cloth sheet 837 constituting the wiping member 845.

For example, when the contamination state of the nozzle surface 20*a* is relatively small, the supply amount of the wiping liquid may be set to be small. For example, when the contamination state of the nozzle surface 20*a* is relatively large, the supply amount of the wiping liquid may be set to be large. For example, when the liquid ejected by the liquid ejector 1 is a liquid which is easily solidified, the supply amount of the wiping liquid may be set to be large. For example, when the liquid ejected by the liquid ejector 1 is a liquid which has difficulty in being solidified, the supply amount of the wiping liquid may be set to be small.

The controller 810 may change the supply amount of the wiping liquid when the wiping member 845 wipes the nozzle surface 20*a*, based on a detection result of the ejection state by the detector 156. That is, the supply amount of the wiping liquid when the wiping member 845 wipes the nozzle surface 20*a* may be changed based on the detection result of the ejection state by the detector 156, as a maintenance method of the liquid ejecting apparatus 7. The detection result of the ejection state by the detector 156 is an example of the status of the liquid ejecting apparatus 7.

For example, when it is supposed that a clogged nozzle 21 is provided, based on the detection result of the ejection state by the detector 156, that is, based on a result of nozzle examination, the supply amount of the wiping liquid may increase. For example, when it is supposed that there is no clogged nozzle 21, based on the result of nozzle examination, the supply amount of the wiping liquid may decrease.

The controller 810 may change the supply amount of the wiping liquid when the wiping member 845 wipes the nozzle surface 20*a*, based on a contained amount of the wiping liquid accommodated in the wiping liquid container 871. For example, a method as follows may be performed as the maintenance method of the liquid ejecting apparatus 7. That is, when the contained amount of the wiping liquid accommodated in the wiping liquid container 871 is smaller than a setting value, the supply amount of the wiping liquid when wet-wiping is performed may be set to smaller than the supply amount of the wiping liquid when the wet-wiping is performed in a case where the contained amount of the wiping liquid accommodated in the wiping liquid container 871 is equal to or greater than the setting value.

The setting value is a threshold value which is preset in the controller 810. When the controller 810 acquires the contained amount of the wiping liquid accommodated in the wiping liquid container 871, the controller 810 compares the contained amount of the wiping liquid to the setting value. When the contained amount of the wiping liquid accommodated in the wiping liquid container 871 is smaller than the setting value, the controller 810 supposes that the contained amount of the wiping liquid accommodated in the wiping liquid container 871 is small. In this case, the controller 810 sets the supply amount of the wiping liquid when wet-wiping is performed, to be smaller than the supply amount of the wiping liquid when wet-wiping is performed in a case where the contained amount of the wiping liquid accommodated in the wiping liquid container 871 is equal to or greater than the setting value. If such setting is performed, the consumption of the wiping liquid when the contained amount of the wiping liquid is small is suppressed. Thus, it is possible to increase the number of times of performing wet-wiping.

As the maintenance method of the liquid ejecting apparatus 7, non-wet wiping in which the wiping member 845 wipes the nozzle surface 20*a* without a supply of the wiping liquid may be performed when the contained amount of the wiping liquid accommodated in the wiping liquid container 871 is smaller than a second setting value which is smaller than the setting value. In this case, the relative movement speed between the liquid ejector 1 and the wiping member 845 in a non-wet wiping operation may be set to be slower than the relative movement speed between the liquid ejector 1 and the wiping member 845 in a wet-wiping operation which is performed when the contained amount of the wiping liquid is equal to or greater than the setting value.

The second setting value is a threshold value which is preset in the controller 810. The second setting value is smaller than the above-described setting value. The second setting value is set as a value indicating that a supply of the wiping liquid to the wiping member 845 by the wiping-liquid supply mechanism 834 has difficulty when the contained amount of the wiping liquid accommodated in the wiping liquid container 871 is smaller than the second setting value.

When the controller 810 acquires the contained amount of the wiping liquid accommodated in the wiping liquid container 871, the controller 810 compares the contained amount of the wiping liquid to the setting value and the second setting value. When the contained amount of the wiping liquid accommodated in the wiping liquid container 871 is smaller than the second setting value, the controller 810 supposes that the contained amount of the wiping liquid accommodated in the wiping liquid container 871 is very small or 0. In this case, the controller 810 may perform non-wet wiping as the wiping.

When non-wet wiping is performed, the wiping-liquid supply mechanism 834 does not supply the wiping liquid to the wiping member 845 before the wiping member 845 wipes the nozzle surface 20*a*. In a case of non-wet wiping, since the wiping liquid is not supplied to the wiping member 845, removal of the contamination on the nozzle surface 20*a* has difficulty in spite of wiping. Therefore, in the non-wet wiping operation, wiping is performed at the relative movement speed between the liquid ejector 1 and the wiping member 845, which is slower than that in the wet-wiping operation, and thereby it is easy to remove the contamination on the nozzle surface 20*a*.

In a case of non-wet wiping, since the wiping liquid is not supplied to the wiping member 845, the nozzle surface 20*a* may be damaged by wiping. Therefore, in the non-wet wiping operation, wiping is performed at the relative movement speed between the liquid ejector 1 and the wiping member 845, which is slower than that in the wet-wiping operation, and thereby damage of the nozzle surface 20*a* by wiping is reduced.

When the contained amount of the wiping liquid accommodated in the wiping liquid container 871 is smaller than the second setting value, the controller 810 may prohibit wiping. When the contained amount of the wiping liquid accommodated in the wiping liquid container 871 is smaller than the second setting value, a user may be allowed to select whether non-wet wiping is performed, or wiping is prohibited.

As the maintenance method of the liquid ejecting apparatus 7, the supply amount of the wiping liquid when wet-wiping is performed in a case where the liquid is not ejected from the nozzle 21 in recording processing may be set to be smaller than the supply amount of the wiping liquid when wet-wiping is performed in a case where recording processing is not performed.

As in the embodiment, in a serial type in which the liquid ejector 1 reciprocates in the scanning direction X, time when the liquid is not ejected from the nozzle 21 in recording processing is a timing at which movement is switched from a forward movement to a backward movement in the recording processing, or a timing at which movement is switched from the backward movement to the forward movement. In the serial type liquid ejecting apparatus 7, a recording medium ST is intermittently transported with matching with a timing at which the movement of the liquid ejector 1 is switched. While the recording medium ST is transported, the liquid ejector 1 does not eject the liquid onto the recording medium ST even in recording processing. Therefore, in the serial type liquid ejecting apparatus 7, wet-wiping may be performed at a timing at which the recording medium ST is transported in the recording processing. At this time, the supply amount of the wiping liquid supplied to the wiping member 845 is smaller than the supply amount of the wiping liquid supplied to the wiping member 845 when recording processing is not performed, for example, when wet-wiping is performed in the standby state.

In a line type in which the liquid ejector 1 is provided to be long in the scanning direction X, time when the liquid is not ejected from the nozzle 21 in recording processing is a timing in a period from when recording of an image is completed until recording of the next image starts. In the line type liquid ejecting apparatus 7, wet-wiping may be performed at a timing in recording processing.

When wet-wiping is performed in recording processing, if the wiping liquid remains on the nozzle surface 20*a*, recording quality is affected. Therefore, when wet-wiping is performed in recording processing, the supply amount of the wiping liquid is set to be small. If the supply amount thereof is set to be small, a concern that the wiping liquid remains on the nozzle surface 20*a* when wet-wiping is performed in recording processing is reduced. Thus, it is possible to reduce a concern of deteriorating recording quality by wet-wiping.

The liquid ejector 1 may perform flushing in recording processing, in order to suppress an occurrence of a situation in which the not-used liquid in the nozzle 21 is thickened or solidified. The liquid ejecting apparatus 7 may be configured to perform wet-wiping with matching with a timing at which flushing is performed in recording processing. The liquid ejecting apparatus 7 may be configured to perform wet-wiping in recording processing when it is determined that a large amount of liquid adhere to the nozzle surface 20*a* by the recording processing.

As the maintenance method of the liquid ejecting apparatus 7, a method as follows may be performed. That is, regarding nozzles 21 supposed to be in an abnormal ejection state from the detection result of the ejection state by the detector 156 performed after the nozzle surface 20*a* is wiped with the wiping member 845, when the number of nozzles 21 on a wiping end side is greater than the number of nozzles 21 on a wiping start side, at least one of a change of increasing the supply amount of the wiping liquid when the nozzle surface 20*a* is wiped with the wiping member 845 in comparison to that before the ejection state is detected, and a change of setting the relative movement speed between the liquid ejector 1 and the wiping member 845 to be slower than that before the ejection state is detected may be performed.

The controller 810 performs nozzle examination after wiping is performed. When the number of abnormal nozzles on the wiping end side is greater than the number of abnormal nozzles on the wiping start side, the controller 810 supposes that it is not possible to appropriately wipe the nozzle surface 20*a*.

When wet-wiping is performed, the amount of the wiping liquid provided in the wiping member 845 may become gradually insufficient while the wiping member 845 proceeds in the wiping direction. In this case, it may be possible to appropriately perform wiping on the wiping start side, but it may not be possible to appropriately perform wiping on the wiping end side. With such reasons, the abnormal nozzle easily occurs on the wiping end side, in the nozzle surface 20*a*, in comparison to the wiping start side.

In the embodiment, the nozzle row NL is constituted by 180 nozzles 21. Therefore, the nozzle row NL is constituted by 90 nozzles 21 located on the wiping start side and 90 nozzles 21 located on the wiping end side. The liquid ejector 1 has eight nozzle rows NL in total. Therefore, the liquid ejector 1 has 1440 nozzles in total. After nozzle examination, the controller 810 compares the number of abnormal nozzles among 720 nozzles 21 located on the wiping start side and the number of abnormal nozzles among 720 nozzles 21 located on the wiping end side, in the nozzle surface 20*a*. When the number of abnormal nozzles on the wiping end side is greater than the number of abnormal nozzles on the wiping start side, the controller 810 supposes that nozzles which have not be wiped yet remain on the wiping end side.

When, regarding the number of abnormal nozzles detected by nozzle examination, the number of abnormal nozzles on the wiping end side is greater than the number of abnormal nozzles on the wiping start side, the controller 810 performs at least one of the change of increasing the supply amount of the wiping liquid in comparison to that before the nozzle examination is performed, and the change of setting the relative movement speed between the liquid ejector 1 and the wiping member 845 to be slower than that before the nozzle examination is performed. That is, the supply amount of the wiping liquid when the next wet-wiping is performed increases, or the relative movement speed between the liquid ejector 1 and the wiping member 845 is set to be slow when the next wet-wiping is performed.

Since the supply amount of the wiping liquid is set to increase, it is possible to appropriately wipe the wiping end side of the nozzle surface 20*a*. Since the relative movement speed between the liquid ejector 1 and the wiping member 845 is set to be slow, it is possible to reduce wiping remaining of the liquid adhering to the wiping end side of the nozzle surface 20*a*.

If the relative movement speed between the liquid ejector 1 and the wiping member 845 is set to be fast, the wiping member 845 may pass by the nozzle surface 20*a* before the wiping member absorbs the liquid adhering to the nozzle surface 20*a*. Therefore, if the relative movement speed between the liquid ejector 1 and the wiping member 845 is set to be fast, wiping remaining may occur.

The controller 810 may perform nozzle examination before and after wiping is performed. In this case, the controller 810 may compare results of the nozzle examination performed before and after performing wiping to each other. If the controller compares the results, the controller 810 can suppose that it is not possible to appropriately perform wiping when the number of abnormal nozzles after wiping is performed is greater than the number of abnormal nozzles before wiping is performed.

The supply nozzle 851*a* may be configured to reciprocate in the scanning direction X. If the supply nozzle 851*a* is configured to reciprocate, the wiping-liquid supply mechanism 834 can change the supply amount of the wiping liquid to the wiping member 845 in the scanning direction X. For example, it is possible to increase the supply amount of the wiping liquid to some wiping members 845 corresponding to the nozzles 21 or the nozzle rows NL in which clogging easily occurs. For example, it is possible to increase the supply amount of the wiping liquid to some wiping members 845 corresponding to an area in which foreign matters easily remain in the nozzle surface 20*a*. The area in which the foreign matters easily remain in the nozzle surface 20*a* refers to, for example, a step portion between the nozzle surface 20*a* and the cover head 400. In particular, foreign matters easily remain at a corner portion formed by the nozzle surface 20*a* and the second exposure opening portion 401 of the cover head 400 in FIG. 23. Conversely, it is possible to reduce the supply amount of the wiping liquid to some wiping members 845 corresponding to the nozzles 21 or the nozzle rows NL in which an occurrence of clogging has difficulty. It is possible to reduce the supply amount of the wiping liquid to some wiping members 845 corresponding to an area in which remaining of foreign matters has difficulty in the nozzle surface 20*a*. In this case, it is possible to reduce an amount of the consumed wiping liquid.

The liquid ejecting apparatus 7 may be configured to change the supply amount of the wiping liquid with the operation portion 701. If the supply amount thereof is changed with the operation portion, it is possible to change the supply amount of the wiping liquid to a desired amount of a user by an operation of the user. Therefore, usability for the user is improved.

Figure 27:
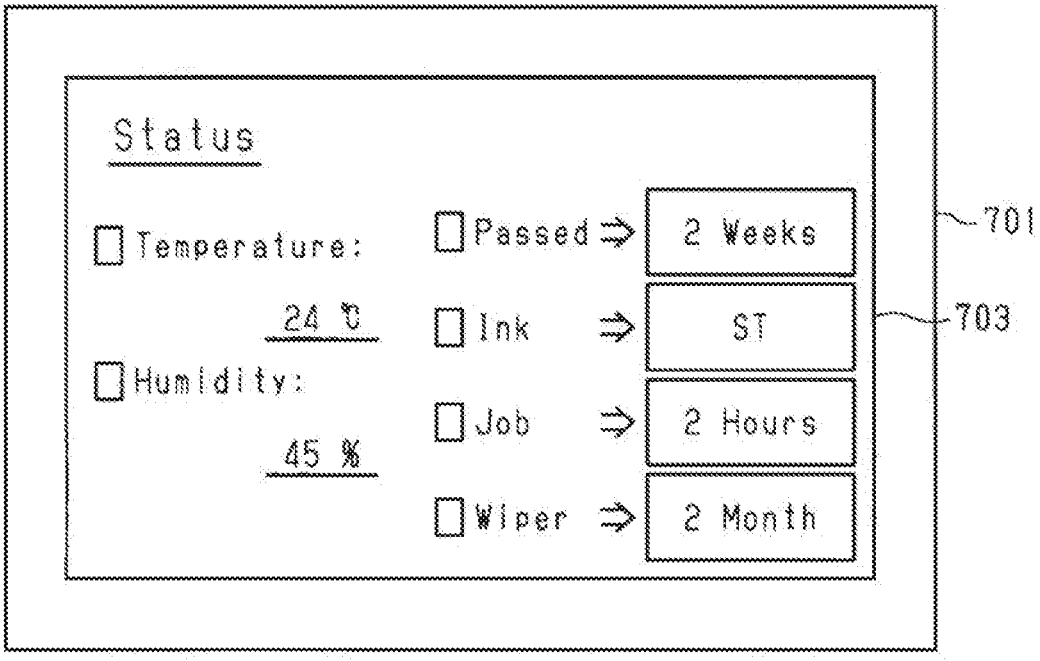
FIG. 27 is a diagram illustrating a status screen.

As illustrated in FIG. 27, a status screen 703 showing the status of the liquid ejecting apparatus 7 is displayed in a touch panel functioning as the operation portion 701. The temperature and humidity of an environment in which the liquid ejecting apparatus 7 is installed, an operation time, and the like are displayed, as the status of the liquid ejecting apparatus 7, on the status screen 703. In the embodiment, "Temperature", "Humidity", "Passed", "Ink", "Job", and "Wiper" are displayed on the status screen 703 as the status of the liquid ejecting apparatus 7. Other kinds of information may be displayed on the status screen 703, as the status of the liquid ejecting apparatus 7.

In the status screen 703, "Passed" indicates time elapsed from when the liquid ejector 1 is filled with a liquid. "Ink" indicates the type of liquid used by the liquid ejector 1. "Job" indicates time elapsed from when power is put into the liquid ejecting apparatus 7. "Wiper" indicates time elapsed from when a cloth sheet 837 is replaced. A user sees the status screen 703 to recognize the status of the liquid ejecting apparatus 7. The user changes the supply amount based on the status of the liquid ejecting apparatus 7.

Figure 28:
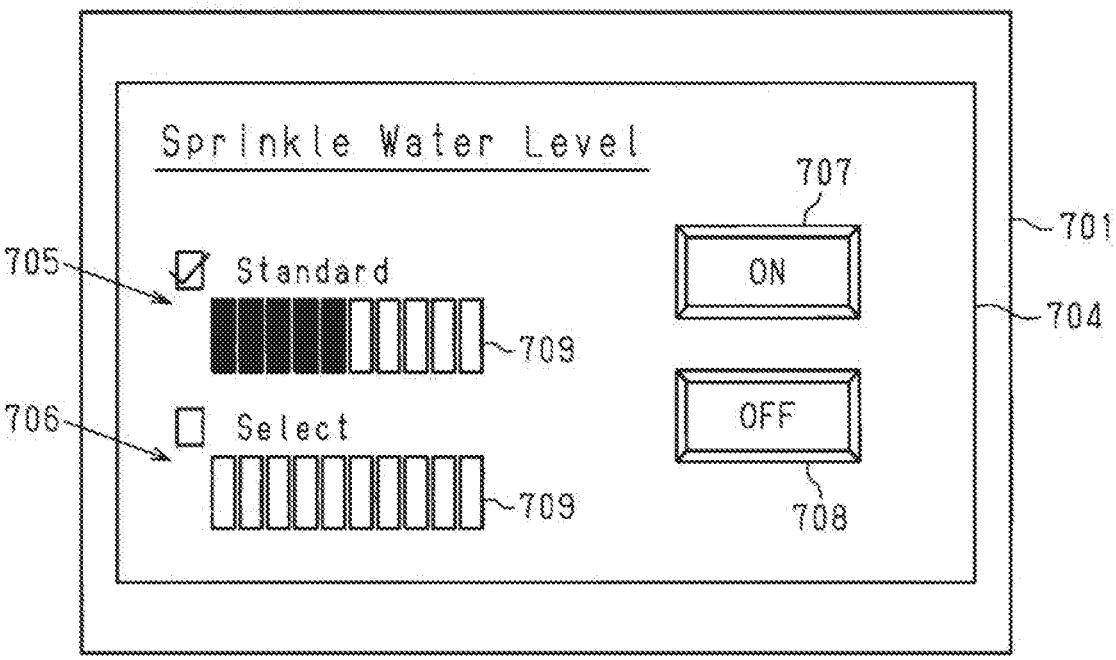
FIG. 28 is a diagram illustrating a change screen.

As illustrated in FIG. 28, when the supply amount of the wiping liquid is changed, a change screen 704 for changing the supply amount is displayed in the operation portion 701. In the embodiment, a normal setting bar 705 indicated by "Standard", a selection setting bar 706 indicated by "Select", an applying button 707 indicated by "ON", and a cancel button 708 indicated by "OFF" are displayed on the change screen 704.

Each of the normal setting bar 705 and the selection setting bar 706 is configured by arranging 10 bars 709. The 10 bars 709 indicate the supply amount of the wiping liquid supplied by the wiping-liquid supply mechanism 834. In FIG. 28, five bars 709 among the 10 bars 709 are colored in the normal setting bar 705. That is, the normal setting bar 705 indicates that the supply amount of the wiping liquid is set as the fifth step among 10 steps.

The normal setting bar 705 displays the supply amount of the wiping liquid which is estimated to be appropriate by the controller 810 based on the status of the liquid ejecting apparatus 7. When the supply amount of the wiping liquid, which is displayed in the normal setting bar 705 is changed, the user selects the selection setting bar 706. With the selection setting bar 706, the supply amount of the wiping liquid can be set to be any step of the 0th step to the 10th step by an operation of the user. In a case of the 0th step, the supply amount of the wiping liquid is set to 0.

The user changes the supply amount of the wiping liquid with the selection setting bar 706, and then selects the applying button 707 or the cancel button 708. If the applying button 707 is selected, the change of the supply amount of the wiping liquid, which is operated by the user is applied to the wiping-liquid supply mechanism 834. If the cancel button 708 is selected, the change of the supply amount of the wiping liquid, which is operated by the user is canceled. In this manner, the user operates on the change screen 704 so as to change the supply amount of the wiping liquid.

Next, a method of mounting the cloth sheet 837 in the cloth holder 838 will be described.

Figure 29:
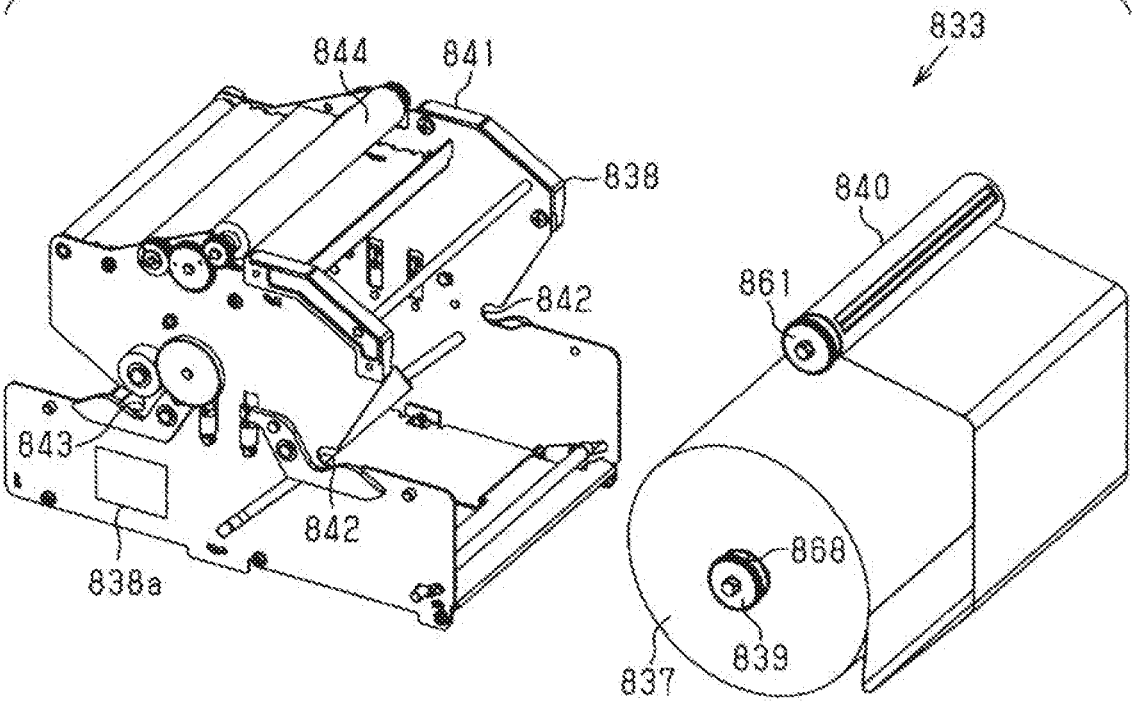
FIG. 29 is a perspective view illustrating a wiping mechanism before a cloth sheet is mounted in a cloth holder.

As illustrated in FIG. 29, when a cloth sheet 837 is mounted in the cloth holder 838, firstly, the feeding shaft 839 is inserted into a central hole 868 of the cloth sheet 837 which has not been used and has a roll shape. The winding shaft 840 is attached to the tip of the cloth sheet 837 which has been slightly fed out from the feeding shaft 839.

Figure 30:
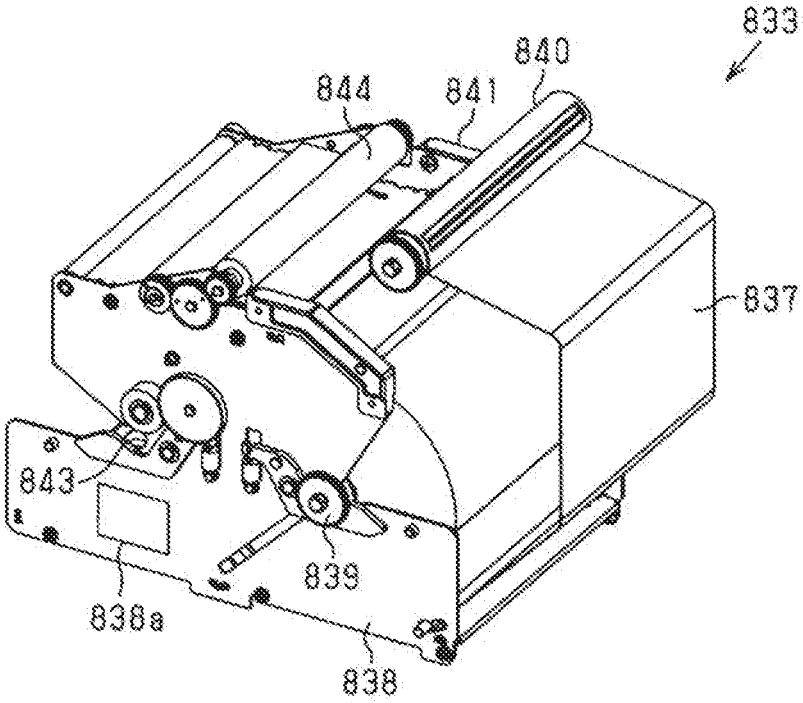
FIG. 30 is a perspective view illustrating the wiping mechanism when the cloth sheet is mounted in the cloth holder.

As illustrated in FIG. 30, both the end portions of the feeding shaft 839 are supported by the pair of feeding bearing portions 842. If both the end portions of the feeding shaft 839 are supported by the pair of feeding bearing portions 842, the not-used roll-like cloth sheet 837 is set on one end side in the cloth holder 838.

Figure 31:
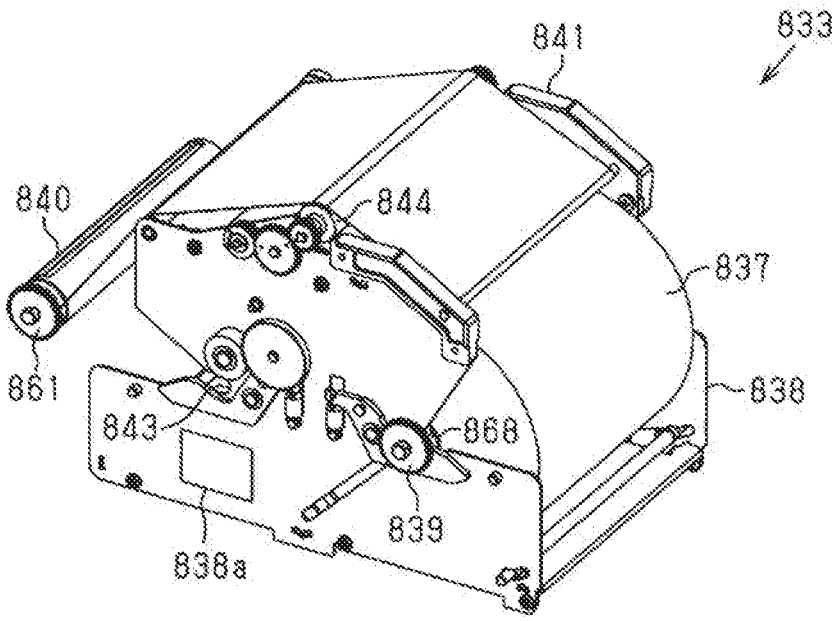
FIG. 31 is a perspective view illustrating the wiping mechanism when the cloth sheet is mounted in the cloth holder.

Then, as illustrated in FIG. 31, the cloth sheet 837 is fed out from the feeding shaft 839. The fed-out cloth sheet 837 is wrapped around the entirety of the wrapping portion 841 including the upper surface of the pressing roller 844, from the top.

As illustrated in FIG. 32, both the end portions of the winding shaft 840 are supported by the pair of winding shaft bearing portion 843 located on a side of the cloth holder 838, which is opposite to a side on which the not-used roll-like cloth sheet 837 has been set. Thus, a work of mounting the cloth sheet 837 into the cloth holder 838 is finished. When the cloth sheet 837 is detached from the cloth holder 838 in which the cloth sheet 837 has been mounted, the above-described work of mounting the cloth sheet 837 into the cloth holder 838 may be performed in a reverse order.

Next, a maintenance operation of performing maintenance of the liquid ejecting apparatus 7 will be described.

Figure 33:
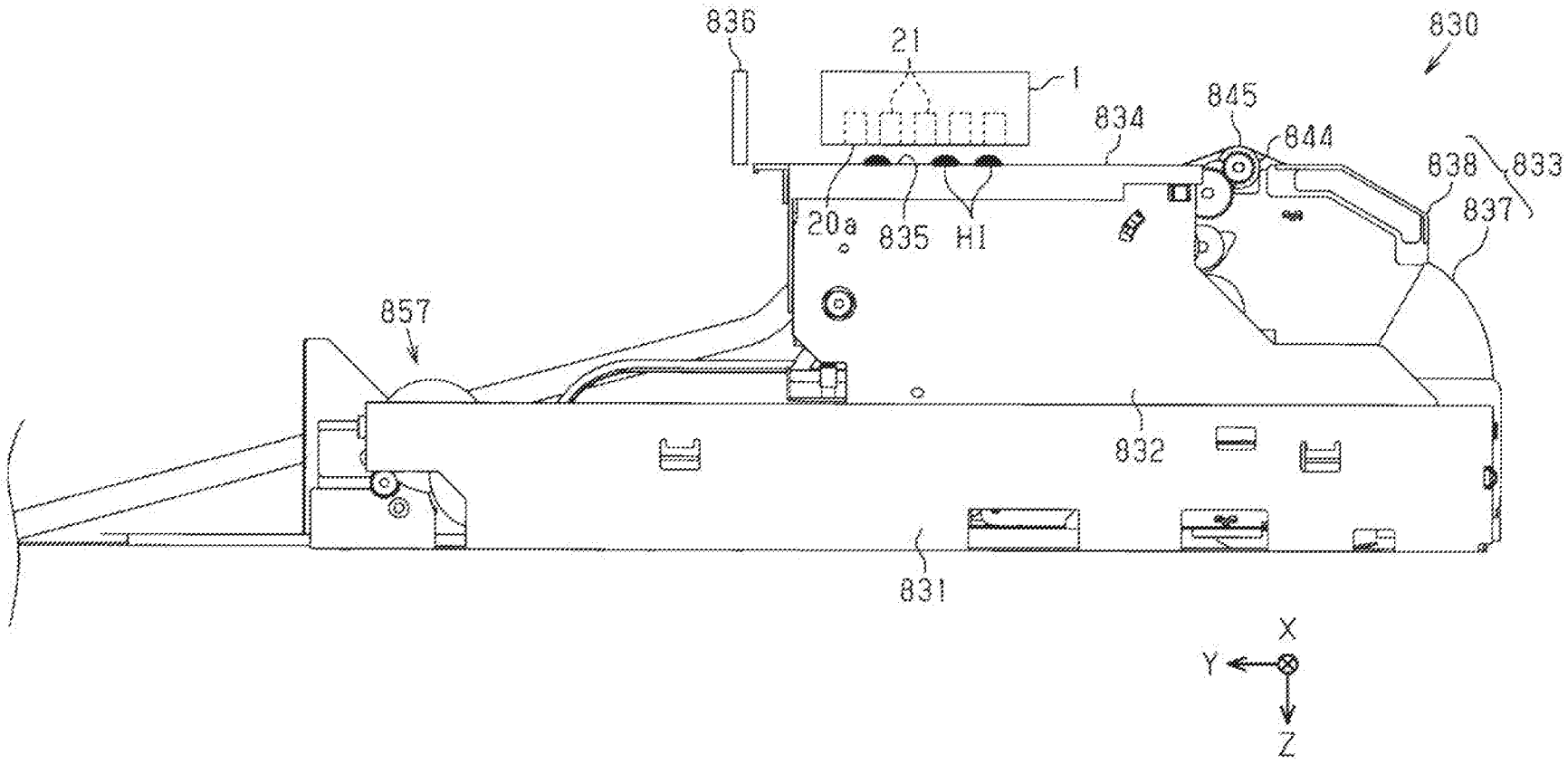
FIG. 33 is a side view schematically illustrating a state when the liquid ejector is moved into a service area.

As illustrated in FIG. 33, when the maintenance of the liquid ejector 1 is performed, firstly, the base portion 832 is caused to be on standby at the standby position. The liquid ejector 1 is moved into the service area SA in a manner that the carriage 723 is moved by driving the carriage motor 748 constituting a moving mechanism, in a state where the base portion 832 is on standby at the standby position. That is, the liquid ejector 1 is moved to a position allowed to face the waste-liquid receiving portion 835 and the wiping mechanism 833. If flushing of ejecting a liquid as a waste liquid HI, from the nozzle 21 of the liquid ejector 1 to the waste-liquid receiving portion 835 regardless of recording processing, in a state where the liquid ejector 1 faces the waste-liquid receiving portion 835, the meniscus of the nozzle 21 is trimmed.

If flushing is performed, a portion of the received waste liquid HI is left on the net member 848 of the waste-liquid receiving portion 835. The waste liquid HI left on the net member 848 remains on the net member 848 by being dried, being thickened, or being solidified and deposited.

Figure 34:
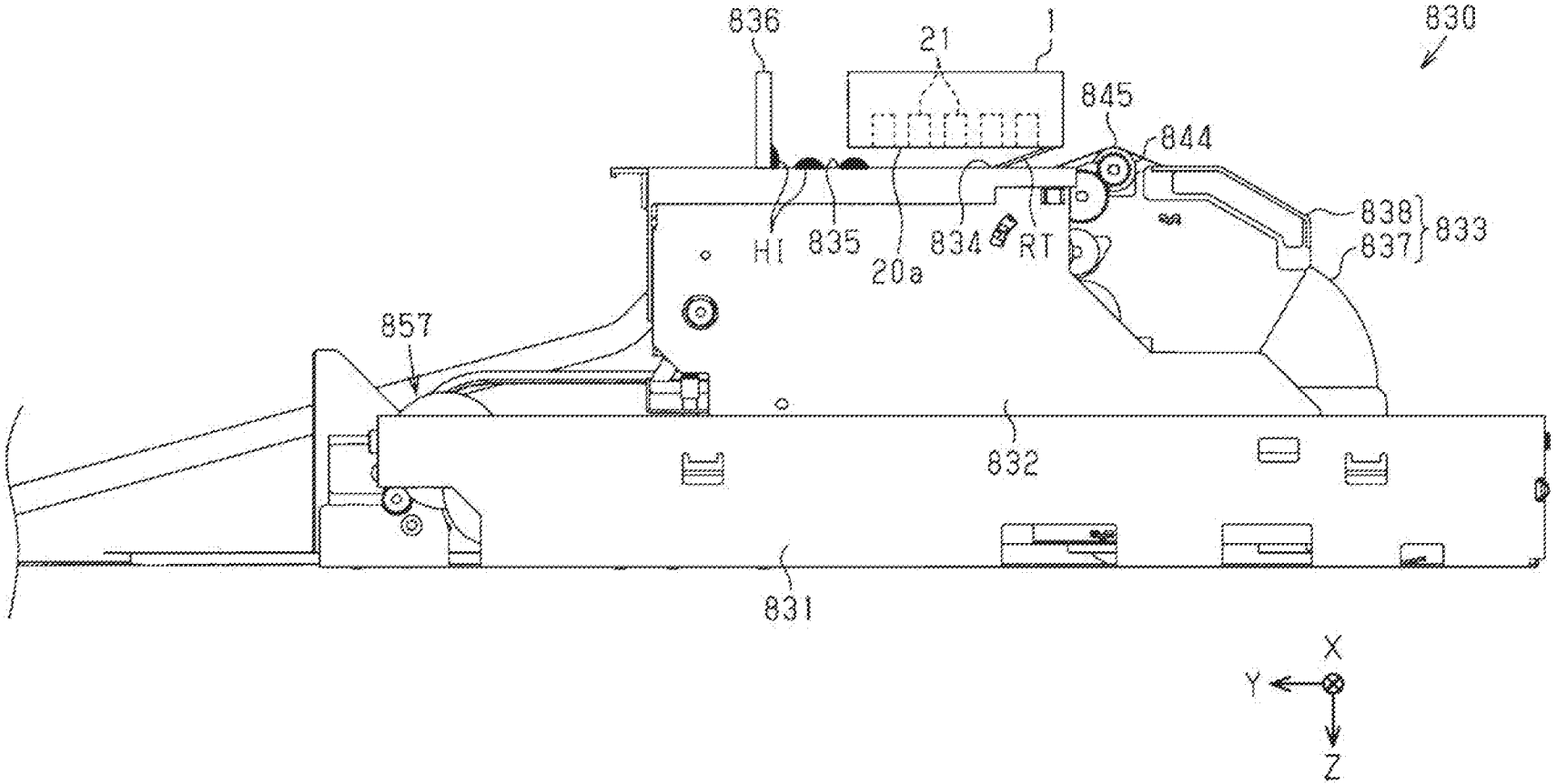
FIG. 34 is a side view schematically illustrating a state when a wiping-liquid supply mechanism supplies a wiping liquid to the liquid ejector.

As illustrated in FIG. 34, if the base portion 832 is moved in the transport direction Y by the relatively-moving mechanism 857, the waste liquid HI on the net member 848 starts collection by being scraped by the collection portion 836. At this time, a fluid RT is obliquely ejected from the wiping-liquid supply mechanism 834 to the end portion of the nozzle surface 20*a* of the liquid ejector 1 on an upstream in the transport direction Y. In this manner, ejection of the fluid to the liquid ejector 1 is started. At this time, the wiping-liquid supply mechanism 834 may eject the fluid RT only onto the nozzle surface 20*a* or may also eject the fluid RT to the cover head 400.

The wiping-liquid supply mechanism 834 ejects the fluid RT obliquely upward so as to be directed toward an opposite side of the transport direction Y being a direction of moving the base portion 832. In the embodiment, the fluid RT is configured with only the wiping liquid. However, the fluid RT may be configured with a fluid mixture obtained by mixing the wiping liquid and a gas such as an air. The fluid RT which is ejected and dropped to the liquid ejector 1 flows into the path 852 from the spout opening portion 854. Then, the fluid RT is discharged and collected into the waste-liquid collection container through the receiving recess portion 849 and the waste liquid tube 850, along with the waste liquid HI.

Figure 35:
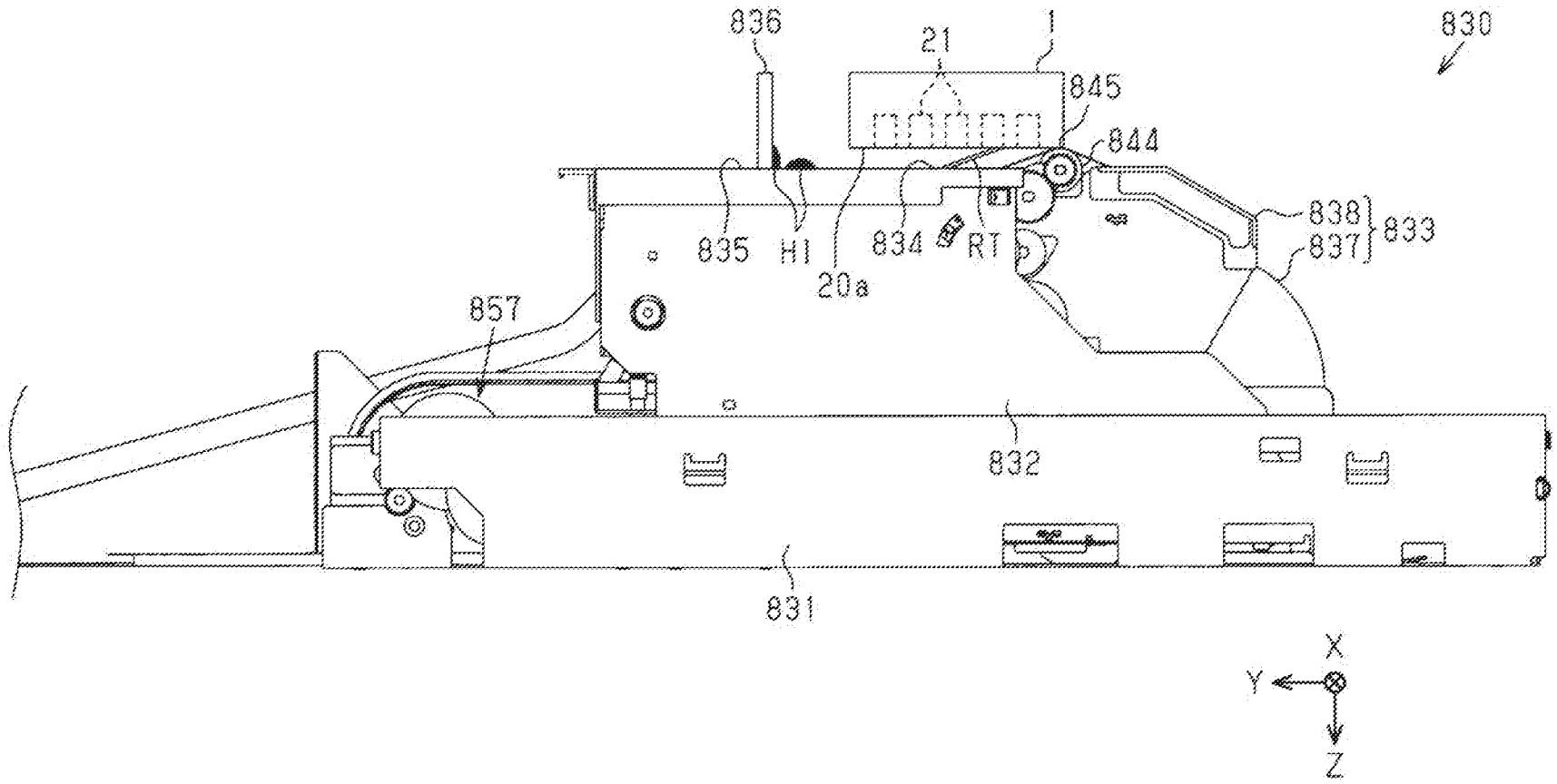
FIG. 35 is a side view schematically illustrating a state where the wiping mechanism wipes the liquid ejector.

As illustrated in FIG. 35, if the base portion 832 is moved in the transport direction Y by the relatively-moving mechanism 857, the waste liquid HI on the net member 848 is collected by being further scraped by the collection portion 836. At this time, the position of the fluid RT ejected onto the nozzle surface 20*a* of the liquid ejector 1 moves in the transport direction Y by moving the base portion 832 in the transport direction Y. At this time, the wiping member 845 is brought into contact with the end portion of the nozzle surface 20*a* of the liquid ejector 1 on the upstream in the transport direction Y. The wiping member 845 comes into contact with the nozzle surface 20*a*, and thus absorbs the fluid RT ejected onto the nozzle surface 20*a*. That is, the wiping member 845 is in a state of absorbing the wiping liquid. In this case, the wiping-liquid supply mechanism 834 indirectly supplies the wiping liquid to the wiping member 845. Wet-wiping of the wiping mechanism 833 on the nozzle surface 20*a* of the liquid ejector 1 is started with moving the base portion 832 in the transport direction Y.

Figure 36:
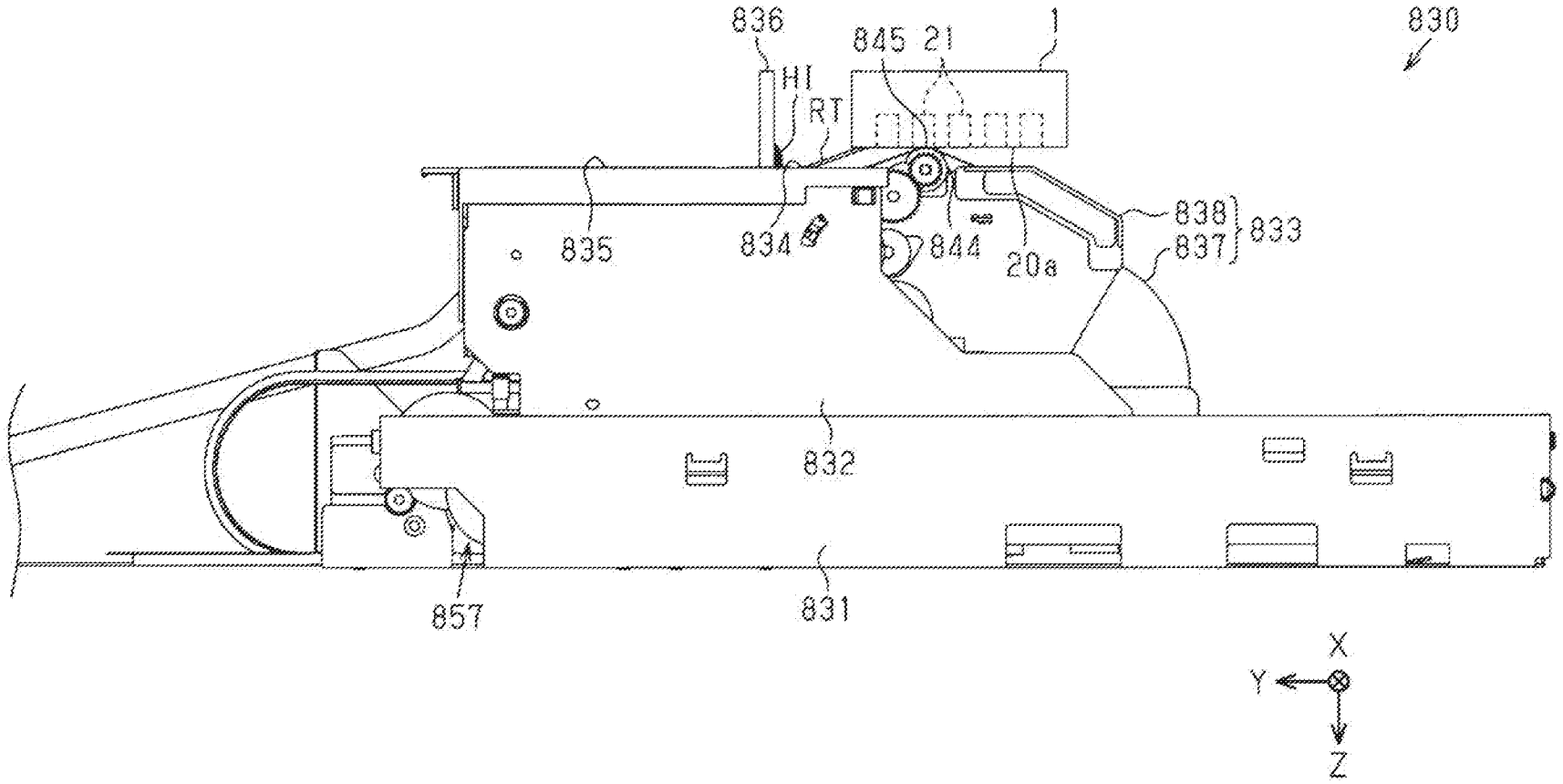
FIG. 36 is a side view schematically illustrating a state in the middle of the wiping mechanism wiping the liquid ejector.

As illustrated in FIG. 36, if the base portion 832 is moved in the transport direction Y by the relatively-moving mechanism 857, the entirety of the waste liquid HI on the net member 848 is collected by being further scraped by the collection portion 836. Therefore, contact of deposits of the waste liquid HI on the net member 848 with the liquid ejector 1 is suppressed. The waste liquid HI collected by the collection portion 836 adheres to the collection portion 836. At this time, the position of the fluid RT ejected onto the nozzle surface 20*a* of the liquid ejector 1 with moving the base portion 832 in the transport direction Y moves to the end portion of the nozzle surface 20*a* of the liquid ejector 1 on the downstream in the transport direction Y. Thus, ejection of the fluid to the entirety of the nozzle surface 20*a* of the liquid ejector 1 is ended. That is, the ejection of the fluid RT from the wiping-liquid supply mechanism 834 is stopped.

The wiping member 845 in contact with the nozzle surface 20*a* of the liquid ejector 1 wipes the nozzle surface 20*a* in a manner that the wiping member 845 moves with respect to the liquid ejector 1 of the wiping mechanism 833 with moving the base portion 832, and thereby rubs the nozzle surface 20*a* of the liquid ejector 1 in the transport direction Y. That is, as the maintenance operation of the liquid ejector 1, the fluid is ejected onto the nozzle surface 20*a* of the liquid ejector 1, and then the nozzle surface 20*a* of the liquid ejector 1 is wiped by the wiping member 845. As the maintenance operation of the liquid ejector 1, the fluid may not be ejected onto the nozzle surface 20*a* of the liquid ejector 1. Instead, the fluid may be ejected to the wiping member 845, and then the nozzle surface 20*a* of the liquid ejector 1 is wiped by the wiping member 845. In this case, the wiping-liquid supply mechanism 834 directly supplies the wiping liquid to the wiping member 845.

Next, an ejection of the fluid RT onto the nozzle surface 20*a* of the liquid ejector 1 by the wiping-liquid supply mechanism 834 will be described.

Figure 40:
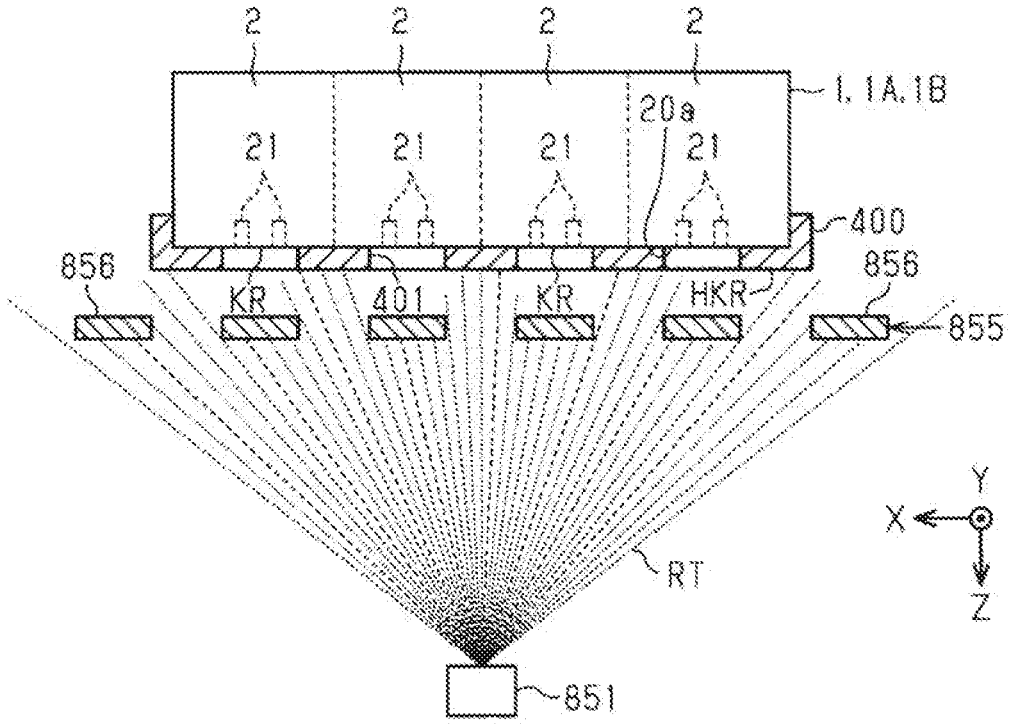
FIG. 40 is a sectional view schematically illustrating a state where a portion of a fluid ejected from an ejection port to the liquid ejector is blocked by a blocking mechanism.

As illustrated in FIG. 40, when the wiping-liquid supply mechanism 834 supplies the wiping liquid to the liquid ejector 1, the fluid RT is ejected from the ejection port 851 to the nozzle surface 20*a* of the liquid ejector 1, in a state of being spread in a fan shape in the scanning direction X. At this time, an occurrence of a situation in which the meniscus is broken by entering the fluid RT into the nozzle 21 is suppressed. Thus, the fluid RT may be ejected to an area in which the nozzle 21 is not formed in the nozzle surface 20*a*. In a case of including the cover head 400, the fluid RT may be ejected to the cover head 400.

In a case of this embodiment, the fluid RT directed toward the opening area KR of the liquid ejector 1 is blocked by the plurality of blocking plates 856 of the blocking mechanism 855. Therefore, the fluid RT ejected from the ejection port 851 is directed to the non-opening area HKR.

The wiping-liquid supply mechanism 834 performs fluid ejection of actively ejecting the fluid RT to the non-opening area HKR, as the maintenance operation of performing maintenance of the liquid ejector 1. In this case, the fluid RT colliding in the non-opening area HKR is scattered, and a portion of the fluid RT reaches the opening area KR. However, a situation in which the fluid RT ejected from the ejection port 851 directly reaches the opening area KR hardly occurs. Therefore, the occurrence of a situation in which the meniscus is broken by entering the fluid RT into the nozzle 21 is suppressed.

Figure 37:
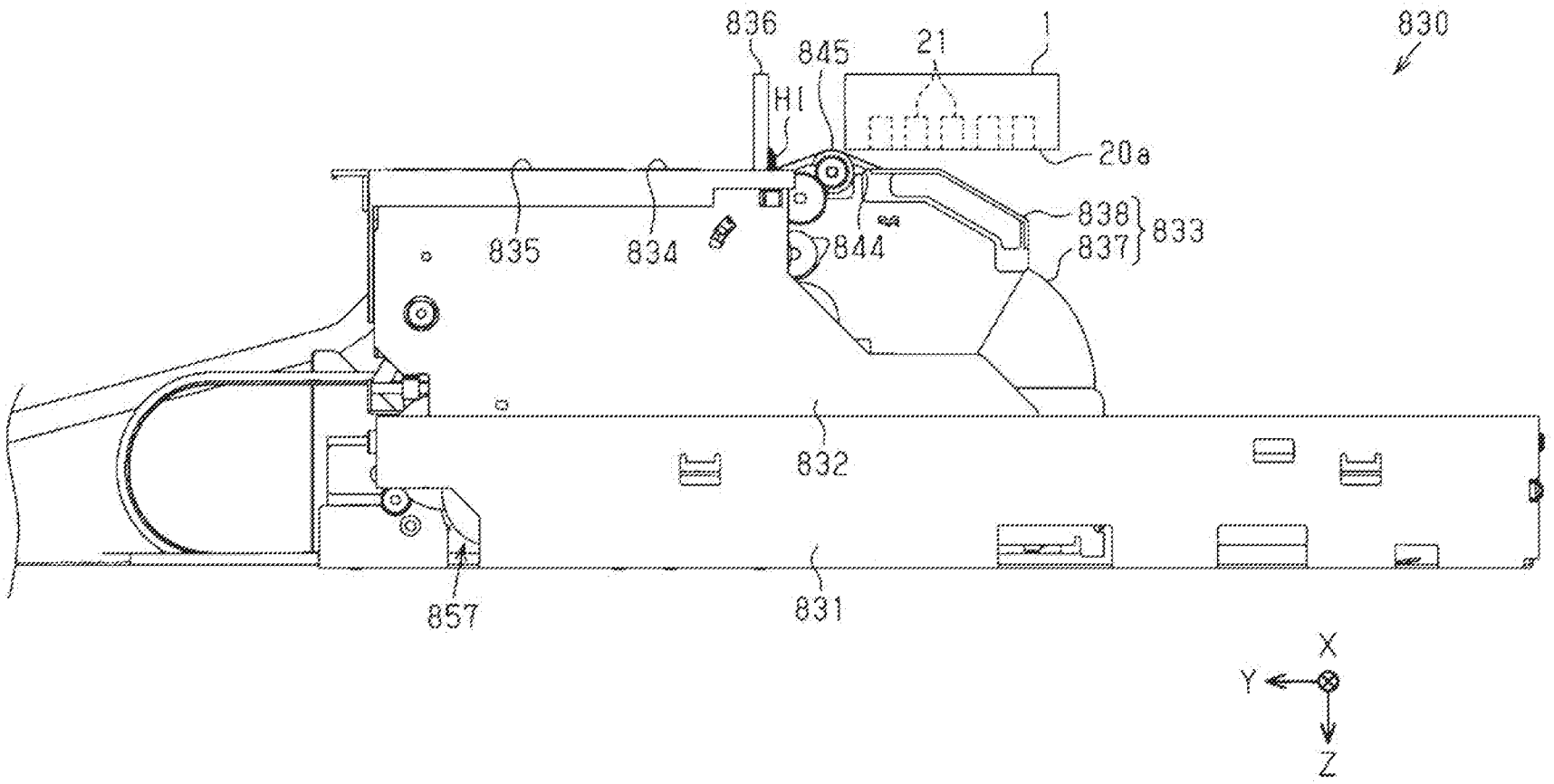
FIG. 37 is a side view schematically illustrating a state when the wiping mechanism ends wiping of the liquid ejector.

As illustrated in FIG. 37, if the base portion 832 is moved in the transport direction Y by the relatively-moving mechanism 857, the wiping member 845 in contact with the nozzle surface 20*a* of the liquid ejector 1 passes by the liquid ejector 1. Thus, wiping of the entirety of the nozzle surface 20*a* of the liquid ejector 1 by the wiping member 845 is ended, and the maintenance of the liquid ejector 1 is finished.

Next, wiping of the nozzle surface 20*a* of the liquid ejector 1 by the wiping member 845 will be described.

Figure 41:
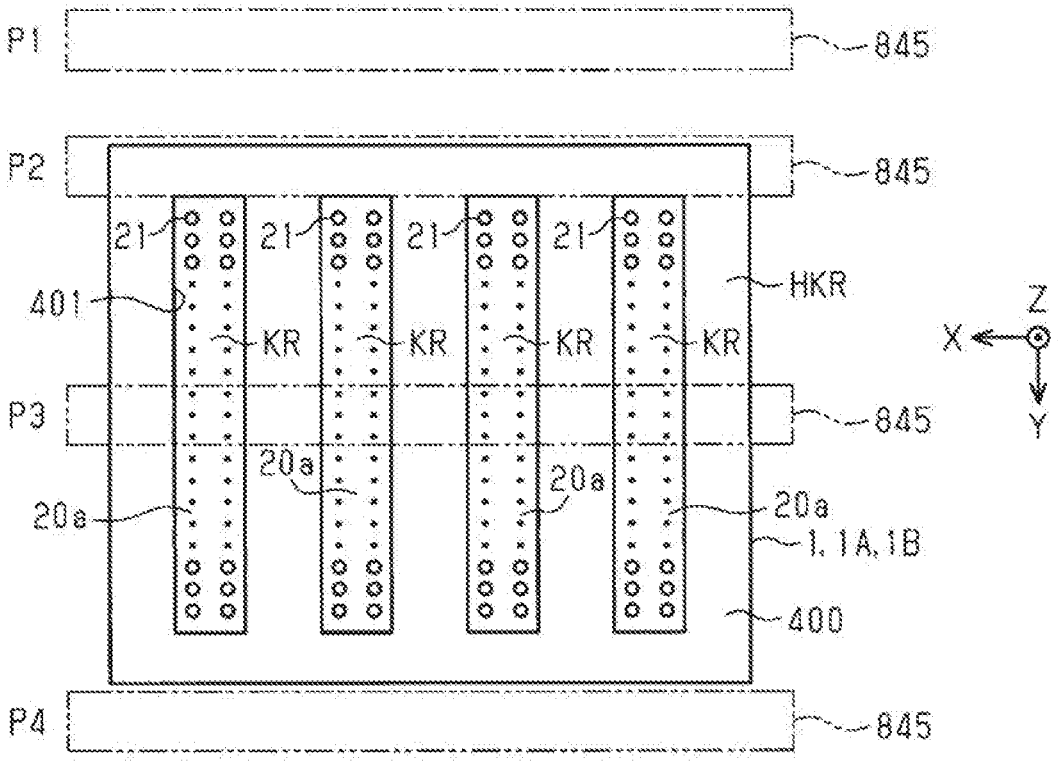
FIG. 41 is a bottom view schematically illustrating a state when the wiping member wipes the liquid ejector.

As illustrated in FIG. 41, as described above, the fluid ejection is performed as the maintenance operation. Then, the nozzle surface 20*a* of the liquid ejector 1 is wiped by moving the wiping member 845 to a P1 position, a P2 position, a P3 position, and a P4 position in the transport direction Y in this order. Thus, wiping, that is, wet-wiping is performed on the nozzle surface 20*a* of the liquid ejector 1 by the wiping member 845 in a state of being wet with the fluid RT.

When the nozzle surface 20*a* of the liquid ejector 1 is wiped, the wiping member 845 is firstly brought into contact with the nozzle surface 20*a* of the liquid ejector 1 at the P2 position. That is, the wiping member 845 firstly comes into contact with the end portion (being the non-opening area HKR) of the nozzle surface 20*a* of the liquid ejector 1 on the upstream in the transport direction Y. That is, the wiping member 845 firstly wipes the non-opening area HKR, and thus wipes the opening area KR in a state of absorbing the fluid RT adhering to the non-opening area HKR. Thus, the wiping member 845 wipes the opening area KR in a state of being wet with the fluid RT. Therefore, when the wiping member 845 wipes the opening area KR, the damage on the opening area KR by the wiping member 845 is reduced.

Figure 38:
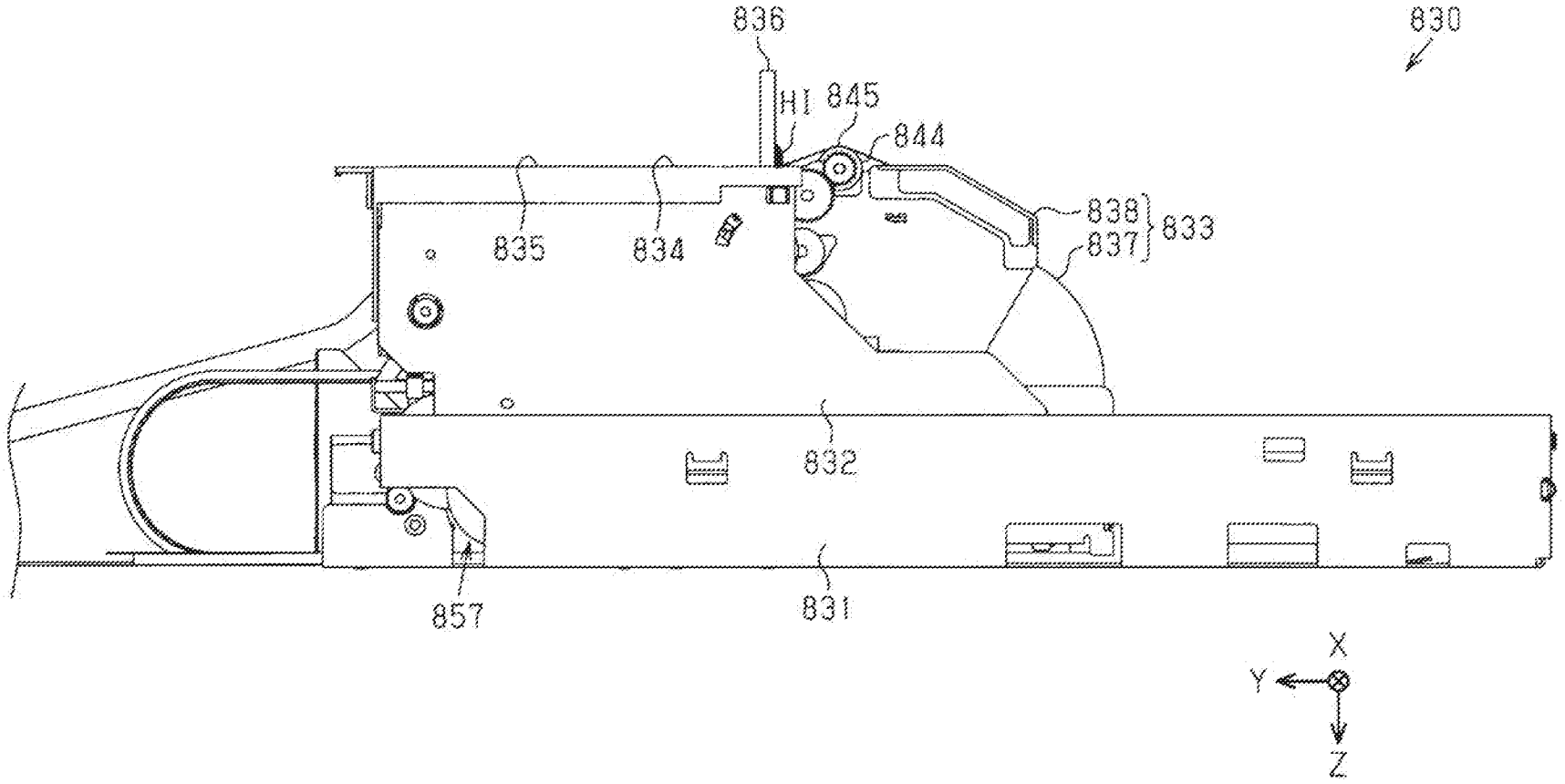
FIG. 38 is a side view schematically illustrating a state when the liquid ejector is withdrawn from the service area.

As illustrated in FIG. 38, the carriage 723 is moved by driving the carriage motor 748 constituting the moving mechanism, and the liquid ejector 1 is withdrawn from the position facing the service area SA which is an area into which the base portion 832 moves.

Figure 39:
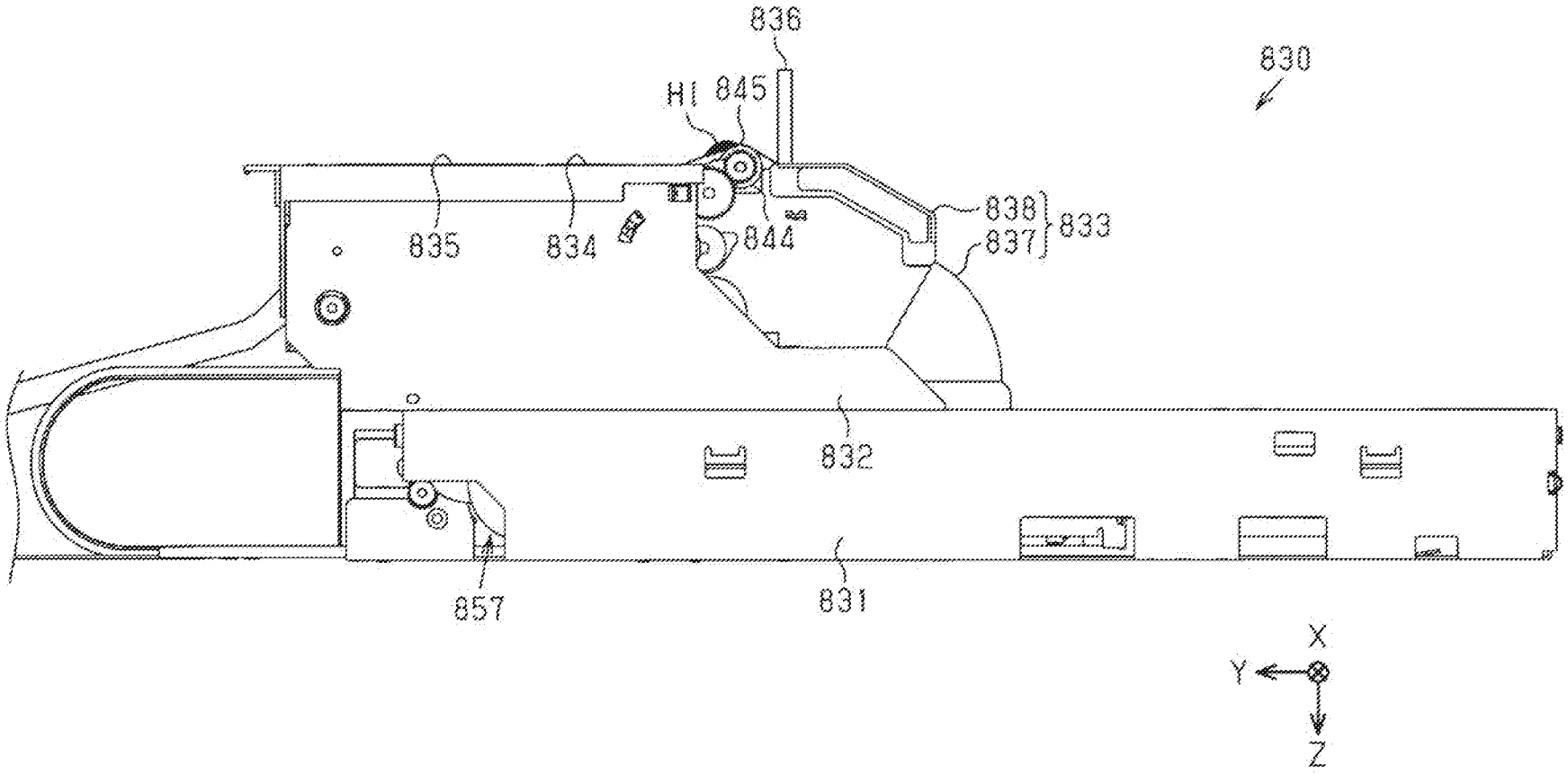
FIG. 39 is a side view schematically illustrating a state when the wiping mechanism sweeps a collection portion.

As illustrated in FIG. 39, if the base portion 832 is moved in the transport direction Y by the relatively-moving mechanism 857, the wiping member 845 of the wiping mechanism 833 and a used portion of the cloth sheet 837 (which is a portion on the downstream of the wiping member 845 in the transport direction Y) pass by the collection portion 836 while being in contact with the collection portion 836.

The pressing roller 844 is temporarily pushed down with the cloth sheet 837 by the collection portion 836, against a pushing force of the pushing member (not illustrated). After passing by the collection portion 836, the pressing roller 844 returns to the original position from the position after being pushed, by the pushing force of the pushing member. If the pressing roller returns to the original position, the waste liquid HI which has adhered and been collected to the collection portion 836 is swept by the cloth sheet 837, and then the waste liquid HI is removed from the collection portion 836. Thus, the wiping mechanism 833 wipes the nozzle surface 20*a* of the liquid ejector 1, and then sweeps the waste liquid HI collected by the collection portion 836.

The used wiping member 845 which is a portion of the cloth sheet 837, which is wrapped around the pressing roller 844 in a manner of winding the cloth sheet 837 by rotating the winding shaft 840 and by a predetermined amount is moved toward the winding shaft 840. Thus, the wiping member 845 is configured with the not-used cloth sheet 837. At this time, the cloth sheet 837 is wound by 10 mm, for example. Then, the base portion 832 is moved in the opposite direction of the transport direction Y by the relatively-moving mechanism 857, and thus the base portion 832 returns to the standby position illustrated in FIG. 33.

According to the second embodiment, it is possible to obtain effects as follows.

(1) The liquid ejecting apparatus 7 is configured to be capable of changing the supply amount of the wiping liquid when the nozzle surface 20*a* is wiped with the wiping member 845. According to this configuration, it is possible to change the supply amount of the wiping liquid to be supplied to the wiping member 845, and thus to supply the wiping liquid of an appropriate amount depending on an occasion to the wiping member. Accordingly, it is possible to appropriately perform wiping.

(2) The liquid ejecting apparatus 7 may include the controller 810 that changes the supply amount of the wiping liquid when the nozzle surface 20*a* is wiped with the wiping member 845, based on the status of the liquid ejecting apparatus 7. If the liquid ejecting apparatus 7 includes the controller 810, it is possible to supply the wiping liquid of an appropriate amount to the wiping member 845 based on the status of the liquid ejecting apparatus 7.

(3) The controller 810 may change the supply amount of the wiping liquid when the nozzle surface 20*a* is wiped with the wiping member 845, based on the ejection state estimated from the detection result detected by the detector 156. If the controller changes the supply amount of the wiping liquid based on the detection result of the ejection state, it is possible to supply the wiping liquid of an appropriate amount to the wiping member 845 based on the ejection state of the liquid from the nozzle 21.

(4) The controller 810 may change the supply amount of the wiping liquid when the nozzle surface 20*a* is wiped with the wiping member 845, based on the contained amount of the wiping liquid accommodated in the wiping liquid container 871. If the controller changes the supply amount of the wiping liquid based on the contained amount of the wiping liquid, it is possible to supply the wiping liquid of an appropriate amount to the wiping member 845 based on the contained amount of the wiping liquid accommodated in the wiping liquid container 871.

(5) The liquid ejecting apparatus 7 may include the operation portion 701 operated to change the supply amount of the wiping liquid. If the operation portion 701 is provided, it is possible to cause the user to randomly change the supply amount of the wiping liquid with the operation portion 701.

(6) As the maintenance method of the liquid ejecting apparatus 7, the supply amount of the wiping liquid when wet-wiping is performed is changed based on the status of the liquid ejecting apparatus 7. According to this configuration, it is possible to supply the wiping liquid of an appropriate amount to the wiping member 845 based on the status of the liquid ejecting apparatus 7. Accordingly, it is possible to appropriately perform wiping.

(7) As the maintenance method of the liquid ejecting apparatus 7, the supply amount of the wiping liquid when wet-wiping is performed in a case where the liquid is not ejected from the nozzle 21 in recording processing may be set to be smaller than the supply amount of the wiping liquid when wet-wiping is performed in a case where recording processing is not performed. When wet-wiping is performed in recording processing, if the wiping liquid remains on the nozzle surface 20*a*, the liquid may not be properly ejected from the nozzle 21. In a case of the maintenance method, the supply amount of the wiping liquid when wet-wiping is performed in recording processing is set to be smaller than the supply amount of the wiping liquid when wet-wiping is performed in a case where recording processing is not performed. Therefore, the concern that the wiping liquid remains on the nozzle surface 20*a* when wet-wiping is performed in recording processing is reduced. Thus, it is possible to appropriately perform wiping.

(8) As the maintenance method of the liquid ejecting apparatus 7, the supply amount of the wiping liquid when the wiping member 845 wipes the nozzle surface 20*a* may be changed based on the ejection state estimated from the detection result detected by the detector 156, as a maintenance method of the liquid ejecting apparatus 7. If the supply amount of the wiping liquid is changed based on the detection result of the ejection state, it is possible to supply the wiping liquid of an appropriate amount to the wiping member 845 based on the ejection state.

(9) As the maintenance method of the liquid ejecting apparatus 7, regarding the nozzles 21 supposed to be in an abnormal ejection state estimated from the detection result detected by the detector 156 performed after the nozzle surface 20*a* is wiped with the wiping member 845, when the number of nozzles 21 on a wiping end side is greater than the number of nozzles 21 on a wiping start side, at least one of a change of increasing the supply amount of the wiping liquid when the nozzle surface 20*a* is wiped with the wiping member 845 in comparison to that before the detection is performed, and a change of setting the relative movement speed between the liquid ejector 1 and the wiping member 845 to be slower than that before the detection is performed may be performed. When, regarding the nozzles 21 supposed to be in an abnormal ejection state, the number of nozzles 21 on the wiping end side is greater than the number of nozzles 21 on the wiping start side, it may not be possible to sufficiently remove foreign matters on the nozzle surface 20*a* when wiping is performed. Therefore, in such a case, at least one of the change of increasing the supply amount of the wiping liquid and the change of setting the relative movement speed between the liquid ejector 1 and the wiping member 845 to be slow is performed, and thus it is easy to remove the foreign matters on the nozzle surface 20*a* by wiping. That is, in a case of the maintenance method, it is possible to appropriately perform wiping.

(10) As the maintenance method of the liquid ejecting apparatus 7, when the contained amount of the wiping liquid accommodated in the wiping liquid container 871 is smaller than a setting value, the supply amount of the wiping liquid when wet-wiping is performed may be set to smaller than the supply amount of the wiping liquid when the wet-wiping is performed in a case where the contained amount of the wiping liquid accommodated in the wiping liquid container 871 is equal to or greater than the setting value. If setting is performed in this manner, the supply amount of the wiping liquid is set to be small when the contained amount of the wiping liquid is smaller than the setting value. Thus, consumption of the wiping liquid is suppressed when the contained amount of the wiping liquid is small. Thus, it is possible to increase the number of times of performing wet-wiping.

(11) As the maintenance method of the liquid ejecting apparatus 7, non-wet wiping in which the wiping member 845 wipes the nozzle surface 20*a* without a supply of the wiping liquid may be performed when the contained amount of the wiping liquid accommodated in the wiping liquid container 871 is smaller than a second setting value which is smaller than the setting value. In addition, the relative movement speed between the liquid ejector 1 and the wiping member 845 in a non-wet wiping operation may be set to be slower than the relative movement speed between the liquid ejector 1 and the wiping member 845 in a wet-wiping operation which is performed when the contained amount of the wiping liquid is equal to or greater than the setting value. In a case of non-wet wiping, since the wiping liquid is not supplied to the wiping member 845, removal of the foreign matters on the nozzle surface 20*a* has difficulty in spite of wiping. Therefore, in the non-wet wiping operation, the relative movement speed between the liquid ejector 1 and the wiping member 845 is set to be slower than that in the wet-wiping operation, and thus it is easy to remove the foreign matters on the nozzle surface 20*a* by wiping. In a case of the maintenance method, it is possible to appropriately perform wiping.

The first embodiment and the second embodiment can be changed as follows and be implemented. The first embodiment, the second embodiment, and modification examples as follows can be implemented in combination with each other in a range without technical contradictions.

When wet-wiping is performed, the wiping-liquid supply mechanism 834 may eject the wiping liquid to the liquid ejector 1 or may eject the wiping liquid to the wiping member 845. The wiping-liquid supply mechanism 834 may directly supply the wiping liquid to the wiping member 845 or may indirectly supply the wiping liquid to the wiping member 845.

The wiping-liquid supply mechanism 834 is not limited to the configuration of ejecting the wiping liquid and may have a configuration of supplying the wiping liquid to the wiping member 845 by dropping the wiping liquid. The wiping liquid may be indirectly supplied to the wiping member 845 in a manner that the wiping liquid is dropped to an area on a side on which the cloth sheet 837 is fed out rather than an area for the wiping member 845. In addition, the cloth sheet 837 may be wound such that the area in which the wiping liquid is dropped becomes the area for the wiping member 845.

When suction cleaning is performed in the standby state, wet-wiping may not be performed after suction cleaning. If suction cleaning is performed, a large amount of the liquid discharged from the nozzle 21 adhere to the nozzle surface 20*a*. Therefore, for example, non-wet wiping may be performed after suction cleaning, so as to remove the liquid adhering to the nozzle surface 20*a*.

After suction cleaning, the lower surface of the liquid ejector 1 may be wiped with a rubber wiper. The rubber wiper is formed of a material such as rubber, which has non-absorptivity. Therefore, it is possible to effectively remove the liquid adhering to the lower surface of the liquid ejector 1 by wiping with the rubber wiper. When wiping is performed with the rubber wiper, the rubber wiper may not come into contact with the nozzle surface 20*a*. In this case, the rubber wiper comes into contact with the cover head 400. The rubber wiper removes the liquid adhering to the cover head 400 by wiping.

After the nozzle surface 20*a* is wiped with the rubber wiper, wet-wiping may be performed. In this case, it is possible to remove the liquid remaining in the liquid ejector 1 by the wiping member 845, after most of the liquid adhering to the liquid ejector 1 is removed by the rubber wiper. That is, it is possible to effectively remove the contamination on the nozzle surface 20*a*. Even when pressurization cleaning of forcibly discharging the liquid from the nozzle 21 by pressing the inside of the liquid ejector 1 is performed instead of suction cleaning, the above descriptions are similarly applied.

After wet-wiping is performed in the standby state, non-wet wiping may be performed. In this case, it is possible to remove the wiping liquid adhering to the nozzle surface 20*a* by wet-wiping. In this case, wet-wiping may be performed when the casing 759 moves forward. The area of the cloth sheet 837, to which the wiping liquid is not supplied by winding the cloth sheet 837 may be set for the wiping member 845. In addition, non-wet wiping may be performed when the casing 759 moves backward.

When it is estimated that an abnormal nozzle occurs, by nozzle examination, wet-wiping may be performed in a state where the supply amount of the wiping liquid is maintained, or the supply amount of the wiping liquid is set to be large, even in a case where the contained amount of the wiping liquid accommodated in the wiping liquid container 871 is smaller than the setting value.

The supply amount of the wiping liquid may be changed by an operation from the computer 160 being an external device.

The wiping mechanism 833 and the wiping-liquid supply mechanism 834 are not limited to the configuration in which the wiping mechanism 833 and the wiping-liquid supply mechanism 834 are integrated with each other as the maintenance unit 830, and may be provided to be independent from each other.

Figure 42:
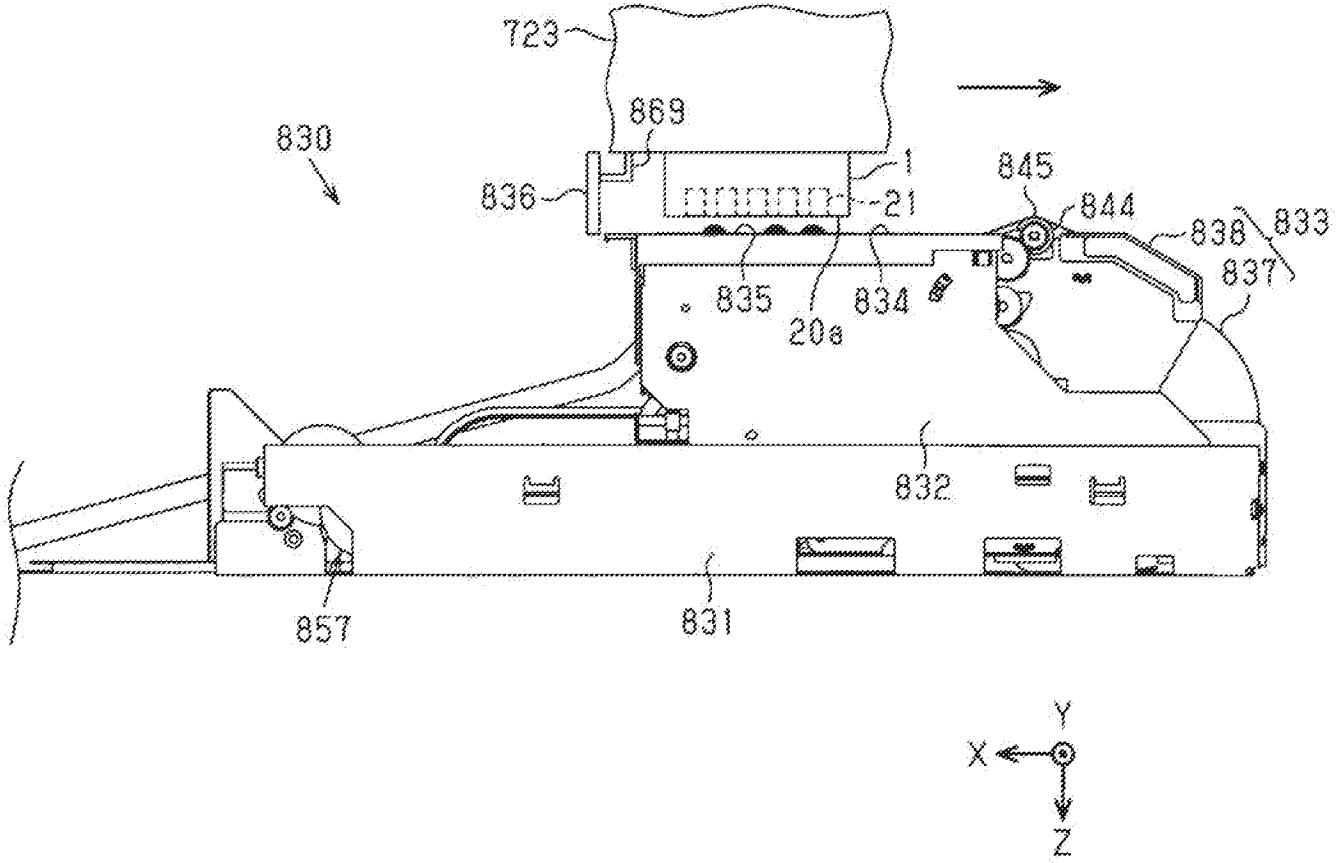
FIG. 42 is a side view schematically illustrating the main components of a liquid ejecting apparatus in a modification example.

As illustrated in FIG. 42, the collection portion 836 may be attached to the carriage 723 with an arm 869. In this modification example, the carriage 723 holds the liquid ejector 1 and the collection portion 836. In this modification example, an orientation of the maintenance unit 830 may be changed by 90°, and the sill portion 831 may be disposed to extend in the scanning direction X. When maintenance of the liquid ejector 1 is performed, the carriage 723 is moved in the scanning direction X with respect to the wiping mechanism 833 and the waste-liquid receiving portion 835 by driving the carriage motor 748. Therefore, in this modification example, the carriage motor 748 constitutes the relatively-moving mechanism. According to such a configuration, the liquid ejector 1 and the collection portion 836 along with the carriage 723 can be moved with respect to the wiping mechanism 833 and the waste-liquid receiving portion 835 by driving the carriage motor 748. When the carriage 723 moves in a case where maintenance of the liquid ejector 1 is performed, the base portion 832 may be moved in an opposite direction of the carriage 723 in the scanning direction X.

The collection portion 836 may be configured to be capable of performing displacement in the gravity direction Z being a direction in which the liquid ejector 1 ejects the liquid. According to such a configuration, it is possible to adjust a contact amount of the collection portion 836 with the waste-liquid receiving portion 835 and a contact amount of the collection portion 836 with the wiping mechanism 833, by causing the collection portion 836 to perform displacement.

The blocking mechanism 855 may be configured to be capable of moving between a position of blocking the ejection of the fluid RT to the opening area KR of the liquid ejector 1 and a position of blocking the ejection of the fluid RT to the non-opening area HKR of the liquid ejector 1. The blocking mechanism 855 may be configured to be capable of moving to a position allowing ejection of the fluid RT to the opening area KR and the non-opening area HKR of the liquid ejector 1. When the liquid ejector 1 moves, the position of the above-described blocking mechanism 855 may be changed by moving the liquid ejector 1.

The size of a gap between the blocking plates 856 in the blocking mechanism 855, that is, the size of the blocking plate 856 may be changed depending on the type of liquid ejected from the nozzle row NL provided in the opening area KR of the corresponding liquid ejector 1. According to such a configuration, it is possible to adjust an amount of the fluid RT adhering to the opening area KR, in accordance with the solidification degree of the liquid.

When the liquid ejector 1 moves in the scanning direction X, the blocking mechanism 855 may be configured with a plate member having one opening portion having a slit shape. In this case, the fluid RT may be ejected by moving the liquid ejector 1, in a state where the non-opening area HKR of the corresponding liquid ejector 1 matches with the position of the opening portion of the plate member.

The blocking mechanism 855 may be configured to be capable of performing displacement so as to allow a change of a distance from the liquid ejector 1. According to such a configuration, it is possible to change a range of blocking the fluid RT ejected from the ejection port 851, by changing a distance between the blocking mechanism 855 and the liquid ejector 1.

The wiping-liquid supply mechanism 834 may change an angle θ of the fluid RT to the opening area KR in the ejection direction, in a range of $0° < \theta < 90°$.

In the liquid ejector 1, liquid repellency of the opening area KR may be substantially identical to liquid repellency of the non-opening area HKR.

In the maintenance unit 830, considering exchangeability of the cloth sheet 837, the wiping mechanism 833, the wiping-liquid supply mechanism 834, and the waste-liquid receiving portion 835 may be disposed from an access side as the front surface side of the apparatus body 11*a*, in this order.

The collection portion 836 may be fixed to the sill portion 831 of the maintenance unit 830 with a portal type attachment member, for example.

A lifting mechanism that lifts the collection portion 836 up and down in the gravity direction Z may be provided in the liquid ejecting apparatus 7. In this case, regarding the collection portion 836, the height when wiping is performed by the wiping mechanism 833 may be set to be higher than the height when the waste liquid HI on the net member 848 of the waste-liquid receiving portion 835 is scraped.

A lifting mechanism that lifts the waste-liquid receiving portion 835 up and down in the gravity direction Z may be provided in the maintenance unit 830. In this case, regarding the waste-liquid receiving portion 835, the height when the waste liquid HI on the net member 848 is scraped by the collection portion 836 may be set to be higher than the height when the liquid ejected by flushing is received.

In the wiping mechanism 833, regarding the cloth sheet 837, a position at which the collection portion 836 is swept may be set to be different from a position at which the liquid ejector 1 is wiped. In this case, an operation of winding the cloth sheet 837 by a predetermined amount and by the winding shaft 840 may be performed between a sweeping operation of the collection portion 836 and the wiping operation of the liquid ejector 1. In this modification example, the liquid ejector 1 may be located at the position at which wiping has previously been performed, when the collection portion 836 is swept with the cloth sheet 837.

The liquid repellency of the opening area KR in the liquid ejector 1 may be set to be lower than the liquid repellency of the non-opening area HKR.

The blocking mechanism 855 may be omitted. In this case, the ejection port 851 may be constituted by the supply nozzle 851*a* allowing the fluid RT to be ejected to the non-opening area HKR of the liquid ejector 1.

In the liquid ejecting apparatus 7, it is not necessary that the fluid ejection to the liquid ejector 1 by the wiping-liquid supply mechanism 834 is performed, and then the wiping member 845 firstly sweeps the non-opening area HKR in the liquid ejector 1.

In the liquid ejecting apparatus 7, it is not necessary that, when the wiping mechanism 833 sweeps the collection portion 836, the liquid ejector 1 is withdrawn from the position facing the service area SA.

In the liquid ejecting apparatus 7, it is not necessary that the waste-liquid receiving portion 835 is disposed on the downstream of the wiping mechanism 833 in the wiping direction when the wiping mechanism 833 wipes the liquid ejector 1.

In the liquid ejecting apparatus 7, it is not necessary that the wiping mechanism 833 wipes the liquid ejector 1, and then sweeps the collection portion 836.

Figure 43:
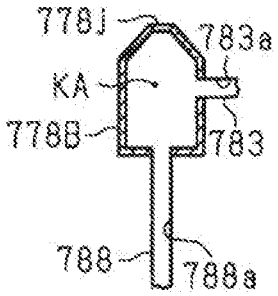
FIG. 43 is a schematic view illustrating a fluid ejection nozzle in the modification example.

As illustrated in FIG. 43, the internally-mixing type fluid ejection nozzle 778B may be used instead of the externally-mixing type fluid ejection nozzle 778. In the fluid ejection nozzle 778B, the mixing portion KA that generates a fluid mixture by mixing the second liquid supplied from the liquid flow path 788*a* and the air supplied from the gas flow path 783*a* is provided. In this case, the fluid mixture generated by the mixing portion KA is ejected from the ejection port 778*j* provided at the upper end being the tip of the fluid ejection nozzle 778B.

Before the fluid mixture is ejected from the fluid ejection nozzle 778 to the liquid ejector 1A and the liquid ejector 1B including the nozzles 21, the second liquid may be ejected to the liquid ejector 1A and the liquid ejector 1B including the nozzles 21. In this case, the second liquid may be ejected from the liquid ejecting nozzle 780 by using the liquid supply pump 793. However, a pump for ejecting the second liquid from the liquid ejecting nozzle 780 may be separately provided at a position in the middle of the liquid supply tube 788. According to such a configuration, the second liquid is ejected to the liquid ejector 1A and the liquid ejector 1B including the nozzles 21, and then the fluid mixture obtained by mixing the air in the second liquid is ejected to the liquid ejector 1A and the liquid ejector 1B including the nozzles 21. Therefore, it is possible to suppress ejection of only the air to the liquid ejector 1A and the liquid ejector 1B including the nozzles 21. Accordingly, it is possible to suppress an occurrence of a situation in which the air ejected to the liquid ejector 1A and the liquid ejector 1B including the nozzles 21 enters from the opening of the nozzle 21 into the back in the liquid ejector 1A and the liquid ejector 1B. In this case, even when ejection of the fluid mixture to the liquid ejector 1A and the liquid ejector 1B including the nozzles 21 is stopped, it is possible to suppress ejection of only the air to the liquid ejector 1A and the liquid ejector 1B including the nozzles 21 by stopping ejection of the second liquid after ejection of the air is stopped.

A pressurization pump for supplying the liquid in the liquid supply source 702 to the reservoir 730 may be provided. In this case, the ink in the pressure generation chamber 12 communicating with the clogged nozzle 21 in a period when the fluid mixture is ejected from the fluid ejection nozzle 778 to the clogged nozzle 21 may be pressurized by the pressurization pump, in a state where the differential pressure valve 731 opens.

Before the fluid mixture is ejected from the fluid ejection nozzle 778 to the liquid ejector 1A and the liquid ejector 1B including the nozzles 21, the second liquid may be ejected to the area in which the nozzles 21 are not provided in the liquid ejector 1A and the liquid ejector 1B. Before the fluid mixture is ejected from the fluid ejection nozzle 778 to the liquid ejector 1A and the liquid ejector 1B including the nozzles 21, the fluid ejection nozzle 778 may eject the second liquid at a position which does not face the liquid ejector 1A and the liquid ejector 1B. Even in such a manner, it is possible to suppress ejection of only the air to the liquid ejector 1A and the liquid ejector 1B including the nozzles 21.

The second liquid may be configured by pure water which does not contain an antiseptic. According to such a configuration, it is possible to suppress an occurrence of a situation in which the ink is affected by the second liquid when the second liquid is mixed with the ink in the nozzle 21.

When the fluid mixture is ejected to the clogged nozzle 21, the actuator 130 corresponding to the clogged nozzle 21 may drive to synchronize with time when the liquid is ejected in recording processing or time of flushing. Even in such a manner, it is possible to suppress entering of the fluid mixture into the clogged nozzle 21.

When the fluid mixture is ejected to the clogged nozzle 21, the actuator 130 corresponding to the nozzle 21 other than the clogged nozzle 21 may drive so as to pressurize the pressure generation chamber 12 corresponding to the nozzle 21 other than the clogged nozzle 21. According to such a configuration, it is possible to suppress entering of the fluid mixture into the nozzle 21 other than the clogged nozzle 21.

The fluid ejecting device 775 may be disposed in the non-recording area RA.

A wiper for wiping the nozzle surface 20*a* of the liquid ejector 1A and the liquid ejector 1B may be separately provided between the fluid ejecting device 775 in the non-recording area LA and the recording area PA. According to such a configuration, it is possible to wipe the nozzle surface 20*a* which is wet with the fluid mixture, by the wiper before the recording portion 720 is moved toward the home position HP across the recording area PA after the fluid mixture is ejected to the liquid ejector 1A and the liquid ejector 1B by the fluid ejecting device 775. Thus, it is possible to suppress dripping of the fluid mixture adhering to the nozzle surface 20*a* during a period in which the recording portion 720 moves in the recording area PA.

An air compressor in facilities such as a factory may be used instead of the air pump 782. In this case, a three-way solenoid valve capable of opening the gas flow path 783*a* to the atmosphere may be provided at a position between the pressure adjustment valve 784 and the air filter 785 in the gas supply tube 783. The gas flow path 783*a* may open to the atmosphere when the fluid ejecting device 775 is not used.

When the controller 810 detects the nozzle 21 in which clogging is not removed even though suction cleaning is performed a predetermined number of times, based on a detection history of clogging, the nozzle 21 in which the clogging is not removed is not temporarily used. Instead, so-called complementary printing of performing recording processing by ejecting the liquid from other normal nozzles 21 may be performed. In this case, the clogging may be removed by washing the nozzle 21 in which clogging has not been removed even though suction cleaning has been performed the predetermined number of times, by the fluid ejecting device 775 after complementary printing.

Regarding the nozzle 21 for ejecting a liquid of a type having a use frequency which is very low, clogging may be removed by washing of the fluid ejecting device 775 if it is time to use the nozzle 21, without performing common maintenance such as suction cleaning, flushing, and wiping. According to such a configuration, it is possible to reduce a consumed amount of the liquid of the type having a use frequency which is very low, by suction cleaning and flushing. Therefore, it is possible to save the liquid.

It is not necessary that the pressure generation chamber 12 communicating with the clogged nozzle 21 is pressurized in the process of ejecting the fluid mixture from the fluid ejection nozzle 778 to the clogged nozzle 21.

It is not necessary that a product of the mass of a droplet of the washing liquid, which is smaller than the opening of the nozzle 21 and the square of the flying velocity at a position of the droplet in the opening of the nozzle 21 is greater than a product of the mass of the liquid ejected from the opening of the nozzle 21 and the square of the flying velocity of the liquid.

The liquid ejected by the liquid ejector 1 is not limited to the ink and may be, for example, a liquid in which particles of a functional material are dispersed or mixed in the liquid. For example, recording may be performed by ejecting a liquid in which a material such as an electrode material or a coloring material, which is used for manufacturing a liquid crystal display, an electroluminescence display, and a surface emitting display, is dispersed or dissolved.

The recording medium ST is not limited to paper and may be a plastic film, a thin plate material, and the like. In addition, a cloth used for a textile printing device or the like may be provided.

The cloth sheet 837 constituting the wiping member 845 may be impregnated with an impregnation liquid in advance.

The impregnation liquid with which the cloth sheet 837 is impregnated will be described below in detail.

The impregnation liquid is included in the wiping member 845 when wiping is performed. Since the impregnation liquid is included, it is easy to move pigment particles from the surface of an absorbent member as an example of the cloth sheet 837 constituting the wiping member 845, into the inside thereof. In addition, remaining of the pigment particles on the surface of the absorbent member has difficulty. Preferably, the impregnation liquid contains a penetrant or a moisturizer. Thus, it is easy to absorb the pigment particles in the absorbent member. The impregnation liquid is not particularly limited so long as inorganic pigment particles can be moved from the surface of the absorbent member into the inside thereof in the impregnation liquid.

The surface tension of the impregnation liquid is equal to or less than 45 mN/m, and is preferably equal to or less than 35 mN/m. If the surface tension is low, permeability of the inorganic pigment into the absorbent member is improved, and a scraping property is improved. As a method of measuring the surface tension, a method of performing measurement at a liquid temperature of 25° C. with the Wilhelmy method and a surface tension meter which is generally used, for example, the surface tension meter CBVP-Z manufactured by Kyowa Interface Science, Inc can be exemplified.

Preferably, the content of the impregnation liquid is from 10 mass % to 30 mass % with respect to 100 mass % of the absorbent member. Since the content thereof is equal to or more than 10 mass %, it is easy to permeate the inorganic pigment ink into the absorbent member, and it is possible to more suppress damage of the liquid repellent film. Since the content thereof is equal to or less than 30 mass %, it is possible to more suppress remaining of the impregnation liquid on the nozzle surface 20*a*. In addition, it is possible to suppress an occurrence of dot missing by entering bubbles and the impregnation liquid into the nozzle 21 or an occurrence of dot missing by entering the impregnation liquid itself into the nozzle 21.

In addition, additives which may be included in the impregnation liquid, that is, components of the impregnation liquid are not particularly limited. For example, resin, a defoamer, a surfactant, water, an organic solvent, and a pH adjustment agent are exemplified. The above components may be singly used or may be used in combination of two kinds or more thereof. The content thereof is not particularly limited.

If the impregnation liquid contains a defoamer, it is possible to effectively prevent forming of the impregnation liquid remaining on the nozzle surface after cleaning processing. The impregnation liquid may contain a large amount of an acidic moisturizer such as polyethylene glycol or glycerin. However, if the impregnation liquid contains a pH adjustment agent in this case, it is possible to avoid an occurrence of a situation in which an acidic impregnation liquid is brought into contact with a basic ink composition having, generally, pH of 7.5 or more. Thus, it is possible to prevent shifting of the ink composition to an acidic side, and thus preservation stability of the ink composition is more secured.

As a moisturizer which may be contained in the impregnation liquid, any moisturizer can be used without being particularly limited so long as the moisturizer can be generally used for an ink and the like. The moisturizer is not particularly limited. A high-boiling moisturizer having a boiling point which is preferably equal to or higher than 180° C. and more preferably equal to or higher than 200° C. at pressure equivalent to one atmosphere can be used. If the boiling point is in the above range, it is possible to prevent volatilization of a volatile component in the impregnation liquid. In addition, it is possible to reliably moisturize an ink composition which contains the inorganic pigment and is brought into contact with the impregnation liquid and thus to effectively perform sweeping.

The high-boiling moisturizer is not particularly limited. Examples of the high-boiling moisturizer include ethylene glycol, propylene glycol, diethylene glycol, triethylene glycol, pentamethylene glycol, trimethylene glycol, 2-butene-1,4-diol, 2-ethyl-1,3-hexanediol, 2-methyl-2,4-pentanediol, tripropylene glycol, polyethylene glycol, polypropylene glycol, 1,3-propylene glycol, isopropylene glycol, isobutylene glycol, glycerin, mesoerythritol, and pentaerythritol.

The moisturizer may be singly used or may be used in mixture of two kinds or more thereof. The content of the moisturizer is preferably 10 to 100 mass % with respect to 100 mass % as the total mass of the impregnation liquid. The phase that the content of the moisturizer is 100 mass % with respect to the total mass of the impregnation liquid indicates that all components of the impregnation liquid are the moisturizer.

A penetrant among the additives which may be contained in the impregnation liquid will be described. As the penetrant, any penetrant can be used without being particularly limited so long as the penetrant can be generally used for an ink and the like. A solution having surface tension which is equal to or less than 45 mN/m among solutions of 90 mass % of water and 10 mass % of a penetrant can be employed as the penetrant. The penetrant is not particularly limited. Examples of the penetrant include one or more selected from the group consisting of alkanediols having 5 to 8 carbon atoms, glycol ethers, acetylene glycol surfactants, siloxane-based surfactants, and fluorine-based surfactants. The surface tension can be measured by the above-described method.

The content of the penetrant in the impregnation liquid is preferably 1 mass % to 40 mass %, and more preferably 3 mass % to 25 mass %. Since the content of the penetrant is equal to or more than 1 mass %, it tends to have the improved scraping property. Since the content of the penetrant is equal to or less than 40 mass %, it is possible to avoid an occurrence of a situation in which the penetrant attacks the pigment contained in the ink in the vicinity of the nozzle, and thereby causing aggregation of breaking dispersion stability.

The alkanediols having 5 to 8 carbon atoms are not particularly limited. Examples of the alkanediols having 5 to 8 carbon atoms include 1,2-pentanediol, 1,5-pentanediol, 1,2-hexanediol, 1,6-hexanediol, 1,2-heptanediol, 2-ethyl-1,3-hexanediol, 2,2-dimethyl-1,3-propanediol, and 2,2-dimethyl-1,3-hexanediol. The alkanediols having 5 to 8 carbon atoms may be singly used or may be used in combination of two kinds or more thereof.

The glycol ethers are not particularly limited. Examples of the glycol ethers include ethylene glycol mono-n-butyl ether, ethylene glycol mono-t-butyl ether, diethylene glycol mono-n-butyl ether, triethylene glycol mono-n-butyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, diethylene glycol dimethyl ether, diethylene glycol diethyl ether, diethylene glycol dibutyl ether, diethylene glycol ethyl methyl ether, diethylene glycol butyl methyl ether, triethylene glycol dimethyl ether, tetraethylene glycol dimethyl ether, dipropylene glycol dimethyl ether, dipropylene glycol diethyl ether, tripropylene glycol dimethyl ether, ethylene glycol monoisohexyl ether, diethylene glycol monoisohexyl ether, triethylene glycol monoisohexyl ether, ethylene glycol monoisoheptyl ether, diethylene glycol monoisoheptyl ether, triethylene glycol monoisoheptyl ether, ethylene glycol monoisooctyl ether, diethylene glycol monoisooctyl ether, triethylene glycol monoisooctyl ether, ethylene glycol mono-2-ethylhexyl ether, diethylene glycol mono-2-ethylhexyl ether, triethylene glycol mono-2-ethylhexyl ether, diethylene glycol mono-2-ethyl pentyl ether, ethylene glycol mono-2-ethyl pentyl ether, ethylene glycol mono-2-methyl pentyl ether, and diethylene glycol mono-2-methyl pentyl ether. The glycol ethers may be singly used or may be used in combination of two kinds or more thereof.

The acetylene glycol surfactant is not particularly limited. Examples of the acetylene glycol surfactant include components represented by Formulas.

(4)

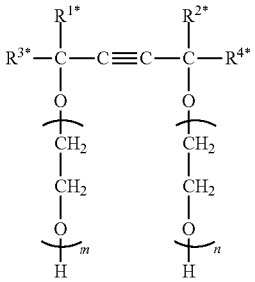

[In Formula (4), $0<m+n<50$, $R^{1*}$, $R^{2*}$, $R^{3*}$, and $R^{4*}$ each independently indicate alkyl groups, preferably, alkyl groups having 1 to 6 carbon atoms.]

Among acetylene glycol surfactants represented by Formula (4), preferably, 2,4,7,9-tetramethyl-5-decyne-4,7-diol, 3,6-dimethyl-4-octine-3,6-diol, 3,5-dimethyl-1-hexyne-3-ol, and the like are exemplified. A commercial product can be used as the acetylene glycol surfactant represented by Formula (4). Specific examples of the commercial product include SURFYNOL 82, 104, 440, 465, 485, or TG, all available from "Air Products and Chemicals. Inc.", OLFINE STG manufactured by Nissin Chemical co., ltd., and OLFINE E1010 manufactured by Nissin Chemical co., ltd. The acetylene glycol surfactant may be singly used or may be used in combination of two kinds or more thereof.

The siloxane-based surfactant is not particularly limited. Examples of the siloxane-based surfactant include components represented by Formula (5) or (6).

(5)

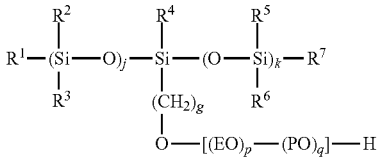

[In Formula (5), $R^1$, $R^2$, $R^3$, $R^4$, $R^5$, $R^6$, and $R^7$ each independently indicate alkyl groups having 1 to 6 carbon atoms, preferably, methyl group. j and k each independently indicate integers of 1 or more, preferably 1 to 5, more preferably 1 to 4, and further preferably 1 or 2. j=k=1 or k=j+1 is preferably satisfied. g indicates an integer of 0 or more, preferably 1 to 3, and more preferably 1. Further, p and q each independently indicate integers of 0 or more, and preferably 1 to 5. p+q is an integer of 1 or more, and preferably, p+q is an integer of 2 to 4.]

As the siloxane-based surfactant represented by Formula (5), a compound in which all $R^1$ to $R^7$ indicate methyl groups, j indicates an integer of 1 to 2, k indicates an integer of 1 to 2, g indicates an integer of 1 to 2, p indicates an integer of 1 to 5, and q is 0.

(6)

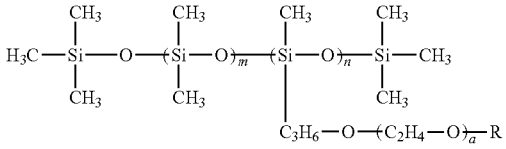

[In Formula (6), R indicates a hydrogen atom or a methyl group. a indicates an integer of 2 to 18. m indicates an integer of 0 to 50. n indicates an integer of 1 to 5.]

The siloxane-based surfactant represented by Formula (6) is not particularly limited. For example, the following components are preferable: a compound in which R indicates a hydrogen atom or a methyl group, a indicates an integer of 7 to 11, m indicates an integer of 30 to 50, and n indicates an integer of 3 to 5; a compound in which R indicates a hydrogen atom or a methyl group, a indicates an integer of 9 to 13, m indicates an integer of 2 to 4, and n indicates an integer of 1 to 2; a compound in which R indicates a hydrogen atom or a methyl group, a indicates an integer of 6 to 18, m indicates an integer of 0, and n indicates an integer of 1; and a compound in which R indicates a hydrogen atom, a indicates an integer of 2 to 5, m indicates an integer of 20 to 40, and n indicates an integer of 3 to 5.

The siloxane-based surfactant is commercially available, and a commercial product thereof may be used. For example, OLFINE PD-501 manufactured by Nissin Chemical co., ltd., OLFINE PD-570 manufactured by Nissin Chemical co., ltd., BYK-347 manufactured by BYK Co., Ltd., and BYK-348 manufactured by BYK Co., Ltd. can be used. The siloxane-based surfactant may be singly used or may be used in combination of two kinds or more thereof.

The fluorine-based surfactant is known as a solvent exhibiting good wettability to a recording medium having low absorptivity or non-absorptivity, as disclosed in International Publication No. WO 2010/050618 and International Publication No. WO 2011/007888. The fluorine-based surfactant is not particularly limited and can be appropriately selected in accordance with the purposes. Examples of the fluorine-based surfactant include perfluoroalkyl sulfonic acid salts, perfluoroalkyl carboxylic acid salts, perfluoroalkyl phosphoric acid ester, perfluoroalkyl ethylene oxide adducts, perfluoroalkyl betaine, and perfluoroalkyl amine oxide compounds.

In addition, as the fluorine-based surfactant, a surfactant obtained by appropriately synthesizing the above substances may be used, or a commercial product may be used. Examples of the commercial product include S 144 and S 145 manufactured by AGC Inc.; FC-170C, FC-430, and Fluorad FC-4430 manufactured by Sumitomo 3M Co., Ltd.; FSO, FSO-100, FSN, FSN-100, and FS-300 manufactured by Dupont Inc.; and FT-250 and 251 manufactured by NEOS COMPANY LIMITED. Among the products, FSO, FSO-100, FSN, FSN-100, and FS-300 manufactured by Dupont Inc. are preferable. The fluorine-based surfactant may be singly used or may be used in combination of two kinds or more thereof.

Next, an ink as the liquid used by the liquid ejector 1 will be described below in detail.

The ink used by the liquid ejecting apparatus 7 contains resin at a composition ratio and does not substantially contain glycerin having a boiling point of 290° C. under one atmosphere. If the ink substantially contains glycerin, the drying property of the ink is significantly deteriorated. As a result, in various media, in particular, media having non-absorptivity or low absorptivity, not only the unevenness in density of the image is noticeable, but also the fixability of the ink is not obtained. Preferably, the ink does not substantially contain alkylpolyols having a boiling point of 280° C. or higher at pressure equivalent to one atmosphere, except for glycerin.

Here, "being not substantially contained" in the present specification means that the content is not more than an amount as much as the meaning of being added is sufficiently exhibited. In quantitative terms, it is preferable that glycerin is not contained by 1.0 mass % or more with respect to 100 mass % as the total mass of the ink. It is more preferable that glycerin is not contained by 0.5 mass % or more, it is further preferable that glycerin is not contained by 0.1 mass % or more, it is further more preferable that glycerin is not contained by 0.05 mass % or more, and it is particularly preferable that glycerin is not contained by 0.01 mass % or more. It is most preferable that the glycerin is not contained by 0.001 mass % or more.

Next, the additives which are contained in the ink or may be contained in the ink, that is, components of the ink will be described.

1. Coloring Material

The ink may contain a coloring material. The coloring material is selected from pigments and dyes.

1-1. Pigment

If a pigment is used as the coloring material, it is possible to improve light resistance of the ink. As the pigment, any of an inorganic pigment and an organic pigment can be used. The inorganic pigment is not particularly limited. Examples of the inorganic pigment include carbon black, iron oxide, titanium oxide, and silica oxide.

The organic pigment is not particularly limited. Examples of the organic pigment include quinacridone-based pigments, quinacridone quinone-based pigments, dioxazine-based pigments, phthalocyanine-based pigments, anthrapyrimidine-based pigments, ansanthrone-based pigments, indanthrone-based pigments, flavanthrone-based pigments, perylene-based pigments, diketopyrrolopyrrole-based pigments, perinone-based pigments, quinophthalone-based pigments, anthraquinone-based pigments, thioindigo-based pigments, benzimidazolone-based pigments, isoindolinone-based pigments, azomethine-based pigments, and azo-based pigments. Specific examples of the organic pigment include substances as follows.

Examples of the pigment used for a cyan ink includes C.I. Pigment Blue 1, 2, 3, 15, and 15:1, 15:2, 15:3, 15:4, 15:6, 15:34, 16, 18, 22, 60, 65, 66, and C.I. Vat Blue 4 and 60. Among the pigments, any of C.I. Pigment Blue 15:3 and 15:4 is preferable.

Examples of the pigment used for a magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, 264, and C.I. Pigment Violet 19, 23, 32, 33, 36, 38, 43, and 50. Among the pigments, one or more selected from the group consisting of C.I. Pigment Red 122, C.I. Pigment Red 202, and C.I. Pigment Violet 19 is preferable.

Examples of the pigment used for a yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213. Among the pigments, one or more selected from the group consisting of C.I. Pigment Yellow 74, 155, and 213 is preferable.

As the pigments used for color inks other than the above-described inks, such as a green ink and an orange ink, pigments which are known well in the related art are exemplified.

The average particle size of the pigment is preferably equal to or less than 250 nm such that it is possible to suppress clogging of the nozzle 21, and ejection stability is more improved. In the present specification, the average particle size is based on a volume. As a measuring method, for example, the average particle size can be measured by a particle size distribution measuring device in which a laser diffraction scattering method is used as the measuring principle. As the particle size distribution measuring device, for example, a particle size distribution meter in which a dynamic light scattering method is used as the measuring principle, for example, Microtrac UPA manufactured by Nikkiso Co., Ltd. is exemplified.

1-2. Dye

A dye can be used as the coloring material. The dye is not particularly limited. Acid dyes, direct dyes, reactive dyes, and basic dyes can be used. The content of the coloring material is preferably 0.4 to 12 mass %, and more preferably 2 mass % to 5 mass %, with respect to 100 mass % as the total mass of the ink.

2. Resin

The ink contains resin. Since the ink contains resin, a resin film is formed on a medium. As a result, the ink is sufficiently fixed on the medium, and thus an effect of improving abrasion resistance of an image is exhibited. Therefore, a resin emulsion is preferably a thermoplastic resin. The heat deformation temperature of resin is preferably equal to or higher than 40° C. and more preferably equal to or higher than 60° C. such that advantageous effects in that clogging occurs in the nozzle 21 less frequently, and abrasion resistance of the medium is secured.

Here, in the present specification, "the heat deformation temperature" is a temperature value represented by "Tg" being a glass transition temperature or "MFT" being the minimum film forming temperature. That is, the phrase that "the heat deformation temperature is equal to or higher than 40° C." means that any of Tg or MFT may be equal to or higher than 40° C. Since it is easier to recognize improvement or deterioration of redispersibility of resin by using MFT than Tg, the heat deformation temperature is preferably a temperature value represented by MFT. If the ink has excellent redispersibility of resin, the ink does not stick. Thus, clogging occurs in the nozzle 21 less frequently.

The thermoplastic resin is not particularly limited. Specific examples of the thermoplastic resin include poly(meth) acrylic acid ester or copolymers thereof; polyacrylonitrile or copolymers thereof; (meth)acrylic polymers such as polycyanoacrylate, polyacrylamide, and poly(meth)acrylic acid; Polyethylene, polypropylene, polybutene, polyisobutylene, polystyrene, and copolymers thereof; polyolefin polymers such as petroleum resin, coumarone-indene resin, and terpene resin; polyvinyl acetate or copolymers thereof; Vinyl acetate or vinyl alcohol polymers such as polyvinyl alcohol, polyvinyl acetal, and polyvinyl ether; polyvinyl chloride or copolymers thereof; halogen-containing polymers such as polyvinylidene chloride, fluorocarbon resin, and fluororubber; polyvinylcarbazole; polyvinyl pyrrolidone or copolymers thereof; nitrogen-containing vinyl polymers such as polyvinylpyridine and polyvinylimidazole; polybutadiene or copolymers thereof; diene polymers such as polychloroprene and polyisoprene (for example, butyl rubber); other ring-opening polymerization resins; condensation polymerization type resin; and natural polymer resin.

The content of the resin is preferably 1 to 30 mass %, and more preferably 1 to 5 mass %, with respect to 100 mass % as the total mass of the ink. When the content thereof is in the above range, it is possible to further improve glossiness and abrasion resistance of a top-coated image to be formed. Examples of the resin which may be contained in the ink include a resin dispersant, a resin emulsion, and a wax.

2-1. Resin Emulsion

The ink may contain a resin emulsion. When a medium is heated, the resin emulsion forms a resin film along with an emulsion which is preferably a wax, and thereby the ink is sufficiently fixed on the medium. Thus, an effect of improving abrasion resistance of an image is exhibited. With the above effect, when recording is performed on a medium with an ink containing a resin emulsion, the ink has excellent abrasion resistance on, particularly, a medium having non ink absorptivity or low ink absorptivity.

The resin emulsion functioning as a binder is contained in an emulsion state in the ink. Since resin functioning as the binder is contained in the emulsion state in the ink, it is easy to adjust viscosity of the ink in a proper range in an ink jet recording method. In addition, it is possible to improve preservation stability and ejection stability of the ink.

The resin emulsion is not limited to the followings. Examples of the resin emulsion include homopolymers or copolymers of (meth)acrylic acid, (meth)acrylic acid ester, acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, and vinylidene chloride, fluorine resin, and natural resin. Among the above substances, any of methacrylic resin and styrene-methacrylic acid copolymer resin is preferable. Any of acrylic resin and styrene-acrylic acid copolymer resin is more preferable, and styrene-acrylic acid copolymer resin is further preferable. The above copolymer may have any form of a random copolymer, a block copolymer, an alternating copolymer, and a graft copolymer.

The average particle size of the resin emulsion is preferably in a range of 5 nm to 400 nm, and more preferably in a range of 20 nm to 300 nm in order to further improve preservation stability and ejection stability of the ink. The content of the resin emulsion among the resins is preferably in a range of 0.5 to 7 mass % with respect to 100 mass % as the total mass of the ink. When the content thereof is in the above range, it is possible to reduce solid content concentration. Thus, it is possible to further improve ejection stability.

2-2. Wax

The ink may contain a wax. Since the ink contains a wax, fixability of the ink on a medium having non-ink absorptivity or low ink absorptivity is more improved. As the wax, an emulsion type is more preferable. The wax is not limited to the followings. Examples of the wax include a polyethylene wax, a paraffin wax, and a polyolefin wax. Among the waxes, the polyethylene wax described later is preferable. In the present specification, "the wax" means a substance in which solid wax particles are dispersed in water by using a surfactant described later.

Since the ink contains the polyethylene wax, it is possible to improve abrasion resistance of the ink. The average particle size of the polyethylene wax is preferably in a range of 5 nm to 400 nm, and more preferably in a range of 50 nm to 200 nm in order to further improve preservation stability and ejection stability of the ink.

The content of the polyethylene wax in terms of a solid content is preferably in a range of 0.1 to 3 mass %, more preferably in a range of 0.3 to 3 mass %, and further preferably in a range of 0.3 to 1.5 mass %, with respect to 100 mass % as the total mass of the ink, independently. When the content thereof is in the above range, it is possible to solidify and fix the ink well even on a medium having non-ink absorptivity or low ink absorptivity. In addition, it is possible to further improve preservation stability and ejection stability of the ink.

3. Surfactant

The ink may contain a surfactant. The surfactant is not limited to the followings. Examples of the surfactant include a nonionic surfactant. The nonionic surfactant has an action of spreading the ink uniformly on a medium. Therefore, when recording is performed with the ink containing the nonionic surfactant, a high definition image with hardly bleeding is obtained. Such a nonionic surfactant is not limited to the followings. Examples of the nonionic surfactant include silicon-based surfactants, polyoxyethylene alkyl ether-based surfactants, polyoxypropylene alkyl ether-based surfactants, polycyclic phenyl ether-based surfactants, sorbitan derivatives, and fluorine-based surfactants. Among the substances, the silicon-based surfactant is preferable.

The content of the surfactant among the resins is preferably in a range of 0.1 mass % to 3 mass % with respect to 100 mass % as the total mass of the ink, such that the preservation stability and the ejection stability of the ink are further improved.

4. Organic Solvent

The ink may contain a water-soluble organic solvent which is well-known and has volatility. As described above, the ink does not substantially contain glycerin which is one type of organic solvent and has a boiling point of 290° C. under one atmosphere. In addition, it is preferable that the ink does not substantially contain alkylpolyols having a boiling point of 280° C. or higher at pressure equivalent to one atmosphere, except for glycerin.

5. Aprotic Polar Solvent

The ink may contain an aprotic polar solvent. Since the ink contains the aprotic polar solvent, the above-described resin particles contained in the ink are dissolved. Thus, it is possible to effectively suppress clogging of the nozzle 21 in recording processing. Since the property of dissolving a medium such as vinyl chloride is provided, adhesion of an image is improved.

The aprotic polar solvent is not particularly limited. Preferably, the aprotic polar solvent contains one or more selected from pyrrolidones, lactones, sulfoxides, imidazolidinones, sulfolanes, urea derivatives, dialkylamides, cyclic ethers, and amide ethers. As the representative example of pyrrolidones, 2-pyrrolidone, N-methyl-2-pyrrolidone, and N-ethyl-2-pyrrolidone are provided. As the representative example of lactones, γ-butyrolactone, γ-valerolactone, and ε-caprolactone are provided. As the representative example of sulfoxides, dimethyl sulfoxide and tetramethylene sulfoxide are provided.

As the representative example of imidazolidinones, 1,3-dimethyl-2-imidazolidinone is provided. As the representative example of sulfolanes, sulfolane and dimethyl sulfolane are provided. As the representative example of urea derivatives, dimethylurea and 1,1,3,3-tetramethylurea are provided. As the representative example of dialkylamides, dimethylformamide and dimethylacetamide are provided. As the representative example of cyclic ethers, 1,4-dioxane and tetrahydrofuran are provided.

Among the above substances, from a viewpoint of the above-described effects, pyrrolidones, lactones, sulfoxides, and amide ethers are particularly preferable, and 2-pyrrolidone is most preferable. The content of the aprotic polar solvent is preferably in a range of 3 to 30 mass % and more preferably in a range of 8 to 20 mass %, with respect to 100 mass % as the total mass of the ink.

6. Other Components

The ink may further contain an antifungal agent, a rust inhibitor, a chelating agent, and the like in addition to the above components.

The ink will be more described.

Ink Composition

The liquid ejecting apparatus 7 in the embodiment is not particularly limited so long as the liquid ejecting apparatus 7 uses an inorganic pigment-containing ink composition. The liquid ejecting apparatus 7 may use another ink composition. Additives which are or may be contained in the inorganic pigment-containing ink composition in the embodiment and another ink composition, that is, components of the ink composition will be described below. The inorganic pigment-containing ink composition and the other ink composition are simply and collectively referred to as "an ink composition" below.

1. Coloring Material

The inorganic pigment-containing ink composition in the embodiment is not particularly limited so long as the ink composition contains an inorganic pigment. The other ink composition may contain a coloring material. The coloring material is selected from a pigment and a dye other than the inorganic pigment.

1-1. Pigment

The inorganic pigment is not particularly limited. Examples of the inorganic pigment include carbon black, iron oxide, titanium oxide, and silica oxide.

The inorganic pigment contained in the inorganic pigment-containing ink composition has an average particle size which is preferably equal to or more than 200 nm and more preferably equal to or more than 250 nm. An upper limit of the average particle size is preferably equal to or less than 4 μm and more preferably equal to or less than 2 μm. The Mohs hardness of the inorganic pigment is preferably more than 2.0 and more preferably equal to or more than 5. An upper limit of the hardness is preferably equal to or less than 8. The inorganic pigment in the above-described range causes the liquid repellent film to be relatively easily damaged. Thus, in a general ink jet recording apparatus, preservability of the liquid repellent film is damaged. However, according to the ink jet recording apparatus in the embodiment, even when the inorganic pigment in the above-described range is used, the preservability of the liquid repellent film is favorable with the above-described configuration. The Mohs hardness of the organic pigment is generally equal to or less than 1 and has a tendency having a smaller concern of damaging the preservability of the liquid repellent film than that of the inorganic pigment.

Preferably, the inorganic pigment-containing ink composition contains the inorganic pigment having a content which is equal to or less than 20 mass %. In particular, when the inorganic pigment-containing ink composition is a white ink composition, the concentration of the inorganic pigment is preferably equal to or more than 5 mass %. If the above ranges are satisfied, characteristics required by the inorganic pigment ink are maintained. In addition, if the ink jet recording apparatus in the embodiment is provided, the preservability of the liquid repellent film is secured.

The Mohs hardness is measured by a Mohs hardness tester. The Mohs hardness tester has been proposed by F. Mohs. The Mohs hardness tester contains ten kinds of minerals ranging from soft minerals to hard minerals in a box and shows a level of the hardness in a manner of 1 degree, 2 degrees, . . . , and 10 degrees from a soft mineral. The standard minerals are as follows, and the number indicates hardness. 1: Talc, 2: Gypsum, 3: Calcite, 4: Fluorite, 5: Apatite 6: Feldspar, 7: Quartz, 8: Topaz, 9: Corundum, and 10: Diamond. When an attempt to scratch the surface of a mineral sample for obtaining hardness with the above minerals is performed, the hardness can be compared by a force resisting against the scratching, that is, a force having a degree of being scratched or not. For example, when calcite is scratched by the mineral sample, the hardness of the sample is more than 3 degrees. When the sample is scratched by fluorite, but fluorite is not scratched by the sample, the hardness of the sample is less than 4 degrees. At this time, the hardness of the sample is indicated by 3 to 4 or 3.5. When the sample and the standard mineral are slightly scratched by each other, the hardness of the sample is hardness of the same level as the used standard mineral. The hardness of the Mohs hardness tester is indicated by just a level and does not have an absolute value.

The inorganic pigment satisfying a condition in which the Mohs hardness is more than 2.0 is not particularly limited. Examples of such an inorganic pigment include single metal such as gold, silver, copper, aluminum, nickel, and zinc; oxides such as cerium oxide, chromium oxide, aluminum oxide, zinc oxide, magnesium oxide, silicon oxide, tin oxide, zirconium oxide, iron oxide, and titanium oxide; sulfates such as calcium sulfate, barium sulfate, and aluminum sulfate; silicates such as calcium silicate and magnesium silicate; nitrides such as boron nitride and titanium nitride; carbides such as silicon carbide, titanium carbide, boron carbide, tungsten carbide, and zirconium carbide; and borides such as zirconium boride and titanium boride. Among the above substances, as a preferable inorganic pigment, aluminum, aluminum oxide, titanium oxide, zinc oxide, zirconium oxide, and silicon oxide are exemplified. More preferably, titanium oxide, silicon oxide, and aluminum oxide are exemplified. Regarding titanium oxide, a rutile type has a Mohs hardness of 7 to about 7.5, but an anatase type has a Mohs hardness of 6.6 to about 6. Rutile type titanium oxide is low in manufacturing cost and has a preferable crystal system. Thus, rutile type titanium oxide can exhibit favorable whiteness. Therefore, when rutile type titanium dioxide is used, an ink jet recording apparatus in which preservability of the liquid repellent film is provided, and it is possible to produce printed matter having favorable whiteness at low cost is obtained.

Examples of a white inorganic pigment include sulfates of alkaline earth metal such as barium sulfate; carbonates of alkaline earth metal such as calcium carbonate; silicas such as fine silica and synthetic silicates; metal compounds such as calcium silicate, alumina, alumina hydrate, titanium oxide, and zinc oxide; and talc and clay. In particular, titanium dioxide is known as a white pigment being preferable in hiding power, coloring properties, and a dispersed particle size.

The organic pigment is not particularly limited. Examples of the organic pigment include quinacridone-based pigments, quinacridone quinone-based pigments, dioxazine-based pigments, phthalocyanine-based pigments, anthrapyrimidine-based pigments, ansanthrone-based pigments, indanthrone-based pigments, flavanthrone-based pigments, perylene-based pigments, diketopyrrolopyrrole-based pigments, perinone-based pigments, quinophthalone-based pigments, anthraquinone-based pigments, thioindigo-based pigments, benzimidazolone-based pigments, isoindolinone-based pigments, azomethine-based pigments, and azo-based pigments. Specific examples of the organic pigment include substances as follows.

Examples of the pigment used for a cyan ink includes C.I. Pigment Blue 1, 2, 3, 15, and 15:1, 15:2, 15:3, 15:4, 15:6, 15:34, 16, 18, 22, 60, 65, 66, and C.I. Vat Blue 4 and 60. Among the pigments, at least any of C.I. Pigment Blue 15:3 and 15:4 is preferable.

Examples of the pigment used for a magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, 264, and C.I. Pigment Violet 19, 23, 32, 33, 36, 38, 43, and 50. Among the pigments, one or more selected from the group consisting of C.I. Pigment Red 122, C.I. Pigment Red 202, and C.I. Pigment Violet 19 is preferable.

Examples of the pigment used for a yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213. Among the pigments, one or more selected from the group consisting of C.I. Pigment Yellow 74, 155, and 213 is preferable. As the pigments used for color inks other than the above-described inks, such as a green ink and an orange ink, pigments which are known well in the related art are exemplified.

The average particle size of the pigment other than the inorganic pigment is preferably equal to or less than 250 nm such that it is possible to suppress clogging of the nozzle, and ejection stability is further improved. In the present specification, the average particle size is based on a volume. As a measuring method, for example, the average particle size can be measured by a particle size distribution measuring device in which a laser diffraction scattering method is used as the measuring principle. As the particle size distribution measuring device, for example, a particle size distribution meter in which a dynamic light scattering method is used as the measuring principle, for example, Microtrac UPA manufactured by Nikkiso Co., Ltd. is exemplified.

1-2. Dye

In the embodiment, a dye can be used as the coloring material. The dye is not particularly limited. Acid dyes, direct dyes, reactive dyes, and basic dyes can be used.

The content of the coloring material is preferably 0.4 to 12 mass %, and more preferably 2 to 5 mass %, with respect to 100 mass % as the total mass of the ink composition.

2. Resin

The ink which is suitably used in the ink jet recording apparatus in the embodiment and contains the inorganic pigment preferably has a feature of (1) or (2) as follows, on a composition ratio.

(1) An ink composition for ink jet recording contains first resin having a heat deformation temperature of 10° C. or lower. This ink composition is referred to as "a first ink" below.

(2) An ink composition for ink jet recording contains second resin and does not substantially contain glycerin. This ink composition is referred to as "a second ink" below.

The above ink composition has a property of solidification easily occurring on the nozzle surface and the absorbent member and has a tendency to easily accelerate damaging of the liquid repellent film. However, according to the present application, it is possible to favorably prevent such an occurrence of such problems.

The first ink contains the first resin having a heat deformation temperature of 10° C. or lower. Such resin has a property of firmly adhering to a material such as fabric, which is rich in flexibility and absorptivity. However, film formation and solidification proceed rapidly, and the resin adheres to the nozzle surface or an absorbent material in a form of a solid.

The second ink does not substantially contain glycerin having boiling point of 290° C. under one atmosphere. If a color ink substantially contains glycerin, the drying property of the ink is significantly deteriorated. As a result, in various recording media, in particular, recording media having non-ink absorptivity or low ink absorptivity, not only the unevenness in density of the image is noticeable, but also the fixability of the ink is not obtained. Since glycerin is not contained, moisture and the like as the main solvent in the ink evaporates rapidly, and the proportion of the organic solvent in the second ink increases. In this case, the heat deformation temperature of the resin, in particular, a film formation temperature is lowered. Thus, solidification by the film is accelerated more. Further, it is preferable that the ink does not substantially contain alkylpolyols having a boiling point of 280° C. or higher at pressure equivalent to one atmosphere, except for glycerin. Regarding the second ink, in a case of a recording apparatus including a heating mechanism that heats a recording medium transported to a position facing a recording head, since drying of the ink in the vicinity of the recording head is accelerated, the problem becomes much worse. However, according to the present application, it is possible to favorably prevent such an occurrence of such a problem. If the temperature of heating is 30° C. to 80° C., this temperature is preferable from a viewpoint of preservation stability of the ink and quality of a recorded image. The heating mechanism is not particularly limited. A heating heater, a hot-air heater, an infrared heater, and the like are exemplified.

Here, "being not substantially contained" in the present specification means that the content is not more than an amount as much as the meaning of being added is sufficiently exhibited. In quantitative terms, it is preferable that glycerin is not contained by 1.0 mass % or more with respect to 100 mass % as the total mass of the color ink. It is more preferable that glycerin is not contained by 0.5 mass % or more, it is further preferable that glycerin is not contained by 0.1 mass % or more, it is further more preferable that glycerin is not contained by 0.05 mass % or more, it is particularly preferable that glycerin is not contained by 0.01 mass % or more, and it is most preferable that glycerin is not contained by 0.001 mass % or more.

The heat deformation temperature of the first resin is equal to or lower than 10° C. The heat deformation temperature of the first resin is preferably equal to or lower than −10° C. and more preferably equal to or lower than −15° C. When the glass transition temperature of fixation resin is in the above range, fixability of the pigment on a record is further improved. As a result, abrasion resistance is improved. A lower limit of the heat deformation temperature is not particularly limited and may be equal to or higher than −50° C.

Regarding the heat deformation temperature of the second resin, the lower limit is preferably equal to or higher than 40° C. and more preferably equal to or higher than 60° C. such that it is possible to cause clogging to occur in the head less frequently and to improve abrasion resistance of the record. Preferably, the upper limit is equal to or lower than 100° C.

Here, in the present specification, "the heat deformation temperature" is a temperature value represented by "Tg" being a glass transition temperature or "MFT" being the minimum film forming temperature. That is, the phrase that "the heat deformation temperature is equal to or higher than 40° C." means that any of Tg or MFT may be equal to or higher than 40° C. Since it is easier to recognize improvement or deterioration of redispersibility of resin by using MFT than Tg, the heat deformation temperature is preferably a temperature value represented by MFT. If the ink composition has excellent redispersibility of resin, the ink composition does not stick. Thus, clogging occurs in the head less frequently.

In the present specification, Tg is described to have a value measured by differential scanning calorimetry. In the present specification, MFT is described to have a value measured by ISO 2115:1996 "Plastics—Polymer dispersions—Determination of white point temperature and minimum film-forming temperature".

The resin is not particularly limited. Examples of the resin include poly(meth)acrylic acid ester or copolymers thereof; polyacrylonitrile or copolymers thereof, (meth)acrylic polymers such as polycyanoacrylate, polyacrylamide, and poly (meth)acrylic acid; polyethylene, polypropylene, polybutene, polyisobutylene, polystyrene, and copolymers thereof; polyolefin polymers such as petroleum resin, coumarone-indene resin, and terpene resin; polyvinyl acetate or copolymers thereof; Vinyl acetate or vinyl alcohol polymers such as polyvinyl alcohol, polyvinyl acetal, and polyvinyl ether; polyvinyl chloride or copolymers thereof, halogen-containing polymers such as polyvinylidene chloride, fluorocarbon resin, and fluororubber; polyvinylcarbazole, polyvinyl pyrrolidone or copolymers thereof, nitrogen-containing vinyl polymers such as polyvinylpyridine and polyvinylimidazole; polybutadiene or copolymers thereof, diene polymers such as polychloroprene and polyisoprene (for example, butyl rubber); other ring-opening polymerization resins, condensation polymerization type resin, and natural polymer resin.

Examples of commercial products of the resin include HITEC E-7025P, HITEC E-2213, HITEC E-9460, HITEC E-9015, HITEC E-4A, HITEC E-5403P, and HITEC E-8237 manufactured by TOHO Chemical Industry Co., Ltd. Examples of the commercial products of the resin include AQUACER 507, AQUACER 515, and AQUACER 840 manufactured by BYK Japan Corporation. Examples of the commercial products of the resin include JONCRYL 67, 611, 678, 680, and 690 manufactured by BASF Inc.

The resin may be either anionic, nonionic or cationic. Among the resins, from a viewpoint of a material suitable for the head, nonionic or anionic resin is preferable. The resin may be singly used or may be used in combination of two kinds or more thereof.

The content of the resin is preferably 1 to 30 mass %, and more preferably 1 to 5 mass %, with respect to 100 mass % as the total mass of the ink composition. When the content thereof is in the above range, it is possible to further improve glossiness and abrasion resistance of a top-coated image to be formed.

Examples of the resin which may be contained in the ink composition include a resin dispersant, a resin emulsion, and a wax. Among the resins, the resin emulsion is preferable because of favorable adhesion and abrasion resistance.

2-1. Resin Dispersant

When the pigment is contained in the ink composition in the embodiment, the ink composition may contain a resin dispersant such that the pigment is allowed to be stably dispersed and held in water. The ink composition contains a resin dispersion pigment as a pigment which is dispersed with a resin dispersant such as water-soluble resin or water-dispersible resin. Thus, when the ink composition adheres to a recording medium, it is possible to improve adhesion at least any of a case between the recording medium and the ink composition and a case between solidified materials in the ink composition. Among resin dispersants, the water-soluble resin is preferable because of excellent dispersion stability.

2-2. Resin Emulsion

The ink composition in the embodiment preferably contains a resin emulsion. The resin emulsion exhibits an effect of improving abrasion resistance of an image in a manner that a resin film is formed, and the ink composition is sufficiently fixed onto a recording medium. With the above effect, a record obtained by performing recording with the ink composition containing the resin emulsion is excellent in adhesion and abrasion resistance, on a recording medium having non-ink absorptivity or low ink absorptivity, in particular, fabric. The resin emulsion has a tendency to accelerate solidification of the inorganic pigment. However, according to the present application, it is possible to favorably prevent an occurrence of a problem by solidification.

Preferably, the resin emulsion functioning as a binder is contained in an emulsion state in the ink composition. Since resin functioning as the binder is contained in the emulsion state in the ink composition, it is easy to adjust viscosity of the ink composition in a proper range in an ink jet recording method. In addition, it is possible to improve preservation stability and ejection stability of the ink composition.

The resin emulsion is not particularly limited. Examples of the resin emulsion include homopolymers or copolymers of (meth)acrylic acid, (meth)acrylic acid ester, acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, and vinylidene chloride, fluorine resin, and natural resin. Among the resin emulsions, at least any of (meth)acrylic resin and styrene-(meth)acrylic acid copolymer resin is preferable. At least any of acrylic resin and styrene-acrylic acid copolymer resin is more preferable. Styrene-acrylic acid copolymer resin is further preferable. The above copolymer may have any form of a random copolymer, a block copolymer, an alternating copolymer, and a graft copolymer.

As the resin emulsion, a commercial product may be used. In addition, the resin emulsion may be produced by using an emulsion polymerization method as follows, and the like. As a method of obtaining resin in the ink composition in an emulsion state, a method in which emulsion polymerization of monomers of the water-soluble resin described above is performed in water in a polymerization catalyst and an emulsifier are provided is exemplified. A polymerization initiator, an emulsifier, and a molecular weight modifier used in emulsion polymerization can be used according to the well-known method in the related art.

The average particle size of the resin emulsion is preferably in a range of 5 nm to 400 nm, and more preferably in a range of 20 nm to 300 nm in order to further improve preservation stability and ejection stability of the ink.

The resin emulsion may be singly used or may be used in combination of two kinds or more thereof. The content of the resin emulsion among the resins is preferably in a range of 0.5 to 15 mass % with respect to 100 mass % as the total mass of the ink composition. When the content thereof is in the above range, it is possible to reduce solid content concentration. Thus, it is possible to further improve ejection stability.

2-3. Wax

The ink composition in the embodiment may contain a wax. Since the ink composition contains the wax, fixability of the ink composition on a recording medium having non-ink absorptivity or low ink absorptivity is more improved. Among waxes, an emulsion wax or a suspension type wax is more preferable. The wax is not limited to the followings. Examples of the wax include a polyethylene wax, a paraffin wax, and a polyolefin wax. Among the waxes, the polyethylene wax described later is preferable.

Since the ink composition contains the polyethylene wax, it is possible to improve abrasion resistance of the ink.

The average particle size of the polyethylene wax is preferably in a range of 5 nm to 400 nm, and more preferably in a range of 50 nm to 200 nm in order to further improve preservation stability and ejection stability of the ink.

The content of the polyethylene wax in terms of a solid content is preferably in a range of 0.1 to 3 mass %, more preferably in a range of 0.3 to 3 mass %, and further preferably in a range of 0.3 to 1.5 mass %, with respect to 100 mass % as the total mass of the ink composition. When the content thereof is in the above range, it is possible to solidify and fix the ink composition well even on a recording medium. In addition, it is possible to further improve preservation stability and ejection stability of the ink composition.

3. Defoamer

The ink composition in the embodiment may contain a defoamer. More specifically, it is preferable that at least any of the ink composition and the impregnation liquid in the embodiment contains a defoamer. When the ink composition contains the defoamer, it is possible to prevent foaming. As a result, it is possible to prevent an occurrence of a problem of entering foam into the nozzle.

The defoamer is not limited to the followings. Examples of the defoamer include a silicon-based defoamer, a polyether-based defoamer, a fatty acid ester-based defoamer, and an acetylene glycol-based defoamer. Among the defoamers, the silicon-based defoamer and the acetylene glycol-based defoamer are preferable from a viewpoint of excellent power of properly maintaining surface tension and interfacial tension and a point that bubbles are hardly generated. An HLB value is more preferably equal to or less than 5 based on a Griffin method of the defoamer.

4. Surfactant

The ink composition in the embodiment may contain a surfactant. The surfactant is limited to a surfactant except for the substances exemplified as the defoamer, that is, a surfactant in which an HLB value based on the Griffin method is more than 5. The surfactant is not limited to the followings. Examples of the surfactant include a nonionic surfactant. The nonionic surfactant has an action of uniformly spreading the ink composition on a recording medium. Therefore, when ink jet recording is performed with the ink composition containing the nonionic surfactant, a high definition image with hardly bleeding is obtained. Such a nonionic surfactant is not limited to the followings. Examples of the nonionic surfactant include silicon-based surfactants, polyoxyethylene alkyl ether-based surfactants, polyoxypropylene alkyl ether-based surfactants, polycyclic phenyl ether-based surfactants, sorbitan derivatives, and fluorine-based surfactants. Among the substances, the silicon-based surfactant is preferable.

The silicon-based surfactant has an excellent action of uniformly spreading the ink composition so as not to bleed on a recording medium.

The silicon-based surfactant is not particularly limited. A polysiloxane compound is preferably exemplified. The polysiloxane compound is not particularly limited. Examples of the polysiloxane compound include polyether modified organosiloxane. A commercial product of the polyether modified organosiloxane is not particularly limited. Examples of the commercial product thereof include BYK-306, BYK-307, BYK-333, BYK-341, BYK-345, BYK-346, BYK-348, and BYK-349 manufactured by BYK Inc. Examples of the commercial product of the polyether modified organosiloxane include KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 manufactured by Shin-Etsu Chemical Co., Ltd.

The surfactant may be singly used or may be used in mixture of two kinds or more thereof. The content of the surfactant among the resins is preferably in a range of 0.1 mass % to 3 mass % with respect to 100 mass % as the total mass of the ink, such that the preservation stability and the ejection stability of the ink are further improved.

5. Water

The ink composition in the embodiment may contain water. In particular, when the ink is an aqueous ink, water is the main solvent of the ink. The water is a component to be evaporated and scattered when a recording medium is heated in ink jet recording.

Examples of the water include water obtained by firmly removing ionic impurities, such as pure water (such as ion exchange water, ultrafiltered water, reverse osmosis water, and distilled water) and ultrapure water. If water sterilized by, for example, UV irradiation or addition of hydrogen peroxide, it is possible to prevent generation of mold and bacteria when a pigment dispersion liquid and an ink using the pigment dispersion liquid is preserved for a long term.

The content of the water is not particularly limited and may be appropriately determined as necessary.

6. Organic Solvent

The ink composition in the embodiment may contain a water-soluble organic solvent having volatility. The organic solvent is not particularly limited. Examples of the organic solvent include alcohols or glycols such as ethylene glycol, diethylene glycol, triethylene glycol, propylene glycol, dipropylene glycol, 1,3-propanediol, 1,2-butanediol, 1,2-pentanediol, 1,2-hexanediol, 1,4-butanediol, 1,5-pentanediol, 1,6-hexanediol, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-n-butyl ether, triethylene glycol mono-n-butyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, diethylene glycol dimethyl ether, diethylene glycol diethyl ether, diethylene glycol dibutyl ether, diethylene glycol ethyl methyl ether, diethylene glycol butyl methyl ether, triethylene glycol dimethyl ether, tetraethylene glycol dimethyl ether, dipropylene glycol dimethyl ether, dipropylene glycol diethyl ether, tripropylene glycol dimethyl ether, methanol, ethanol, n-propyl alcohol, iso-propyl alcohol, n-butanol, 2-butanol, tert-butanol, iso-butanol, n-pentanol, 2-pentanol, 3-pentanol, and tert-pentanol; and N,N-dimethylformamide, N,N-dimethylacetamide, 2-pyrrolidone, N-methyl-2-pyrrolidone, 2-oxazolidone, 1,3-dimethyl-2-imidazolidinone, dimethyl sulfoxide, sulfolane, and 1,1,3,3-tetramethylurea.

The organic solvent may be singly used or may be used in combination of two kinds or more thereof. The content of the organic solvent is not particularly limited and may be appropriately determined as necessary.

7. pH Adjustment Agent

The ink composition in the embodiment may contain a pH adjustment agent. Examples of the pH adjustment agent include inorganic alkali such as sodium hydroxide and potassium hydroxide, ammonia, diethanolamine, triethanolamine, triisopropanolamine, morpholine, potassium dihydrogen phosphate, and disodium hydrogen phosphate.

The pH adjustment agent may be singly used or may be used in combination of two kinds or more thereof. The content of the pH adjustment agent is not particularly limited and may be appropriately determined as necessary.

8. Other Components

The ink composition in the embodiment may further contain an antiseptic.antifungal agent, a rust inhibitor, a chelating agent, and the like in addition to the above components.

9. Method of Producing Ink Composition

The ink composition in the embodiment can be obtained in a manner that the above components, that is, the materials are mixed in any order, and filtering or the like is performed if necessary, so as to remove impurities. Here, the pigment is mixed after being produced in a state of being uniformly dispersed in a solvent. This is preferable because of simple handling.

As a method of mixing the materials, a method in which the materials are sequentially added to a container including a stirring device such as a mechanical stirrer or a magnetic stirrer, and mixing with stirring is performed is suitably used. As a filtration method, for example, centrifugal filtration or filter filtration can be performed if necessary.

10. Surface Tension of Ink Composition

The surface tension of the ink composition is not particularly limited and is preferably 15 to 35 mN/m. Thus, it is possible to secure permeability of the ink composition into the absorbent member and to secure bleeding resistance at time of recording. In addition, an ink scraping property in a cleaning operation is improved. As described above, for example, a method of measuring the surface tension of the ink composition with a surface tension meter which is generally used, for example, a surface tension meter CBVP-Z manufactured Kyowa Interface Science, Inc can be exemplified. Preferably, a difference between the surface tension of the ink composition and the surface tension of the impregnation liquid has a relation of being within 10 mN/m. Thus, when the ink composition and the impregnation liquid are mixed in the vicinity of the nozzle, it is possible to prevent large decrease of the surface tension of the ink composition.

Next, components of the surfactant mixed in the second liquid will be described.

As the surfactant, the followings can be used: cationic surfactants such as alkylamine salts and quaternary ammonium salts; anionic surfactants such as dialkyl sulfosuccinates, alkyl naphthalene sulfonates, and fatty acid salts; amphoteric surfactants such as alkyl dimethyl amine oxide and alkyl carboxy betaine; and nonionic surfactants such as polyoxyethylene alkyl ethers, polyoxyethylene alkyl allyl ethers, acetylene glycols, and polyoxyethylene.polyoxypropylene block copolymers. In particular, among the surfactants, the anionic surfactant or the nonionic surfactant is preferable.

The content of the surfactant is preferably 0.1 to 5.0 mass % with respect to the total mass of the second liquid. From a viewpoint of foamability and defoamability after foaming, the content of the surfactant is preferably 0.5 to 1.5 mass % with respect to the total mass of the second liquid. The surfactant may be singly used or may be used in mixture of two kinds or more thereof. Preferably, the surfactant contained in the second liquid is the same as the surfactant contained in the ink. For example, when the surfactant contained in the ink is a nonionic surfactant, the nonionic surfactant is not limited to the followings. Examples of the nonionic surfactant include a silicone-based surfactant, a polyoxyethylene-based surfactant, a polyoxypropylene alkyl ether-based surfactant, a polycyclic phenyl ether-based surfactant, sorbitan derivatives, and a fluorine-based surfactant. Among the surfactants, the silicon-based surfactant is preferable.

In particular, as the surfactant, a surfactant in which an adduct obtained by adding "EO" which is ethylene oxide in an addition mole number of 4 to 30 to acetylene diol is used, and the content of the adduct is set to be 0.1 to 3.0 weight % with respect to the total weight of the washing liquid is preferable. Thus, regarding the foam height just after foaming start and the foam height after five minutes from the start of foaming, which are obtained using the Ross Miles method, the foam height just after foaming start is set to be in a range of 50 mm or more, and the foam height after five minutes from the start of foaming is set to be in a range of 5 mm or less. Further, a surfactant in which an adduct obtained by adding "EO" which is ethylene oxide in an addition mole number of 10 to 20 to acetylene diol is used, and the content of the adduct is set to be 0.5 to 1.5 weight % with respect to the total weight of the washing liquid is preferable. Thus, regarding the foam height just after foaming start and the foam height after five minutes from the start of foaming, which are obtained using the Ross Miles method, the foam height just after foaming start is set to be in a preferable range of 100 mm or more, and the foam height after five minutes from the start of foaming is set to be in a preferable range of 5 mm or less. If the content of the ethylene oxide adduct of acetylene diol is too large, the concentration thereof may reach the critical micelle concentration, and the surfactant may become an emulsion.

The surfactant has a function of easily wetting and spreading an aqueous ink on a recording medium. The surfactant which can be used in the present disclosure is not particularly limited. For example, the followings can be used: anionic surfactants such as dialkyl sulfosuccinates, alkyl naphthalene sulfonates, and fatty acid salts; nonionic surfactants such as polyoxyethylene alkyl ethers, polyoxyethylene alkyl allyl ethers, acetylene glycols, and polyoxyethylene.polyoxypropylene block copolymers; cationic surfactants such as alkylamine salts and quaternary ammonium salts; silicon-based surfactants; and fluorine-based surfactants.

The surfactant has an effect of fragmenting and dispersing aggregates by a surface-active effect between the washing liquid as the second liquid and the aggregates. Since the surface tension of the washing liquid may be lowered, there is an effect that the washing liquid easily enters between the aggregate and the nozzle surface 20*a*, and the aggregate is easily separated from the nozzle surface 20*a*.

Any surfactant can be suitably used so long as the surfactant is a compound having a hydrophilic portion and a hydrophobic portion in the same molecule. As a specific example, compounds represented by Formulas (I) to (IV) are preferable. That is, a polyoxyethylene alkyl phenyl ether-based surfactant in Formula (I), an acetylene glycol surfactant in Formula (II), a polyoxyethylene alkyl ether-based surfactant in Formula (III), and a polyoxyethylene polyoxypropylene alkyl ether-based surfactant in Formula (IV) are exemplified.

(1)

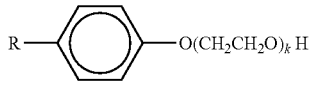

[R indicates a hydrocarbon chain which has 6 to 14 carbon atoms and may be branched, k: 5 to 20]

(II)

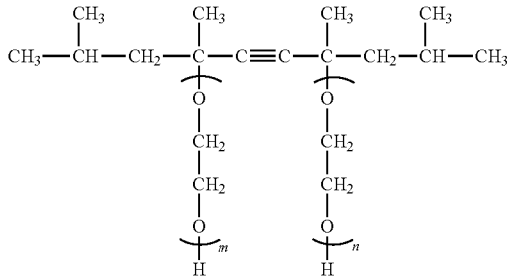

[m, n≤20, 0<m+n≤40]

$$R—(OCH_2CH_2)nH \quad \text{(III)}$$

[R indicates a hydrocarbon chain which has 6 to 14 carbon atoms and may be branched, and n is 5 to 20]

(IV)

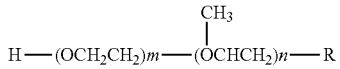

[R indicates a hydrocarbon chain having 6 to 14 carbon atoms, and m and n are numbers of 20 or less]

In addition to the compounds in Formulas (I) to (IV), for example, the followings can be used: alkyl and aryl ethers of polyhydric alcohols such as diethylene glycol monophenyl ether, ethylene glycol monophenyl ether, ethylene glycol monoallyl ether, diethylene glycol monophenyl ether, diethylene glycol monobutyl ether, propylene glycol monobutyl ether, and tetraethylene glycol chlorophenyl ether; nonionic surfactants such as polyoxyethylene polyoxypropylene block copolymers; fluorine-based surfactants; and lower alcohols such as ethanol and 2-propanol. In particular, diethylene glycol monobutyl ether is preferable.

The technical idea and effects thereof to be recognized from the embodiments and the modification examples described above will be described below.

The liquid ejecting apparatus includes the liquid ejector configured to eject the liquid from the nozzle, the wiping mechanism configured to wipe the nozzle surface on which the plurality of nozzles is disposed with the wiping member configured to absorb the liquid, the wiping-liquid supply mechanism configured to supply the wiping liquid to the wiping member, and the relatively-moving mechanism configured to move the liquid ejector and the wiping member relative to each other when the nozzle surface is wiped with the wiping member. The liquid ejecting apparatus is configured to perform wet-wiping of wiping the nozzle surface in a state where the wiping member has absorbed the wiping liquid and is configured to change a supply amount of the wiping liquid when the wiping member wipes the nozzle surface.

According to this configuration, it is possible to change the supply amount of the wiping liquid supplied to the wiping member. Thus, it is possible to supply the wiping liquid of an appropriate amount depending on an occasion to the wiping member. Accordingly, it is possible to appropriately perform wiping.

The liquid ejecting apparatus may further include the controller configured to change the supply amount of the wiping liquid when the wiping member wipes the nozzle surface, based on the status of the liquid ejecting apparatus.

According to this configuration, it is possible to supply the wiping liquid of an appropriate amount to the wiping member based on the status of the liquid ejecting apparatus.

The liquid ejecting apparatus may further include the detector configured to detect an ejection state of the liquid from the nozzle. The controller may change the supply amount of the wiping liquid when the wiping member wipes the nozzle surface, based on the result obtained by the detector detecting the ejection state.

According to this configuration, it is possible to supply the wiping liquid of an appropriate amount to the wiping member based on the ejection state of the liquid from the nozzle.

In the liquid ejecting apparatus, the wiping-liquid supply mechanism may supply the wiping liquid contained in a wiping liquid container coupled to the wiping-liquid supply mechanism, to the wiping member. The controller may change the supply amount of the wiping liquid when the wiping member wipes the nozzle surface, based on a contained amount of the wiping liquid contained in the wiping liquid container.

According to this configuration, it is possible to supply the wiping liquid of an appropriate amount to the wiping member based on the contained amount of the wiping liquid accommodated in the wiping liquid container.

The liquid ejecting apparatus may further include the operation portion configured to be operated to change the supply amount of the wiping liquid.

According to this configuration, it is possible to cause the user to randomly change the supply amount of the wiping liquid with the operation portion.

As a maintenance method of the liquid ejecting apparatus, there may be provided the maintenance method of the liquid ejecting apparatus including the liquid ejector configured to perform recording processing on a recording medium by ejecting the liquid from the nozzle, the wiping mechanism configured to wipe the nozzle surface on which the plurality of nozzles is disposed with the wiping member configured to absorb the liquid, the wiping-liquid supply mechanism configured to supply the wiping liquid to the wiping member, and the relatively-moving mechanism configured to move the liquid ejector and the wiping member relative to each other when the nozzle surface is wiped with the wiping member and being configured to perform wet-wiping of wiping the nozzle surface in a state where the wiping member has absorbed the wiping liquid. The method may include changing a supply amount of the wiping liquid when the wet-wiping is performed, based on a status of the liquid ejecting apparatus.

According to this method, it is possible to supply the wiping liquid of an appropriate amount to the wiping member based on the status of the liquid ejecting apparatus. Accordingly, it is possible to appropriately perform wiping.

As the maintenance method of the liquid ejecting apparatus, the supply amount of the wiping liquid in a case where the wet-wiping is performed when the liquid is not ejected from the nozzle in the recording processing may be set to be smaller than the supply amount of the wiping liquid in a case where the wet-wiping is performed when the recording processing is not performed.

When wet-wiping is performed in recording processing, if the wiping liquid remains on the nozzle surface, the liquid may not be properly ejected from the nozzle. According to this method, the supply amount of the wiping liquid when wet-wiping is performed in recording processing is set to be smaller than the supply amount of the wiping liquid when wet-wiping is performed in a case where recording processing is not performed. Therefore, the concern that the wiping liquid remains on the nozzle surface when wet-wiping is performed in recording processing is reduced. Thus, it is possible to appropriately perform wiping.

As the maintenance method of the liquid ejecting apparatus, the liquid ejecting apparatus may further include the detector configured to detect an ejection state of the liquid from the nozzle, and the supply amount of the wiping liquid when the wiping member wipes the nozzle surface may be changed based on a result obtained by the detector detecting the ejection state.

According to this method, it is possible to supply the wiping liquid of an appropriate amount to the wiping member based on the ejection state.

As the maintenance method of the liquid ejecting apparatus, when, regarding nozzles supposed to have the abnormal ejection state from a result obtained by the detector detecting the ejection state after the wiping member wipes the nozzle surface, the number of the nozzles on the wiping end side is greater than the number of the nozzles on the wiping start side, performed may be at least one of the change of the supply amount of the wiping liquid when the wiping member wipes the nozzle surface to be greater than the supply amount before the ejection state is detected and a change of a relative movement speed between the liquid ejector and the wiping member to be slower than the relative movement speed before the ejection state is detected.

When, regarding nozzles supposed to have an abnormal ejection state, the number of nozzles on the wiping end side is greater than the number of nozzles on the wiping start side, it may not be possible to sufficiently remove foreign matters on the nozzle surface when wiping is performed. Therefore, in such a case, at least one of the change of increasing the supply amount of the wiping liquid and the change of setting the relative movement speed between the liquid ejector and the wiping member to be slow is performed, and thus it is easy to remove the foreign matters on the nozzle surface by wiping. That is, according to this method, it is possible to appropriately perform wiping.

As the maintenance method of the liquid ejecting apparatus, the wiping-liquid supply mechanism may supply the wiping liquid contained in a wiping liquid container coupled to the wiping-liquid supply mechanism, to the wiping member. The controller may change the supply amount of the wiping liquid when the wiping member wipes the nozzle surface, based on a contained amount of the wiping liquid contained in the wiping liquid container. The supply amount of the wiping liquid in a case where the wet-wiping is performed when a contained amount of the wiping liquid contained in the wiping liquid container is smaller than a setting value may be set to be smaller than the supply amount of the wiping liquid in a case where the wet-wiping is performed when the contained amount of the wiping liquid contained in the wiping liquid container is equal to or greater than the setting value.

According to this method, the supply amount of the wiping liquid is set to be small when the contained amount of the wiping liquid is smaller than the setting value. Thus, consumption of the wiping liquid is suppressed when the contained amount of the wiping liquid is small. Thus, it is possible to increase the number of times of performing wet-wiping.

As the maintenance method of the liquid ejecting apparatus, when the contained amount of the wiping liquid contained in the wiping liquid container is smaller than a second setting value which is smaller than the setting value, non-wet wiping in which the wiping member wipes the nozzle surface without supplying the wiping liquid may be performed. The relative movement speed between the liquid ejector and the wiping member in the non-wet wiping may be slower than the relative movement speed between the liquid ejector and the wiping member in the wet-wiping which is performed when the contained amount of the wiping liquid is equal to or greater than the setting value.

In a case of non-wet wiping, since the wiping liquid is not supplied to the wiping member, removal of the foreign matters on the nozzle surface has difficulty in spite of wiping. Therefore, in the non-wet wiping operation, the relative movement speed between the liquid ejector and the wiping member is set to be slower than that in the wet-wiping operation, and thus it is easy to remove the foreign matters on the nozzle surface by wiping. According to this method, it is possible to appropriately perform wiping.

What is claimed is:

1. A liquid ejecting apparatus comprising:

a liquid ejector that ejects a liquid from a nozzle;

a wiping mechanism that wipes a nozzle surface on which a plurality of nozzles is disposed, with a wiping member configured to absorb the liquid;

a wiping-liquid supply mechanism that supplies a wiping liquid to the wiping member;

a relatively-moving mechanism that moves the liquid ejector and the wiping member relative to each other when the nozzle surface is wiped with the wiping member, wherein wet-wiping of wiping the nozzle surface in a state where the wiping member has absorbed the wiping liquid is performed, and a supply amount of the wiping liquid when the wiping member wipes the nozzle surface is variable, and a controller that changes the supply amount of the wiping liquid when the wiping member wipes the nozzle surface, based on a status of the liquid ejector.

2. The liquid ejecting apparatus according to claim 1, further comprising:

the controller that changes the supply amount of the wiping liquid when the wiping member wipes the nozzle surface, based on a status of the liquid ejecting apparatus.

3. The liquid ejecting apparatus according to claim 2, further comprising:

a detector configured to perform a detection to estimate an ejection state of the liquid from the nozzle, wherein the controller changes the supply amount of the wiping liquid when the wiping member wipes the nozzle surface, based on the ejection state estimated from a detection result detected by the detector.

4. The liquid ejecting apparatus according to claim 2, wherein the wiping-liquid supply mechanism supplies the wiping liquid contained in a wiping liquid container coupled to the wiping-liquid supply mechanism, to the wiping member, and the controller changes the supply amount of the wiping liquid when the wiping member wipes the nozzle surface, based on a contained amount of the wiping liquid contained in the wiping liquid container.

5. The liquid ejecting apparatus according to claim 1, further comprising:

an operation portion that is operated to change the supply amount of the wiping liquid.

6. The liquid ejecting apparatus according to claim 1, wherein the controller sets a supply amount of the wiping liquid when the wiping member wipes the nozzle surface based on a status of the liquid ejecting apparatus, the status of the liquid ejecting apparatus including at least one of (1) a temperature, (2) a humidity level, (3) a type of liquid being used by the liquid ejector, (4) a time elapsed since the liquid ejector is filled with the liquid, (5) a time elapsed since power of the liquid ejecting apparatus is turned on, or (6) a time elapsed since the wiping member is replaced.

7. The liquid ejecting apparatus according to claim 1, further comprising:

an operation unit configured to receive a user input, wherein the supply amount of the wiping liquid when the wiping member wipes the nozzle surface is received from the user input at the operation unit, the user input selecting one of a plurality of predetermined supply amounts.

8. A maintenance method of a liquid ejecting apparatus including a liquid ejector that performs recording processing on a recording medium by ejecting a liquid from a nozzle, a wiping mechanism that wipes a nozzle surface on which a plurality of nozzles is disposed, with a wiping member that absorbs the liquid, a wiping-liquid supply mechanism that supplies a wiping liquid to the wiping member, and a relatively-moving mechanism that moves the liquid ejector and the wiping member relative to each other when the wiping member wipes the nozzle surface, the method comprising:

performing wet-wiping of wiping the nozzle surface in a state where the wiping member has absorbed the wiping liquid; and changing a supply amount of the wiping liquid when the wet-wiping is performed, based on a status of the liquid ejecting apparatus.

9. The maintenance method of a liquid ejecting apparatus according to claim 8, wherein the supply amount of the wiping liquid in a case where the wet-wiping is performed when the liquid is not ejected from the nozzle in the recording processing is set to be smaller than the supply amount of the wiping liquid in a case where the wet-wiping is performed when the recording processing is not performed.

10. The maintenance method of a liquid ejecting apparatus according to claim 9, wherein the liquid ejecting apparatus further includes a detector that performs a detection to estimate an ejection state of the liquid from the nozzle, and the supply amount of the wiping liquid when the wiping member wipes the nozzle surface is changed based on the ejection state estimated from a detection result detected by the detector.

11. The maintenance method of a liquid ejecting apparatus according to claim 10, wherein when, regarding nozzles supposed to have an abnormal ejection state estimated from a detection result detected by the detector after the wiping member wipes the nozzle surface, the number of the nozzles on a wiping end side is greater than the number of the nozzles on a wiping start side, performed is at least one of a change of the supply amount of the wiping liquid when the wiping member wipes the nozzle surface to be greater than the supply amount before the detection is performed and a change of a relative movement speed between the liquid ejector and the wiping member to be slower than the relative movement speed before the detection is performed.

12. The maintenance method of a liquid ejecting apparatus according to claim 8, wherein the wiping-liquid supply mechanism supplies the wiping liquid contained in a wiping liquid container coupled to the wiping-liquid supply mechanism, to the wiping member, and the supply amount of the wiping liquid in a case where the wet-wiping is performed when a contained amount of the wiping liquid contained in the wiping liquid container is smaller than a setting value is set to be smaller than the supply amount of the wiping liquid in a case where the wet-wiping is performed when the contained amount of the wiping liquid contained in the wiping liquid container is equal to or greater than the setting value.

13. The maintenance method of a liquid ejecting apparatus according to claim 12, wherein when the contained amount of the wiping liquid contained in the wiping liquid container is smaller than a second setting value which is smaller than the setting value, non-wet wiping in which the wiping member wipes the nozzle surface without supplying the wiping liquid is performed, and a relative movement speed between the liquid ejector and the wiping member in the non-wet wiping is slower than the relative movement speed between the liquid ejector and the wiping member in the wet-wiping which is performed when the contained amount of the wiping liquid is equal to or greater than the setting value.

14. A liquid ejecting apparatus comprising:

a liquid ejector that ejects a liquid from a nozzle;

a wiping mechanism that wipes a nozzle surface on which a plurality of nozzles is disposed, with a wiping member configured to absorb the liquid;

a wiping-liquid supply mechanism that supplies a wiping liquid to the wiping member; and a relatively-moving mechanism that moves the liquid ejector and the wiping member relative to each other when the nozzle surface is wiped with the wiping member; and a controller configured to control the wiping-liquid supply mechanism, wherein wet-wiping of wiping the nozzle surface in a state where the wiping member has absorbed the wiping liquid is performed, and the controller sets a supply amount of the wiping liquid when the wiping member wipes the nozzle surface is based on a status of the liquid ejecting apparatus, the status of the liquid ejecting apparatus including at least one of (1) a temperature, (2) a humidity level, (3) a type of liquid being used by the liquid ejector, (4) a time elapsed since the liquid ejector is filled with the liquid, (5) a time elapsed since power of the liquid ejecting apparatus is turned on, (6) a time elapsed since the wiping member is replaced, or (7) a time elapsed since a previous wiping.

15. A liquid ejecting apparatus comprising:

a liquid ejector that ejects a liquid from a nozzle;

a wiping mechanism that wipes a nozzle surface on which a plurality of nozzles is disposed, with a wiping member configured to absorb the liquid;

a wiping-liquid supply mechanism that supplies a wiping liquid to the wiping member;

a relatively-moving mechanism that moves the liquid ejector and the wiping member relative to each other when the nozzle surface is wiped with the wiping member; and an operation unit configured to receive a user input, wherein wet-wiping of wiping the nozzle surface in a state where the wiping member has absorbed the wiping liquid is performed, and a supply amount of the wiping liquid when the wiping member wipes the nozzle surface is received from the user input at the operation unit, the user input selecting one of a plurality of predetermined supply amounts.

* * * * *